US008540020B2

(12) United States Patent
Stone et al.

(10) Patent No.: US 8,540,020 B2
(45) Date of Patent: Sep. 24, 2013

(54) CONVERTING ORGANIC MATTER FROM A SUBTERRANEAN FORMATION INTO PRODUCIBLE HYDROCARBONS BY CONTROLLING PRODUCTION OPERATIONS BASED ON AVAILABILITY OF ONE OR MORE PRODUCTION RESOURCES

(75) Inventors: Matthew T. Stone, Rosharon, TX (US); Ganesh Ghurye, Pearland, TX (US); Matthew T Shanley, Bellaire, TX (US); Peter Rasmussen, Conroe, TX (US); Xianghui Huang, Pearland, TX (US); Robert D. Kaminsky, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 437 days.

(21) Appl. No.: 12/764,624

(22) Filed: Apr. 21, 2010

(65) Prior Publication Data

US 2010/0282460 A1 Nov. 11, 2010

Related U.S. Application Data

(60) Provisional application No. 61/175,547, filed on May 5, 2009.

(51) Int. Cl.
*E21B 36/04* (2006.01)

(52) U.S. Cl.
USPC ..... 166/248; 166/60; 166/250.15; 166/272.1

(58) Field of Classification Search
USPC ..... 166/248, 245, 57, 60, 272.1, 302, 166/369, 261, 250.15, 402; 208/370
See application file for complete search history.

(56) References Cited

U.S. PATENT DOCUMENTS

| | | | |
|---|---|---|---|
| 363,419 | A | 5/1887 | Poetsch |
| 895,612 | A | 8/1908 | Baker |
| 1,342,780 | A | 6/1920 | Vedder |
| 1,422,204 | A | 7/1922 | Hoover et al. |

(Continued)

FOREIGN PATENT DOCUMENTS

| | | | |
|---|---|---|---|
| CA | 994694 | 8/1976 | |
| CA | 1288043 | 8/1991 | ..... 166/38 |

(Continued)

OTHER PUBLICATIONS

Miknis, F.P, et al (1985) "Isothermal Decomposition of Colorado Oil Shale", DOE/FE/60177-2288 (DE87009043) May 1985.

(Continued)

*Primary Examiner* — Daniel P Stephenson
(74) *Attorney, Agent, or Firm* — ExxonMobil Upstream Research Company-Law Department

(57) ABSTRACT

One or more methods, systems and computer readable mediums are utilized to provide treatment of a subterranean formation that contains solid organic matter, such as oil shale, tar sands, and/or coal formation. The treatment of the formation includes heating a treatment interval within the subterranean formation with one or more electrical in situ heaters. Available power, or other production resources, for the electrical heaters are determined at regular, predetermined intervals. Heating rates of the one or more electrical heaters are selectively controlled based on the determined available power at each regular, predetermined interval and based on an optimization model that outputs optimal heating rates for each of the electrical heaters at the determined available power.

40 Claims, 33 Drawing Sheets

(56) References Cited

U.S. PATENT DOCUMENTS 1,666,488 A 4/1928 Crawshaw
1,701,884 A 2/1929 Hogle
1,872,906 A 8/1932 Doherty
2,033,560 A 3/1936 Wells ..... 166/1
2,033,561 A 3/1936 Wells ..... 166/21
2,534,737 A 12/1950 Rose ..... 73/38
2,584,605 A 2/1952 Merriam et al.
2,634,961 A 4/1953 Ljungstrom ..... 262/3
2,732,195 A 1/1956 Ljungstrom ..... 262/3
2,777,679 A 1/1957 Ljungstrom ..... 262/3
2,780,450 A 2/1957 Ljungstrom ..... 262/3
2,795,279 A 6/1957 Sarapuu
2,812,160 A 11/1957 West et al. ..... 255/1.4
2,813,583 A 11/1957 Marx et al.
2,847,071 A 8/1958 De Priester ..... 166/39
2,887,160 A 5/1959 De Priester et al. ..... 166/59
2,895,555 A 7/1959 De Priester ..... 166/59
2,923,535 A 2/1960 Ljungstrom ..... 262/3
2,944,803 A 7/1960 Hanson ..... 262/3
2,952,450 A 9/1960 Purre ..... 262/3
2,974,937 A 3/1961 Kiel
3,004,601 A 10/1961 Bodine ..... 166/39
3,013,609 A 12/1961 Brink ..... 166/39
3,095,031 A 6/1963 Eurenius et al. ..... 158/99
3,106,244 A 10/1963 Parker
3,109,482 A 11/1963 O'Brien ..... 158/115
3,127,936 A 4/1964 Eurenius ..... 166/39
3,137,347 A 6/1964 Parker ..... 166/39
3,149,672 A 9/1964 Orkiszewski et al. ..... 166/39
3,170,815 A 2/1965 White
3,180,411 A 4/1965 Parker ..... 166/11
3,183,675 A 5/1965 Schroeder ..... 61/36
3,183,971 A 5/1965 McEver et al.
3,194,315 A 7/1965 Rogers ..... 166/57
3,205,942 A 9/1965 Sandberg
3,225,829 A 12/1965 Chown et al. ..... 166/59
3,228,869 A 1/1966 Irish
3,241,611 A 3/1966 Dougan ..... 166/7
3,241,615 A 3/1966 Brandt et al. ..... 166/59
3,254,721 A 6/1966 Smith et al. ..... 166/59
3,256,935 A 6/1966 Nabor et al. ..... 166/9
3,263,211 A 7/1966 Heidman
3,267,680 A 8/1966 Schlumberger ..... 61/36
3,271,962 A 9/1966 Dahms et al. ..... 61/36
3,284,281 A 11/1966 Thomas ..... 166/2
3,285,335 A 11/1966 Reistle, Jr.
3,288,648 A 11/1966 Jones
3,294,167 A 12/1966 Vogel ..... 166/11
3,295,328 A 1/1967 Bishop ..... 61/0.5
3,323,840 A 6/1967 Mason et al.
3,358,756 A 12/1967 Vogel
3,372,550 A 3/1968 Schroeder ..... 61/36
3,376,403 A 4/1968 Mircea ..... 219/10.49
3,382,922 A 5/1968 Needham
3,400,762 A 9/1968 Peacock et al. ..... 166/11
3,436,919 A 4/1969 Shock et al. ..... 61/0.5
3,439,744 A 4/1969 Bradley
3,468,376 A 9/1969 Slusser et al. ..... 166/272
3,500,913 A 3/1970 Nordgren et al. ..... 166/259
3,501,201 A 3/1970 Closmann et al. ..... 299/4
3,502,372 A 3/1970 Prats ..... 299/5
3,513,914 A 5/1970 Vogel ..... 166/271
3,515,213 A 6/1970 Prats
3,516,495 A 6/1970 Patton
3,521,709 A 7/1970 Needham
3,528,252 A 9/1970 Gail ..... 61/36
3,528,501 A 9/1970 Parker
3,547,193 A 12/1970 Gill
3,559,737 A 2/1971 Ralstin et al. ..... 166/281
3,572,838 A 3/1971 Templeton
3,599,714 A 8/1971 Messman et al. ..... 166/258
3,602,310 A 8/1971 Halbert ..... 166/303
3,613,785 A 10/1971 Closmann et al. ..... 166/271
3,620,300 A 11/1971 Crowson ..... 166/248
3,642,066 A 2/1972 Gill ..... 166/248
3,661,423 A 5/1972 Garrett
3,692,111 A 9/1972 Breithaupt et al. ..... 166/252
3,695,354 A 10/1972 Dilgren et al.
3,700,280 A 10/1972 Papadopoulos et al. ..... 299/5
3,724,225 A 4/1973 Mancini et al. ..... 62/12
3,729,965 A 5/1973 Gartner ..... 70/395
3,730,270 A 5/1973 Allred
3,739,851 A 6/1973 Beard ..... 166/254
3,741,306 A 6/1973 Papadopoulos ..... 166/252
3,759,328 A 9/1973 Ueber et al. ..... 166/303
3,759,329 A 9/1973 Ross ..... 166/308.1
3,759,574 A 9/1973 Beard ..... 299/4
3,779,601 A 12/1973 Beard
3,880,238 A 4/1975 Tham et al.
3,882,937 A 5/1975 Robinson ..... 166/267
3,882,941 A 5/1975 Pelofsky
3,888,307 A 6/1975 Closmann
3,924,680 A 12/1975 Terry
3,943,722 A 3/1976 Ross ..... 61/36
3,950,029 A 4/1976 Timmins ..... 299/2
3,958,636 A 5/1976 Perkins
3,967,853 A 7/1976 Closmann et al.
3,978,920 A 9/1976 Bandyopadhyay ..... 166/258
3,999,607 A 12/1976 Pennington et al.
4,003,432 A 1/1977 Paull et al. ..... 166/271
4,005,750 A 2/1977 Shuck ..... 166/308
4,007,786 A 2/1977 Schlinger
4,008,762 A 2/1977 Fisher et al.
4,008,769 A 2/1977 Chang
4,014,575 A 3/1977 French et al.
4,030,549 A 6/1977 Bouck ..... 166/280
4,037,655 A 7/1977 Carpenter
4,043,393 A 8/1977 Fisher et al.
4,047,760 A 9/1977 Ridley
4,057,510 A 11/1977 Crouch et al.
4,065,183 A 12/1977 Hill et al. ..... 229/4
4,067,390 A 1/1978 Camacho et al. ..... 166/302
4,069,868 A 1/1978 Terry
4,071,278 A 1/1978 Carpenter et al. ..... 299/5
4,093,025 A 6/1978 Terry
4,096,034 A 6/1978 Anthony ..... 176/87
4,125,159 A 11/1978 Vann ..... 166/285
4,140,180 A 2/1979 Bridges et al. ..... 166/248
4,149,595 A 4/1979 Cha
4,160,479 A 7/1979 Richardson et al.
4,163,475 A 8/1979 Cha et al.
4,167,291 A 9/1979 Ridley
4,169,506 A 10/1979 Berry
4,185,693 A 1/1980 Crumb et al.
4,186,801 A 2/1980 Madgavkar et al.
4,202,168 A 5/1980 Acheson et al.
4,239,283 A 12/1980 Ridley ..... 299/2
4,246,966 A 1/1981 Stoddard et al.
4,250,230 A 2/1981 Terry
4,265,310 A 5/1981 Britton et al. ..... 166/259
4,271,905 A 6/1981 Redford et al.
4,272,127 A 6/1981 Hutchins ..... 299/2
4,285,401 A 8/1981 Erickson
4,318,723 A 3/1982 Holmes et al.
4,319,635 A 3/1982 Jones ..... 166/263
4,320,801 A 3/1982 Rowland et al. ..... 166/248
4,324,291 A 4/1982 Wong et al.
4,340,934 A 7/1982 Segesman
4,344,485 A 8/1982 Butler
4,358,222 A 11/1982 Landau ..... 405/130
4,362,213 A 12/1982 Tabor
4,368,921 A 1/1983 Hutchins ..... 299/2
4,369,842 A 1/1983 Cha ..... 166/251
4,372,615 A 2/1983 Ricketts ..... 299/2
4,375,302 A 3/1983 Kalmar ..... 299/4
4,384,614 A 5/1983 Justheim
4,397,502 A 8/1983 Hines ..... 299/2
4,401,162 A 8/1983 Osborne ..... 166/248
4,412,585 A 11/1983 Bouck ..... 166/248
4,417,449 A 11/1983 Hegarty et al.
4,468,376 A 8/1984 Suggitt
4,473,114 A 9/1984 Bell et al.
4,474,238 A 10/1984 Gentry et al. ..... 166/268
4,483,398 A 11/1984 Peters et al.

4,485,869 A 12/1984 Sresty et al. ..... 166/248
4,487,257 A 12/1984 Dauphine ..... 166/60
4,487,260 A 12/1984 Pittman et al. ..... 166/259
4,495,056 A 1/1985 Venardos
4,511,382 A 4/1985 Valencia et al. ..... 62/20
4,533,372 A 8/1985 Valencia et al. ..... 62/12
4,537,067 A 8/1985 Sharp et al. ..... 73/151
4,545,435 A 10/1985 Bridges et al.
4,546,829 A 10/1985 Martin et al.
4,550,779 A 11/1985 Zakiewicz ..... 166/248
4,567,945 A 2/1986 Segalman ..... 166/248
4,589,491 A 5/1986 Perkins ..... 166/302
4,589,973 A 5/1986 Minden
4,602,144 A 7/1986 Vogel
4,607,488 A 8/1986 Karinthi et al. ..... 62/45
4,626,665 A 12/1986 Fort ..... 219/534
4,633,948 A 1/1987 Closmann
4,634,315 A 1/1987 Owen et al. ..... 405/217
4,637,464 A 1/1987 Forgac et al.
4,640,352 A 2/1987 Vanmeurs et al. ..... 166/245
4,671,863 A 6/1987 Tejeda ..... 204/266
4,694,907 A 9/1987 Stahl et al. ..... 166/303
4,704,514 A 11/1987 Van Egmond et al. ..... 219/278
4,705,108 A 11/1987 Little et al. ..... 166/248
4,706,751 A 11/1987 Gondouin
4,730,671 A 3/1988 Perkins
4,737,267 A 4/1988 Pao et al.
4,747,642 A 5/1988 Gash et al. ..... 299/11
4,754,808 A 7/1988 Harmon et al. ..... 166/254
4,776,638 A 10/1988 Hahn
4,779,680 A 10/1988 Sydansk
4,815,790 A 3/1989 Rosar et al. ..... 299/4
4,817,711 A 4/1989 Jeambey
4,828,031 A 5/1989 Davis
4,860,544 A 8/1989 Krieg et al. ..... 62/45
4,886,118 A 12/1989 Van Meurs et al. ..... 166/245
4,923,493 A 5/1990 Valencia et al. ..... 62/13
4,926,941 A 5/1990 Glandt et al. ..... 166/248
4,928,765 A 5/1990 Nielson
4,929,341 A 5/1990 Thirumalachar et al.
4,974,425 A 12/1990 Krieg et al. ..... 62/45.1
5,016,709 A 5/1991 Combe et al. ..... 166/245
5,036,918 A 8/1991 Jennings et al.
5,050,386 A 9/1991 Krieg et al. ..... 62/45.1
5,055,030 A 10/1991 Schirmer
5,055,180 A 10/1991 Klaila
5,082,055 A 1/1992 Hemsath
5,085,276 A 2/1992 Rivas et al.
5,117,908 A 6/1992 Hofmann
5,120,338 A 6/1992 Potts, Jr. et al. ..... 62/12
5,217,076 A 6/1993 Masek
5,236,039 A 8/1993 Edelstein
5,255,742 A 10/1993 Mikus ..... 166/303
5,275,063 A 1/1994 Steiger et al. ..... 73/865
5,297,626 A 3/1994 Vinegar et al. ..... 166/271
5,305,829 A 4/1994 Kumar ..... 166/245
5,372,708 A 12/1994 Gewertz
5,377,756 A 1/1995 Northrop et al.
5,392,854 A 2/1995 Vinegar et al. ..... 166/271
5,411,089 A 5/1995 Vinegar et al. ..... 166/272
5,416,257 A 5/1995 Peters ..... 588/1
5,620,049 A 4/1997 Gipson et al. ..... 166/248
5,621,844 A 4/1997 Bridges
5,661,977 A 9/1997 Shnell
5,730,550 A 3/1998 Andersland et al. ..... 405/128
5,838,634 A 11/1998 Jones et al.
5,844,799 A 12/1998 Joseph et al.
5,868,202 A 2/1999 Hsu
5,899,269 A 5/1999 Wellington et al. ..... 166/58
5,905,657 A 5/1999 Celniker
5,907,662 A 5/1999 Buettner
5,956,971 A 9/1999 Cole et al. ..... 62/623
6,015,015 A 1/2000 Luft et al.
6,016,867 A 1/2000 Gregoli et al.
6,023,554 A 2/2000 Vinegar et al. ..... 392/301
6,055,803 A 5/2000 Mastronarde et al.
6,056,057 A 5/2000 Vinegar et al.
6,079,499 A 6/2000 Mikus et al.
6,148,911 A 11/2000 Gipson et al. ..... 166/248
6,158,517 A 12/2000 Hsu
6,246,963 B1 6/2001 Cross et al.
6,247,358 B1 6/2001 Dos Santos ..... 73/152.11
6,328,104 B1 12/2001 Graue
6,434,436 B1 8/2002 Adamy et al.
6,480,790 B1 11/2002 Calvert et al.
6,540,018 B1 4/2003 Vinegar et al.
6,581,684 B2 6/2003 Wellington et al. ..... 166/245
6,585,046 B2 7/2003 Neuroth et al.
6,589,303 B1 7/2003 Lokhandwale et al.
6,591,906 B2 7/2003 Wellington et al.
6,607,036 B2 8/2003 Ranson et al. ..... 166/302
6,609,761 B1 8/2003 Ramey et al. ..... 299/5
6,668,922 B2 12/2003 Ziauddin et al.
6,684,644 B2 2/2004 Mittricker et al. ..... 60/772
6,684,948 B1 2/2004 Savage
6,708,758 B2 3/2004 de Rouffignac et al. ..... 166/245
6,709,573 B2 3/2004 Smith
6,712,136 B2 3/2004 de Rouffignac et al. ..... 166/245
6,715,546 B2 4/2004 Vinegar et al. ..... 166/245
6,722,429 B2 4/2004 de Rouffignac et al. ..... 166/245
6,742,588 B2 6/2004 Wellington et al. ..... 166/245
6,745,831 B2 6/2004 De Rouffignac et al. ..... 166/245
6,745,832 B2 6/2004 Wellington et al. ..... 166/245
6,752,210 B2 6/2004 de Rouffignac et al.
6,754,588 B2 6/2004 Cross et al.
6,764,108 B2 7/2004 Ernst et al.
6,782,947 B2 8/2004 de Rouffignac et al. ..... 166/245
6,796,139 B2 9/2004 Briley et al. ..... 62/260
6,820,689 B2 11/2004 Sarada
6,832,485 B2 12/2004 Sugarmen et al.
6,854,929 B2 2/2005 Vinegar et al. ..... 405/129.65
6,858,049 B2 2/2005 Mittricker ..... 48/127.7
6,877,555 B2 4/2005 Karanikas et al.
6,880,633 B2 4/2005 Wellington et al. ..... 166/245
6,887,369 B2 5/2005 Moulton et al. ..... 208/107
6,896,053 B2 5/2005 Berchenko et al. ..... 166/245
6,896,707 B2 5/2005 O'Rear et al.
6,913,078 B2 7/2005 Shahin et al. ..... 166/245
6,918,444 B2 7/2005 Passey et al. ..... 166/258
6,923,258 B2 8/2005 Wellington et al. ..... 166/245
6,932,155 B2 8/2005 Vinegar et al.
6,948,562 B2 9/2005 Wellington et al. ..... 166/272.1
6,951,247 B2 10/2005 De Rouffignac et al.
6,953,087 B2 10/2005 de Rouffignac et al. ..... 166/245
6,964,300 B2 11/2005 Vinegar et al. ..... 166/245
6,969,123 B2 11/2005 Vinegar et al. ..... 299/3
6,988,549 B1 1/2006 Babcock
6,994,160 B2 2/2006 Wellington et al.
6,997,518 B2 2/2006 Vinegar et al. ..... 299/5
7,001,519 B2 2/2006 Linden et al. ..... 210/602
7,004,247 B2 2/2006 Cole et al. ..... 166/242.1
7,004,251 B2 2/2006 Ward et al.
7,011,154 B2 3/2006 Maher et al. ..... 166/245
7,032,660 B2 4/2006 Vinegar et al. ..... 166/245
7,036,583 B2 5/2006 de Rouffignac et al. ..... 166/245
7,048,051 B2 5/2006 McQueen
7,051,807 B2 5/2006 Vinegar et al.
7,055,600 B2 6/2006 Messier et al.
7,063,145 B2 6/2006 Veenstra et al.
7,066,254 B2 6/2006 Vinegar et al. ..... 166/245
7,073,578 B2 7/2006 Vinegar et al. ..... 166/245
7,077,198 B2 7/2006 Vinegar et al. ..... 166/245
7,077,199 B2 7/2006 Vinegar et al. ..... 166/250.1
7,093,655 B2 8/2006 Atkinson ..... 166/266
7,096,942 B1 8/2006 de Rouffignac et al. ..... 166/245
7,096,953 B2 8/2006 de Rouffignac et al. ..... 166/302
7,100,994 B2 9/2006 Vinegar et al. ..... 299/7
7,104,319 B2 9/2006 Vinegar et al. ..... 166/245
7,121,342 B2 10/2006 Vinegar et al. ..... 166/302
7,124,029 B2 10/2006 Jammes et al.
7,165,615 B2 1/2007 Vinegar et al.
7,181,380 B2 2/2007 Dusterhoft et al.
7,198,107 B2 4/2007 Maguire
7,219,734 B2 5/2007 Bai et al.
7,225,866 B2 6/2007 Berchenko et al. ..... 166/245
7,243,618 B2 7/2007 Gurevich
7,322,415 B2 1/2008 de St. Remey
7,331,385 B2 2/2008 Symington et al. ..... 166/248

| | | | | |
|---|---|---|---|---|
| 7,353,872 | B2 | 4/2008 | Sandberg | 166/249 |
| 7,357,180 | B2 | 4/2008 | Vinegar et al. | 166/254.1 |
| 7,441,603 | B2 | 10/2008 | Kaminsky et al. | 166/308.1 |
| 7,461,691 | B2 | 12/2008 | Vinegar et al. | |
| 7,484,561 | B2 | 2/2009 | Bridges | 166/248 |
| 7,516,785 | B2 | 4/2009 | Kaminsky | 166/245 |
| 7,516,786 | B2 | 4/2009 | Dallas et al. | |
| 7,516,787 | B2 | 4/2009 | Kaminsky | 166/250.1 |
| 7,546,873 | B2 | 6/2009 | Kim et al. | |
| 7,549,470 | B2 | 6/2009 | Vinegar et al. | 166/245 |
| 7,556,095 | B2 | 7/2009 | Vinegar | 166/302 |
| 7,617,869 | B2 | 11/2009 | Carney | |
| 7,631,691 | B2 | 12/2009 | Symington et al. | |
| 7,644,993 | B2 | 1/2010 | Kaminsky et al. | |
| 7,647,971 | B2 | 1/2010 | Kaminsky | |
| 7,647,972 | B2 | 1/2010 | Kaminsky | |
| 7,654,320 | B2 | 2/2010 | Payton | |
| 7,669,657 | B2 | 3/2010 | Symington et al. | |
| 7,743,826 | B2 | 6/2010 | Harris et al. | |
| 7,798,221 | B2 | 9/2010 | Vinegar et al. | |
| 7,857,056 | B2 | 12/2010 | Kaminsky et al. | |
| 7,860,377 | B2 | 12/2010 | Vinegar et al. | |
| 7,905,288 | B2 | 3/2011 | Kinkead | |
| 2001/0049342 | A1 | 12/2001 | Passey et al. | |
| 2002/0013687 | A1 | 1/2002 | Ortoleva | |
| 2002/0023751 | A1 | 2/2002 | Neuroth et al. | |
| 2002/0029882 | A1 | 3/2002 | Rouffignac et al. | |
| 2002/0049360 | A1 | 4/2002 | Wellington et al. | |
| 2002/0077515 | A1 | 6/2002 | Wellington et al. | |
| 2002/0099504 | A1 | 7/2002 | Cross et al. | |
| 2003/0080604 | A1 | 5/2003 | Vinegar et al. | |
| 2003/0085570 | A1 | 5/2003 | Ernst et al. | |
| 2003/0111223 | A1 | 6/2003 | Rouffignac et al. | |
| 2003/0131994 | A1 | 7/2003 | Vinegar et al. | |
| 2003/0131995 | A1 | 7/2003 | de Rouffignac et al. | |
| 2003/0178195 | A1 | 9/2003 | Agee et al. | |
| 2003/0183390 | A1 | 10/2003 | Veenstra et al. | |
| 2003/0192691 | A1 | 10/2003 | Vinegar et al. | |
| 2003/0196788 | A1 | 10/2003 | Vinegar et al. | |
| 2003/0196789 | A1 | 10/2003 | Wellington | |
| 2003/0209348 | A1 | 11/2003 | Ward et al. | |
| 2003/0213594 | A1 | 11/2003 | Wellington et al. | |
| 2004/0020642 | A1 | 2/2004 | Vinegar et al. | |
| 2004/0140095 | A1 | 7/2004 | Vinegar et al. | |
| 2004/0198611 | A1 | 10/2004 | Atkinson | |
| 2004/0211557 | A1* | 10/2004 | Cole et al. | 166/242.1 |
| 2005/0051327 | A1 | 3/2005 | Vinegar et al. | |
| 2005/0252656 | A1 | 11/2005 | Maguire | |
| 2005/0252832 | A1 | 11/2005 | Doyle et al. | |
| 2005/0252833 | A1 | 11/2005 | Doyle et al. | |
| 2005/0269077 | A1* | 12/2005 | Sandberg | 166/249 |
| 2005/0269088 | A1 | 12/2005 | Vinegar et al. | |
| 2006/0021752 | A1 | 2/2006 | de St. Remey | |
| 2006/0100837 | A1 | 5/2006 | Symington et al. | |
| 2006/0213657 | A1 | 9/2006 | Berchenko et al. | |
| 2007/0000662 | A1 | 1/2007 | Symington et al. | |
| 2007/0023186 | A1 | 2/2007 | Kaminsky et al. | |
| 2007/0045265 | A1 | 3/2007 | McKinzie, II | 219/207 |
| 2007/0045267 | A1 | 3/2007 | Vinegar et al. | |
| 2007/0084418 | A1 | 4/2007 | Gurevich | |
| 2007/0095537 | A1 | 5/2007 | Vinegar | |
| 2007/0102359 | A1 | 5/2007 | Lombardi et al. | 210/639 |
| 2007/0131415 | A1 | 6/2007 | Vinegar et al. | |
| 2007/0144732 | A1 | 6/2007 | Kim et al. | 166/245 |
| 2007/0209799 | A1 | 9/2007 | Vinegar et al. | 166/302 |
| 2007/0246994 | A1 | 10/2007 | Symington et al. | 299/3 |
| 2008/0087420 | A1 | 4/2008 | Symington et al. | 166/245 |
| 2008/0087421 | A1 | 4/2008 | Kaminsky | 166/245 |
| 2008/0087426 | A1 | 4/2008 | Kaminsky | 166/271 |
| 2008/0087427 | A1 | 4/2008 | Symington et al. | 166/272.1 |
| 2008/0087428 | A1 | 4/2008 | Symington et al. | 166/272.2 |
| 2008/0173443 | A1 | 7/2008 | Symington et al. | 166/248 |
| 2008/0185145 | A1 | 8/2008 | Carney et al. | |
| 2008/0207970 | A1 | 8/2008 | Meurer et al. | 484/24 |
| 2008/0230219 | A1 | 9/2008 | Kaminsky | 166/248 |
| 2008/0271885 | A1 | 11/2008 | Kaminsky | 166/245 |
| 2008/0283241 | A1 | 11/2008 | Kaminsky et al. | 166/245 |
| 2008/0289819 | A1 | 11/2008 | Kaminsky et al. | 166/256 |
| 2008/0290719 | A1 | 11/2008 | Symington et al. | 299/3 |
| 2009/0038795 | A1 | 2/2009 | Kaminsky et al. | |
| 2009/0050319 | A1 | 2/2009 | Kaminsky et al. | 166/257 |
| 2009/0101346 | A1 | 4/2009 | Vinegar et al. | |
| 2009/0101348 | A1 | 4/2009 | Kaminsky | |
| 2009/0107679 | A1 | 4/2009 | Kaminsky | |
| 2009/0133935 | A1 | 5/2009 | Kinkead | |
| 2009/0145598 | A1 | 6/2009 | Symington et al. | |
| 2009/0308608 | A1 | 12/2009 | Kaminsky et al. | |
| 2010/0078169 | A1 | 4/2010 | Symington et al. | |
| 2010/0089575 | A1 | 4/2010 | Kaminsky et al. | |
| 2010/0089585 | A1 | 4/2010 | Kaminsky | |
| 2010/0095742 | A1 | 4/2010 | Symington et al. | |
| 2010/0101793 | A1 | 4/2010 | Symington et al. | |
| 2010/0218946 | A1 | 9/2010 | Symington et al. | |
| 2010/0282460 | A1 | 11/2010 | Stone et al. | |
| 2010/0319909 | A1 | 12/2010 | Symington et al. | |

FOREIGN PATENT DOCUMENTS

| | | |
|---|---|---|
| CA | 2560223 | 3/2007 |
| EP | 0387846 | 9/1990 |
| GB | 855408 | 11/1960 |
| GB | 1454324 | 11/1976 |
| GB | 1463444 | 2/1977 |
| GB | 1 478 880 | 7/1977 |
| GB | 1501310 | 2/1978 |
| GB | 1559948 | 1/1980 |
| GB | 1595082 | 8/1981 |
| WO | WO 82/01408 | 4/1982 |
| WO | WO 90/06480 | 6/1990 |
| WO | WO 99/67504 | 12/1999 |
| WO | WO 01/78914 | 10/2001 |
| WO | WO 01/81505 | 11/2001 |
| WO | WO 02/085821 | 10/2002 |
| WO | WO 2005/010320 | 2/2005 |
| WO | WO 2005/045192 | 5/2005 |
| WO | WO 2006/115943 | 11/2006 |
| WO | WO2007/033371 | 3/2007 |
| WO | WO2007/050445 | 5/2007 |
| WO | WO 2007/050479 | 5/2007 |
| WO | WO2010/047859 | 4/2010 |

OTHER PUBLICATIONS

Motzfeldt, K. (1954) "The Thermal Decomposition of Sodium Carbonate by the Effusion Method," *Jrnl. Phys. Chem.*, v. Lix, pp. 139-147.

Mut, Stephen (2005) "The Potential of Oil Shale," *Shell Oil Presentation at National Academies, Trends in Oil Supply Demand*, in Washington, DC, Oct. 20-21, 2005, 11 pages.

Needham, et al (1976) "Oil Yield and Quality from Simulated In-Situ Retorting of Green River Oil Shale", Society of Petroleum Engineers of American Institute of Mining, Metallurgical and Petroleum Engineers, Inc. SPE 6069.

Newkirk, A. E. et al. (1958) "Drying and Decomposition of Sodium Carbonate," *Anal. Chem.*, 30(5), pp. 982-984.

Nielsen, K. R., (1995) "Colorado Nahcolite: A Low Cost Source of Sodium Chemicals," *7th Annual Canadian Conference on Markets for Industrial Minerals*, (Vancouver, Canada, Oct. 17-18) pp. 1-9.

Persoff, P. et al. (1979) "Control strategies for abandoned in situ oil shale retorts," J. H. Gary (ed.), *12th Oil Shale Symposium Proceedings*, Colorado School of Mines, Golden, CO., Apr. 18-20, pp. 72-80.

Peters, G., (1990) "The Beneficiation of Oil Shale by the Solution Mining of Nahcolite," *23rd Colorado School of Mines Oil Shale Symposium* (Golden, CO) pp. 142-151.

Prats, M. et al. (1975) "The Thermal Conductivity and Diffusivity of Green River Oil Shales", *Journal of Petroleum Technology*, pp. 97-106, Jan. 1975.

Prats, M., et al. (1977) "Soluble-Salt Processes for In-Situ Recovery of Hydrocarbons from Oil Shale," *Journal of Petrol. Technol.*, pp. 1078-1088.

Rajeshwar, K. et al. (1979) "Review: Thermophysical Properties of Oil Shales", *Journal of Materials Science*, v.14, pp. 2025-2052.

Ramey, M. et al. (2004) "The History and Performance of Vertical Well Solution Mining of Nahcolite ($NaHCO_3$) in the Piceance Basin, Northwestern, Colorado, USA," *Solution Mining Research Institute: Fall 2004 Technical Meeting* (Berlin, Germany).

Reade Advanced Materials; Electrical resistivity of materials. Retrieved from internet: http://www.reade.com/Particle%5FBriefings/elec%5Fres.html.
Riva, D. et al. (1998) "Suncor down under: the Stuart Oil Shale Project", Annual Meeting of the *Canadian Inst. of Mining, Metallurgy, and Petroleum*, Montreal, May 3-7.
Rupprecht, R. (1979) "Application of the Ground-Freezing Method to Penetrate a Sequence of Water-Bearing and Dry Formations—Three Construction Cases," *Engineering Geology*, 13, pp. 541-546.
Salamonsson, G. (1951) "The Ljungstrom In Situ Method for Shale-Oil Recovery," *2nd Oil Shale and Cannel Coal Conference*, 2, Glasgow, Scotland, Inst. of Petrol., London, pp. 260-280.
Sandberg, C. R. et al. (1962) "In-Situ Recovery of Oil from Oil Shale—A Review and Summary of Field and Laboratory Studies," RR62.039FR, Nov. 1962.
Sierra, R. et al. (2001) "Promising Progress in Field Application of Reservoir Electrical Heating Methods," *SPE 69709*, SPE Int'l Thermal Operations and Heavy Oil Symposium, Venezuela, Mar. 2001, 17 pages.
Siskin, M. et al. (1995) "Detailed Structural Characterization of the Organic Material in Rundel Ramsay Crossing and Green River Oil Shales," *Kluwer Academic Publishers*, pp. 143-158.
Smith, F. M. (1966) "A Down-hole Burner—Versatile Tool for Well Heating," *25th Tech. Conf on Petroleum Production*, Pennsylvania State Univ., pp. 275-285.
Sresty, G. C.; et al. (1982) "Kinetics of Low-Temperature Pyrolysis of Oil Shale by the IITRI RF Process," *Colorado School of Mines; Fifteenth Oil Shale Symposium Proceedings*, Aug. 1982, pp. 411-423.
Stevens, A. L., and Zahradnik, R. L. (1983) "Results from the simultaneous processing of modified in situ retorts 7& 8", Gary, J. H., ed., *16th Oil Shale Symp.*, CSM, p. 267-280.
Stoss, K. et al. (1979) "Uses and Limitations of Ground Freezing With Liquid Nitrogen," *Engineering Geology*, 13, pp. 485-494.
Symington, W.A., et al (2006) ExxonMobil's electrofrac process for in situ oil shale conversion 26th Oil Shale Symposium, Colorado School of Mines.
Templeton, C. C. (1978) "Pressure-Temperature Relationship for Decomposition of Sodium Bicarbonate from 200 to 600° F," *J of Chem. and Eng. Data*, 23(1), pp. 7-8.
Thomas, A. M. (1963) "Thermal Decomposition of Sodium Carbonate Solutions," *J. of Chem. and Eng. Data*, 8(1), pp. 51-54.
Thomas, G. W. (1964) "A Simplified Model of Conduction Heating in Systems of Limited Permeability," *Soc.Pet. Engineering Journal*, Dec. 1964, pp. 335-344.
Thomas, G. W. (1966) "Some Effects of Overburden Pressure on Oil Shale During Underground Retorting," *Society of Petroleum Engineers Journal*, pp. 1-8, Mar. 1966.
Tihen, S. S. et al. (1967) "Thermal Conductivity and Thermal Diffusivity of Green River Oil Shale," *Thermal Conductivity: Proceedings of the Seventh Conference* (Nov. 13-16, 1967), *NBS Special Publication* 302, pp. 529-535, 1968.
Tisot, P. R. et al. (1970) "Structural Response of Rich Green River Oil Shales to Heat and Stress and Its Relationship to Induced Permeability," *Journal of Chemical Engineering Data*, v. 15(3), pp. 425-434.
Tisot, P. R. et al. (1971) "Structural Deformation of Green River Oil Shale as It Relates to In Situ Retorting," *US Bureau of Mines Report of Investigations* 7576, 1971.
Tisot, P. R. (1975) "Structural Response of Propped Fractures in Green River Oil Shale as It Relates to Underground Retorting," *US Bureau of Mines Report of Investigations 8021*.
Tissot, B. P., and Welte, D. H. (1984) *Petroleum Formation and Occurrence*, New York, Springer-Verlag, p. 160-174, 175-198 and 254-266.
Tissot, B. P., and Welte, D. H. (1984) *Petroleum Formation and Occurrence*, New York, Springer-Verlag, p. 267-289 and 470-492.
Tyner, C. E. et al. (1982) "Sandia/Geokinetics Retort 23: a horizontal in situ retorting experiment", Gary, J. H., ed., *15th Oil Shale Symp.*, CSM, p. 370-384.
Yen, T. F. et al. (1976) *Oil Shale*, Amsterdam, Elsevier, p. 216-267.
Oil & Gas Journal, 1998, "Aussie oil shale project moves to Stage 2", Oct. 26, p. 42.
Reade Advanced Materials; Electrical resistivity of materials. Retrieved from internet: http://www.reade.com/Particle%5FBriefings/elec%5Fres.html.
"Encyclopedia of Chemical Technology" (4th ed.), *Alkali and Chlorine Products*, pp. 1025-1039 (1998).
EP Search Report dated Apr. 21, 2006 (RS113865, corresponding to U.S. Appl. No. 11/726,651).
EP Search Report dated Feb. 16, 2007 (RS 114807, Corresponding to U.S. Appl. No. 11/973,753).
EP Search Report dated Mar. 12, 2009 (EP 08 00 3956,—Corresponding to U.S. Appl. No. 12/271,521).
EP Search Report dated Dec. 29, 2003 (RS 110243, Corresponding to US Pat 7,331,385).
International Search Report for PCT/US04/11508, Jan. 5, 2005.
International Search Report for PCT/US07/07133, Jan. 4, 2008.
International Search Report for PCT/US07/21669, Apr. 29, 2008.
International Search Report for PCT/US08/88045, Feb. 12, 2009.
International Search Report for PCT/US07/021968, May 14, 2008.
International Search Report for PCT/US07/021968, May 21, 2008.
International Search Report for PCT/US08/083815, Mar. 20, 2009.
International Search Report for PCT/US09/055403, Oct. 22, 2009.
US Pat No. 7,331,385—Office Action mailed Jul. 12, 2007.
US Pat No. 7,516,785—Office Action mailed Apr. 2, 2008.
US Pat No. 7,516,787—Office Action mailed Apr. 3, 2008.
US Pat No. 7,644,993—Office Action mailed Jun. 24, 2009.
U.S. Appl. No. 11/973,750 Office Action mailed Dec. 4, 2008.
Allred, (1964) "Some Characteristic Properties of Colorado Oil Shale Which May Influence In Situ Processing," *Quarterly Colo. School of Mines, 1st Symposium Oil Shale*, v.59. No. 3, pp. 47-75.
Baugman, G. L. (1978) *Synthetic Fuels Data Handbook*, Second Edition, Cameron Engineers Inc.
Berry, K. L., et al. (1982) "Modified in situ retorting results of two field retorts", Gary, J. H., ed., 15th Oil Shale Symp., CSM, pp. 385-396.
Boyer, H. E. et al. (1985) "Chapter 16: Heat-Resistant Materials," *Metals Handbook*, American Society for Metals, 16 pages.
Brandt, A. R., "*Converting Oil Shale to Liquid Fuels: Energy Inputs and Greenhouse Gas Emissions of the Shell in Situ Conversion Process*," Environ. Sci. Technol. 2008, 42, pp. 7489-7495.
Brandt, H. et al. (1965) "Stimulating Heavy Oil Reservoirs With Downhole Air-Gas Burners," *World Oil*, (Sep. 1965), pp. 91-95.
Bridges, J. E., et al. (1983) "The IITRI in situ fuel recovery process", *J. Microwave Power*, v. 18, pp. 3-14.
Burnham, A. K. et al. (1983) "High-Pressure Pyrolysis of Green River Oil Shale" in Geochemistry and Chemistry of Oil Shales: ACS Symposium Series.
Burwell, E. L. et al. (1970) "Shale Oil Recovery by In-Situ Retorting—A Pilot Study" Journal of Petroleum Engr., Dec. 1970, pp. 1520-1524.
Chute, F. S., and Vermeulen, F. E., (1988) "Present and potential applications of electromagnetic heating in the in situ recovery of oil", AOSTRA J. Res., v. 4, pp. 19-33.
Chute, F. S. and Vermeulen, F.E., (1989) "Electrical heating of reservoirs", Hepler, L., and Hsi, C., eds., AOSTRA Technical Handbook on Oil Sands, Bitumens, and Heavy Oils, Chapt. 13, pp. 339-376.
Cook, G. L. et al. (1968) "The Composition of Green River Shale Oils" United Nations Symposium of the Development and Utilization of Oil Shale Resources, 23 pgs.
Covell, J. R., et al. (1984) "Indirect in situ retorting of oil shale using the TREE process", Gary, J. H., ed., 17th Oil Shale Symposium Proceedings, Colorado School of Mines, pp. 46-58. c.
Cummins, J. J. et al. (1972) "Thermal Degradation of Green River Kerogen at 150 to 350C: Rate of Product Formation, Report of Investigation 7620," *US Bureau of Mines*, 1972.
Day, R. L., (1998) "Solution Mining of Colorado Nahcolite, Wyoming State Geological Survey Public Information Circular 40," *Proceedings of the First International Soda Ash Conference*, V.II (Rock Springs, Wyoming, Jun. 10-12) pp. 121-130.
DePriester, C. et al. (1963) "Well Stimulation by Downhole Gas-Air Burner," *Jrnl. Petro. Tech.*, (Dec. 1963), pp. 1297-1302.
Dougan, P. M. et al. (1981) "BX In Situ Oil Shale Project," *Colorado School of Mines; Fourteenth Oil Shale Symposium Proceedings*, 1981, pp. 118-127.

Dougan, P. M. (1979) "The BX in Situ Oil Shale Project," *Chem. Engr. Progress*, pp. 81-84.
Duncan, D. C., (1967) "Geologic Setting of Oil Shale Deposits and World Prospects," in *Proceedings of the Seventh World Petroleum Congress*, v.3, Elsevier Publishing, pp. 659-667.
Dunks, G. et al. (1983) "Electrochemical Studies of Molten Sodium Carbonate," *Inorg. Chem.*, 22, pp. 2168-2177.
Dyni, J. R., (1974) "Stratigraphy and Nahcolite Resources of the Saline Facies of the Green River Formation in Northwest Colorado," in D.K. Murray (ed.), *Guidebook to the Energy Resources of the Piceance Creek Basin Colorado, Rocky Mountain Association of Geologists*, Guidebook, pp. 111-122.
Fisher, S. T. (1980) "A Comparison of Eleven Processes for Production of Energy from the Solid Fossil Fuels of North America," *SPE* 9098, pp. 1-27.
Fox, J. P, (1980) "Water-related Impacts of In-Situ Oil Shale Processing," *California Univ., Berkeley, Lawrence Berkeley Lab*, Chapters 6-7.
Hardy, M. et al. (2003) "Solution Mining of Nahcolite at the American Soda Project, Piceance Creek, Colorado," *SME Annual Mtg.*, Feb. 24-26, Cincinnati, Ohio, Preprint 03-105.
Hardy, M., et al. (2003) "Solution Mining of Nahcolite at American Soda's Yankee Gulch Project," *Mining Engineering*, Oct. 2003, pp. 23-31.
Hill, G.R. et al. (1967) "The Characteristics of a Low Temperature In Situ Shale Oil," *4th Symposium on Oil Shale, Quarterly of the Colorado School of Mines*, v.62(3), pp. 641-656.
Humphrey, J. P. (1978) "Energy from in situ processing of Antrim oil shale", *DOE Report FE-2346-29*.
Ingram, L. L. et al. (1983) "Comparative Study of Oil Shales and Shale Oils from the Mahogany Zone, Green River Formation (USA) and Kerosene Creek Seam, Rundle Formation (Australia)," *Chemical Geology*, 38, pp. 185-212.
Ireson, A. T. (1990) "Review of the Soluble Salt Process for In-Situ Recovery of Hydrocarbons from Oil Shale with Emphasis on Leaching and Possible Beneficiation," *23rd Colorado School of Mines Oil Shale Symposium* (Golden, Colorado), 152-161.
Jacobs, H. R. (1983) "Analysis of the Effectiveness of Steam Retorting of Oil Shale", *AIChE Symposium Series—Heat Transfer*—Seattle 1983 pp. 373-382.
Johnson, D. J. (1966) "Decomposition Studies of Oil Shale," *University of Utah*, May 1966.
Katz, D.L. et al. (1978) "*Predicting Phase Behavior of Condensate/Crude-Oil Systems Using Methane Interaction Coefficients, J Petroleum Technology*", pp. 1649-1655.
Kuo, M. C. T. et al (1979) "Inorganics leaching of spent shale from modified in situ processing," J. H. Gary (ed.) *Twelfth Oil Shale Symposium Proceedings*, Colorado School of Mines, Golden CO., Apr. 18-20, pp. 81-93.
Laughrey, C. D. et al. (2003) "Some Applications of Isotope Geochemistry for Determining Sources of Stray Carbon Dioxide Gas," *Environmental Geosciences*, 10(3), pp. 107-122.
Lekas, M. A. et al. (1991) "Initial evaluation of fracturing oil shale with propellants for in situ retorting—Phase 2", DOE Report DOE/MC/11076-3064.
Ali, A.H.A, et al, (2003) "Watching Rocks Change-Mechanical Earth Modeling", *Oilfield Review*, pp. 22-39.
Asquith, G., et al., (2004) *Basic Well Log Analysis*, Second Ed., Chapter 1, pp. 1-20.
Ball, J.S., et al. (1949) "Composition of Colorado Shale-Oil Naphtha", *Industrial and Engineering Chemistry*, vol. 41, No. 3 pp. 581-587.
Barnes, A. L. et al. (1968) "Quarterly of the Colorado School of Mines" *Fifth Symposium on Oil Shale*, v. 63(4), Oct. 1968, pp. 827-852.
Bastow, T.P., (1998) Sedimentary Processes Involving Aromatic Hydrocarbons >>. Thesis (PhD in Applied Chemistry) Curtin University of Technology (Australia), Dec., p. 102.
Blanton, T. L. et al, (1999) "Stress Magnitudes from Logs: Effects of Tectonic Strains and Temperature", *SPE Reservoir Eval. & Eng.* 2, vol. 1, February, pp. 62-68.
Charlier, R. et al, (2002) "Numerical Simulation of the Coupled Behavior of Faults During the Depletion of a High-Pressure/High-Temperature Reservoir", *Society of Petroleum Engineers*, SPE 78199, pp. 1-12.
Fainberg, V. et al. (1998) "Integrated Oil Shale Processing Into Energy and Chemicals Using Combined-Cycle Technology," *Energy Sources*, v.20.6, Abstract, 1 page.
Farouq Ali, S. M., (1994), "Redeeming features of in situ combustion", DOE/NIPER *Symposium on In Situ Combustion Practices-Past, Present, and Future Application*, Tulsa, OK, Apr. 21-22, No. ISC 1, p. 3-8.
Fredrich, J. T. et al, (1996) "Three-Dimensional Geomechanical Simulation of Reservoir Compaction and Implications for Well Failures in the Belridge Diatomite", *Society of Petroleum Engineers* SPE 36698, pp. 195-210.
Fredrich, J. T. et al, (2000) "Geomechanical Modeling of Reservoir Compaction, Surface Subsidence, and Casing Damage at the Belridge Diatomite Field", *SPE Reservoir Eval. & Eng.3*, vol. 4, August, pp. 348-359.
Fredrich, J. T. et al, (2003) "Stress Perturbations Adjacent to Salt Bodies in the Deepwater Gulf of Mexico", *Society of Petroleum Engineers* SPE 84554, pp. 1-14.
Frederiksen, S. et al, (2000) "A Numerical Dynamic Model for the Norwegian-Danish Basin", *Tectonophysics*, 343, 2001, pp. 165-183.
Gatens III, J. M. et al, (1990) "In-Situ Stress Tests and Acoustic Logs Determine Mechanical Properties and Stress Profiles in the Devonian Shales", *SPE Formation Evaluation* SPE 18523, pp. 248-254.
Garthoffner, E. H., (1998), "Combustion front and burned zone growth in successful California ISC projects", SPE 46244, pp. 1-11.
Hansen, K. S. et al, (1989) "Earth Stress Measurements in the South Belridge Oil Field, Kern County, California", *SPE Formation Evaluation*, December pp. 541-549.
Hansen, K. S. et al, (1993) "Finite-Element Modeling of Depletion-Induced Reservoir Compaction and Surface Subsidence in the South Belridge Oil Field, California", SPE 26074, pp. 437-452.
Henderson, W, et al. (1968) "Thermal Alteration as a Contributory Process to the Genesis of Petroleum", *Nature* vol. 219, pp. 1012-1016.
Hilbert, L. B. et al, (1999) "Field-Scale and Wellbore Modeling of Compaction-Induced Casing Failures", *SPE Drill. & Completion*, 14(2), June pp. 92-101.
Hill, G. R. et al. (1967) "Direct Production of a Low Pour Point High Gravity Shale Oil", *I&EC Product Research and Development*, 6(1), March pp. 52-59.
Holditch, S. A., (1989) "Pretreatment Formation Evaluation", *Recent Advances in Hydraulic Fracturing*, SPE Monograph vol. 12, Chapter 2 (Henry L. Doherty Series), pp. 39-56.
Holmes, A. S. et al. (1982) "Process Improves Acid Gas Separation," *Hydrocarbon Processing*, pp. 131-136.
Holmes, A. S. et al. (1983) "Pilot Tests Prove Out Cryogenic Acid-Gas/Hydrocarbon Separation Processes," *Oil & Gas Journal*, pp. 85-91.
Cipolla, C.L., et al. (1994), "Practical Application of in-situ Stress Profiles", *Society of Petroleum Engineers*, SPE 28607, pp. 487-499.
Domine, F. et al. (2002) "Up to What Temperature is Petroleum Stable? New Insights from a 5200 Free Radical Reactions Model", *Organic Chemistry*, 33, pp. 1487-1499.
Dusseault, M.B. (1998) "Casing Shear: Causes, Cases, Cures", Society of Petroleum Engineers, SPE 48,864 pp. 337-349.
Freund, H. et al., (1989) "Low-Temperature Pyrolysis of Green River Kerogen", *The American Association of Petroleum Geologists Bulletin*, v. 73, No. 8 (August) pp. 1011-1017.
Greaves, M., et al. (1994) "In situ combustion (ISC) processes: 3D studies of vertical and horizontal wells", *Europe Comm. Heavy Oil Technology in a Wider Europe Symposium*, Berlin, Jun. 7-8, p. 89-112.
Hansen, K. S. et al, (1995) "Modeling of Reservoir Compaction and Surface Subsidence at South Belridge", *SPE Production & Facilities*, August pp. 134-143.
Kenter, C. J. et al, (2004) "Geomechanics and 4D: Evaluation of Reservoir Characteristics from Timeshifts in the Overburden", *Gulf Rocks 2004, 6th North America Rock Mechanics Symposium*

(*NARMS*): *Rock Mechanics Across Borders and Disciplines*, Houston, Texas, Jun. 5-9, ARMA/NARMS 04-627.
Le Pourhiet, L. et al, (2003) "Initial Crustal Thickness Geometry Controls on the Extension in a Back Arc Domain: Case of the Gulf of Corinth", *Tectonics*, vol. 22, No. 4, pp. 6-1—6-14.
Lundquist, L. (1951) "Refining of Swedish Shale Oil", *Oil Shale Cannel Coal Conference*, vol./Issue: 2, pp. 621-627.
Marotta, A. M. et al, (2003) "Numerical Models of Tectonic Deformation at the Baltica-Avalonia Transition Zone During the Paleocene Phase of Inversion", *Tectonophysics*, 373, pp. 25-37.
Mohammed, Y.A., et al (2001) "A Mathematical Algorithm for Modeling Geomechanical Rock Properties of the Khuff and PreKhuff Reservoirs in Ghawar Field", *Society of Petroleum Engineers* SPE 68194, pp. 1-8.
Molenaar, M. M. et al, (2004) "Applying Geo-Mechanics and 4D: '4D In-Situ Stress' as a Complementary Tool for Optimizing Field Management", *Gulf Rocks 2004, 6th North America Rock Mechanics Symposium* (*NARMS*): *Rock Mechanics Across Borders and Disciplines*, Houston, Texas, Jun. 5-9, ARMA/NARMS 04-639, pp. 1-7.
Moschovidis, Z. (1989) "Interwell Communication by Concurrent Fracturing—a New Stimulation Technique", *Journ. of Canadian Petro. Tech*. 28(5), pp. 42-48.
Nottenburg, R.N. et al. (1979) "Temperature and stress dependence of electrical and mechanical properties of Green River oil shale," *Fuel*, 58, pp. 144-148.
Nowacki, P. (ed.), (1981) *Oil Shale Technical Handbook*, Noyes Data Corp. pp. 4-23, 80-83 & 161-183.
Pattillo, P. D. et al, (1998) "Reservoir Compaction and Seafloor Subsidence at Valhall", SPE 47274, 1998, pp. 377-386.
Pattillo, P. D. et al, (2002) "Analysis of Horizontal Casing Integrity in the Valhall Field", SPE 78204, pp. 1-10.
Plischke, B., (1994) "Finite Element Analysis of Compaction and Subsidence—Experience Gained from Several Chalk Fields", *Society of Petroleum Engineers*, SPE 28129, 1994, pp. 795-802.
Ruzicka, D.J. et al. (1987) "Modified Method Measures Bromine Number of Heavy Fuel Oils", *Oil & Gas Journal*, 85(31), Aug. 3, pp. 48-50.
Sahu, D. et al. (1988) "Effect of Benzene and Thiophene on Rate of Coke Formation During Naphtha Pyrolysis", *Canadian Journ. of Chem. Eng.*, 66, Oct. pp. 808-816.
Smart, K. J. et al, (2004) "Integrated Structural Analysis and Geomechanical Modeling: an Aid to Reservoir Exploration and Development", *Gulf Rocks 2004, 6th North America Rock Mechanics Symposium* (*NARMS*): *Rock Mechanics Across Borders and Disciplines*, Houston, Texas, Jun. 5-9, ARMA/NARMS 04-470.
Syunyaev, Z.I. et al. (1965) "Change in the Resistivity of Petroleum Coke on Calcination," Chemistry and Technology of Fuels and Oils, 1(4), pp. 292-295.
Turta, A., (1994), "In situ combustion—from pilot to commercial application", *DOE/NIPER Symposium on In Situ Combustion Practices-Past, Present, and Future Application*, Tulsa, OK, Apr. 21-22, No. ISC 3, p. 15-39.
Tzanco, E. T., et al. (1990), "Laboratory Combustion Behavior of Countess B Light Oil", *Petroleum Soc. of CIM and SPE*, Calgary, Jun. 10-13, No. CIM/SPE 90-63, p. 63.1-63.16.
Veatch, Jr. R.W. and Martinez, S.J., et al. (1990) "Hydraulic Fracturing: Reprint Series No. 28", *Soc. of Petroleum Engineers* SPE 14085, Part I, Overview.
Warpinski, N. R., (1989) "Elastic and Viscoelastic Calculations of Stresses in Sedimentary Basins", *SPE Formation Evaluation*, vol. 4, pp. 522-530.
Yoon, E. et al. (1996) "High-Temperature Stabilizers for Jet Fuels and Similar Hydrocarbon Mixtures. 1. Comparative Studies of Hydrogen Donors", *Energy & Fuels*, 10, pp. 806-811.

* cited by examiner

CONVERTING ORGANIC MATTER FROM A SUBTERRANEAN FORMATION INTO PRODUCIBLE HYDROCARBONS BY CONTROLLING PRODUCTION OPERATIONS BASED ON AVAILABILITY OF ONE OR MORE PRODUCTION RESOURCES

This application claims the benefit of U.S. Patent Application No. 61/175,547, filed on May 5, 2009, and entitled "CONVERTING ORGANIC MATTER FROM A SUBTERRANEAN FORMATION INTO PRODUCIBLE HYDROCARBONS BY CONTROLLING PRODUCTION OPERATIONS BASED ON AVAILABILITY OF ONE OR MORE PRODUCTION RESOURCES," the entirety of which is incorporated by reference herein.

This application is also related to U.S. patent application Ser. No. 12/011,456 filed on Jan. 25, 2008, U.S. application Ser. No. 10/558,068, filed on Nov. 22, 2005 (and now issued as U.S. Pat. No. 7,331,385) and U.S. patent application Ser. No. 10/577,332, filed on Jul. 30, 2004 (and now issued as U.S. Pat. No. 7,441,603), and U.S. Patent Application No. 60/109,369, entitled "Electrically Conductive Methods For Heating A Subsurface Formation To Convert Organic After Into Hydrocarbon Fluids," filed on Oct. 29, 2008. All of the above-referenced applications are incorporated herein in their entirety by reference.

TECHNICAL FIELD

This description relates to the field of hydrocarbon recovery from subsurface formations. More specifically, the present description relates to the in situ recovery of hydrocarbon fluids from organic-rich rock formations including, for example, oil shale formations, coal formations and/or tar sands formations. The present description also relates to methods for producing hydrocarbons from an organic-rich rock formation mobilized and/or matured through heating, such as through low temperature heating to mobilize highly viscous fluids and/or through higher temperature heating to support pyrolysis of the organic-rich rock formation.

BACKGROUND

Certain geological formations are known to contain an organic matter known as "kerogen." Kerogen is a solid, carbonaceous material. When kerogen is imbedded in rock formations, the mixture is referred to as oil shale. This is true whether or not the mineral is, in fact, technically shale, that is, a rock formed from compacted clay.

Kerogen is subject to decomposing upon exposure to heat over a period of time. Upon heating, kerogen molecularly decomposes to produce oil, gas, and carbonaceous coke. Small amounts of water may also be generated. The oil, gas and water fluids become mobile within the rock matrix, while the carbonaceous coke remains essentially immobile.

Oil shale formations are found in various areas worldwide, including the United States. Oil shale formations tend to reside at relatively shallow depths. In the United States, oil shale is most notably found in Wyoming, Colorado, and Utah. These formations are often characterized by limited permeability. Some consider oil shale formations to be hydrocarbon deposits which have not yet experienced the years of heat and pressure thought to be required to create conventional oil and gas reserves.

The decomposition rate of kerogen to produce mobile hydrocarbons is temperature dependent. Temperatures generally in excess of 270° C. (518° F.) over the course of many months may be required for substantial conversion. At higher temperatures substantial conversion may occur within shorter times. When kerogen is heated, chemical reactions break the larger molecules forming the solid kerogen into smaller molecules of oil and gas. The thermal conversion process is referred to as pyrolysis or retorting.

Attempts have been made for many years to extract oil from oil shale formations. Near-surface oil shales have been mined and retorted at the surface for over a century. In 1862, James Young began processing Scottish oil shales. The industry lasted for about 100 years. Commercial oil shale retorting through surface mining has been conducted in other countries as well such as Australia, Brazil, China, Estonia, France, Russia, South Africa, Spain, and Sweden. However, the practice has been mostly discontinued in recent years because it proved to be uneconomical or because of environmental constraints on spent shale disposal. See, e.g., T. F. Yen, and G. V. Chilingarian, "*Oil Shale*," Amsterdam, Elsevier, p. 292, the entire disclosure of which is incorporated herein by reference. Further, surface retorting requires mining of the oil shale, which often limits application to very shallow formations.

In the United States, the existence of oil shale deposits in northwestern Colorado has been known since the early 1900's. While research projects have been conducted in this area from time to time, no serious commercial development has been undertaken. Most research on oil shale production has been carried out in the latter half of the 1900's. The majority of this research was on shale oil geology, geochemistry, and retorting in surface facilities.

In 1947, U.S. Pat. No. 2,732,195 issued to Ljungstrom. The '195 patent, entitled "Method of Treating Oil Shale and Recovery of Oil and Other Mineral Products Therefrom," described the application of heat at high temperatures to the oil shale formation in situ to distill and produce hydrocarbons. The '195 Ljungstrom patent is incorporated herein by reference. Ljungstrom coined the phrase "heat supply channels" to describe bore holes drilled into the formation. The bore holes received an electrical heat conductor which transferred heat to the surrounding oil shale. Thus, the heat supply channels served as heat injection wells. The electrical heating elements in the heat injection wells were placed within sand or cement or other heat-conductive material to permit the heat injection wells to transmit heat into the surrounding oil shale while preventing the inflow of fluid. According to Ljungstrom, the "aggregate" was heated to between 500° and 1,000° C., in some applications.

Along with the heat injection wells, fluid producing wells were also completed in near proximity to the heat injection wells. As kerogen was pyrolyzed upon heat conduction into the rock matrix, the resulting oil and gas would be recovered through the adjacent production wells. Ljungstrom applied his approach of thermal conduction from heated wellbores through the Swedish Shale Oil Company. A full scale plant was developed that operated from 1944 into the 1950's. See, e.g., G. Salomonsson, "*The Ljungstrom In Situ Method for Shale-Oil Recovery,*" 2$^{nd}$ Oil Shale and Cannel Coal Conference, v. 2, Glasgow, Scotland, Institute of Petroleum, London, p. 260-280 (1951), the entire disclosure of which is incorporated herein by reference.

Additional in situ methods have been proposed. These methods generally involve the injection of heat and/or solvent into a subsurface oil shale. Heat may be in the form of heated methane (see U.S. Pat. No. 3,241,611 to J. L. Dougan), flue gas, or superheated steam (see U.S. Pat. No. 3,400,762 to D. W. Peacock). Heat may also be in the form of electric resistive heating, dielectric heating, radio frequency (RF) heating (U.S. Pat. No. 4,140,180, assigned to the ITT Research Institute in Chicago, Ill.) or oxidant injection to support in situ combustion. In some instances, artificial permeability has been created in the matrix to aid the movement of pyrolyzed fluids. Permeability generation methods include mining, rubblization, hydraulic fracturing (see U.S. Pat. No. 3,468,376 to M. L. Slusser and U.S. Pat. No. 3,513,914 to J. V. Vogel), explosive fracturing (see U.S. Pat. No. 1,422,204 to W. W. Hoover, et al.), heat fracturing (see U.S. Pat. No. 3,284,281 to R. W. Thomas), and steam fracturing (see U.S. Pat. No. 2,952,450 to H. Purre).

In 1989, U.S. Pat. No. 4,886,118 issued to Shell Oil Company, the entire disclosure of which is incorporated herein by reference. That patent, entitled "Conductively Heating a Subterranean Oil Shale to Create Permeability and Subsequently Produce Oil," declared that "[c]ontrary to the implications of . . . prior teachings and beliefs . . . the presently described conductive heating process is economically feasible for use even in a substantially impermeable subterranean oil shale." (col. 6, ln. 50-54). Despite this declaration, it is noted that few, if any, commercial in situ shale oil operations have occurred other than Ljungstrom's application. The '118 patent proposed controlling the rate of heat conduction within the rock surrounding each heat injection well to provide a uniform heat front.

Additional history behind oil shale retorting and shale oil recovery can be found in co-owned U.S. Pat. No. 7,331,385 (Symington) entitled "Methods of Treating a Subterranean Formation to Convert Organic Matter into Producible Hydrocarbons," and in U.S. Pat. No. 7,441,603 (Kaminsky) "Hydrocarbon Recovery from Impermeable Oil Shales." The Background and technical disclosures of each these two patent documents are incorporated herein by reference, including for example, for the purposes of incorporating one or more the various heating and treatment methods that may be applicable to the present application.

As described hereinabove, a full scale plant was developed that operated from 1944 into the 1950's. See, e.g., G. Salamonsson, "*The Ljungstrom In Situ Method for Shale-Oil Recovery,*" 2$^{nd}$ Oil Shale and Cannel Coal Conference, v. 2, Glasgow, Scotland, Institute of Petroleum, London, p. 260-280 (1951). For example, Ljungstrom describes the use of an oil shale development field as a large energy accumulator based on electricity sourced from hydroelectric power. Specifically, because of the low thermal conductivity of the shale, the heat can be stored in the rock for a long time (years). When a period of power or fuel shortage is coming, some additional heat must be supplied for pyrolyzing the shale. Thereby, a considerably higher production may be obtained than would have been possible with the actual power supply (without preheating). Ljungstrom further describes accumulating surplus electrical power, such as surplus hydroelectric power, e.g., at night, or in summer, or in rain-rich years.

In addition, various studies have estimated that greenhouse gas (GHG) emissions associated with in situ conversion processes may be higher than that associated with conventional fossil fuel resources. See, e.g., Brandt, Adam R., "*Converting Oil Shale to Liquid Fuels: Energy Inputs and Greenhouse Gas Emissions of the Shell in Situ Conversion Process*," Environ. Sci. Technol. 2008, 42, pp. 7489-7495, the entirety of which is incorporated herein by reference. For example, Brandt suggests that in the absence of capturing CO2 generated from electricity produced to fuel the process, well-to-pump GHG emissions may be in the range of 30.0-37.0 grams of carbon equivalent per megajoule of liquid fuel produced in the described In Situ Conversion Process (ICP). Brandt suggests that these full-fuel-cycle emissions are 21%-47% larger than those from conventionally produced petroleum-based fuels.

For example, Brandt suggests that if electricity were generated from low carbon sources (such as renewables or fossil fuels with carbon capture), then emissions from oil shale would be approximately equal to those from conventional oil. Referring to FIG. 29 of the present application, which is based on analysis conducted by Brandt, several differences between conventional oil, a high GHG emissions estimate of the ICP process, and a low GHG emissions estimate of the ICP process. FIG. 29 depicts a chart 2900 of estimated greenhouse gas emissions in units of grams of Carbon equivalent per Megajoule of refined fuel, e.g., the at the pump product. Data for the high ICP case 2910, the low ICP case 2920, and a comparative conventional oil process 2930 are shown. GHG emissions associated with retorting, reclamation, the ICP freezewall process, and miscellaneous production, transportation, and refining processes are shown for each of the exemplary processes. It will be further appreciated that a significant portion of the increase in GHG emissions associated with the ICP process is associated with the energy required to retort (GHG associated with electrical power generation for heaters), support the freeze walls, and/or for reclamation associated with shale oil production activities, such as flushing the formation during or after production. In fact, as seen in FIG. 29 and suggested by Brandt, if the GHG emissions associated with retorting, reclamation, and/or mitigations steps (such as freezewalls) are reduced, if not eliminated, the potential exists for the overall GHG emissions associated with in situ conversion processes to be reduced below that of conventional oil.

Brandt also suggests, as previously identified by Ljungstrom, that the energy requirements of in situ electrically conductive heaters, such as the ICP process, are likely to not be sensitive to intermittency, because of the high heat capacity of the large mass of shale and the long heating time. Thus, intermittent renewables could be used in off-peak times. Second, the reuse of waste heat seems feasible, given that the hot, depleted production cells will need to be flushed with water to meet the water quality requirements in any case. However, these low-carbon ICP options are costly and, therefore, are unlikely without regulation of carbon emissions. The present inventors have determined that there are several ways in which intermittent renewables may be selectively deployed in hydrocarbon recovery processes, such as in situ heating of oil shale, tar sands, or other heavy hydrocarbons, in a manner that does not necessarily require the regulation of carbon emissions to achieve cost reductions that ensure one or more of the in situ heating processes referred to in this description remain competitive with conventional oil, e.g., similar in costs and environmental footprint.

U.S. Pat. No. 7,484,561 (Bridges) describes an electro thermal in situ energy storage for intermittent energy sources to recover fuel from hydro carbonaceous earth formations. Specifically, the '561 patent describes forming an opening in a formation, heating the formation with power from at least one source of intermittent electrical power provided through the opening, storing the thermal energy in the formation over a time interval sufficient to develop a recoverable fluid fuel, withdrawing valuable constituents from the formation via the opening, and varying the load on the power grid to at least partially compensate for the effects of the intermittent power changes on the power grid. Bridges specifically describes utilizing EM (electromagnetic) in situ heating methods in combination with in situ thermal energy storage to utilize large amounts of electrical energy from wind or solar power sources; and thereby avoid the CO2 emissions that conventional oil shale extraction processes generate. Bridges suggests that this combination has the potential to economically extract fuels from unconventional deposits, such as the oil shale, oil sand/tar sand and heavy oil deposits in North America. Bridges indicates that the described electro-thermal storage method can rapidly or smoothly vary the load presented to the power line, either ramping up the consumption or ramping down the load, thereby serving as a load leveling function. The variable loading function can be coordinated with reactive power sources to further stabilize the grid.

The present inventors appreciate that a need exists for improved processes for the production of shale oil, particularly for processes that rely upon increasingly scarce resources. For example, water that may be used during the course of an oil shale production cycle may be limited in availability due to more senior water rights and/or relatively low seasonal precipitation (and thus less available surface flows in nearby watersheds). In addition, a need exists for improved processes for producing hydrocarbons from an organic-rich rock formation, including, but not limited to oil shale, tar sands, and/or coal formations. For example, it is desirable to reduce the energy requirements for any operation associated with a heavy hydrocarbon resource and/or to utilize electrical power sourced from low GHG emission sources, such as wind power and/or solar power (solar cells, solar collectors, etc).

Even in view of currently available and proposed technologies, the present inventors have determined that it would be advantageous to have improved methods of treating subterranean formations to convert organic matter or mobilize heavy hydrocarbons into producible hydrocarbons. In addition, although Ljungstrom and/or Brandt discuss the use of intermittent power during off-peak periods, e.g., relying upon excess power from intermittent power sources, the present inventors have determined that there are additional ways to incorporate the use of intermittent, variable, and/or scarce production resources, such as intermittent electrical power and scarce process water, that will significantly reduce the environmental impacts and costs associated with oil shale production techniques discussed in the background art. Therefore, an object of this description is to provide one or more such improved methods. Other objects of this description will be made apparent by the following description of the description.

SUMMARY

In one general aspect, a method of treating a subterranean formation that contains solid organic matter includes heating a treatment interval within the subterranean formation with one or more electrical in situ heaters. Available power, e.g., from a power source, is determined for the electrical heaters at regular, predetermined intervals. Heating rates of the one or more electrical heaters are selectively controlled based on the determined available power at each regular, predetermined interval and based on an optimization model that outputs optimal heating rates for each of the electrical heaters at the determined available power.

Implementations of this aspect may include one or more of the following features. For example, the method may include running an optimization model to determine optimal heating rates for the one or more electrical heaters based on a first power input. The optimization model may be run prior to determining available power from a power source. The selectively controlled heating rates may be selected from a library of optimal solutions predetermined by running the optimization model based on a plurality of different, available power values from the power source. The running of the optimization model may include determining optimal heating rates for each electrical heater and a plurality of power inputs within a range of between 10 MW to 600 MW. The optimization model may be run after determining available power from a power source. The power source may include one or more power sources providing electrical power through a utility grid. The electrical heaters may include one or more resistive heaters. The power factor for each resistive heater may be between 0.7 to 1.0, the power may be three-phase AC power, and each heater may be operatively connected through a transformer to a power distribution sub-station servicing the treatment interval. The electrical heaters may include one or more wellbore heaters. The electrical heaters may include one or more electrically conductive fractures. The optimization model may be ran to determine optimal heating rates based on a first power input to the treatment interval, and a prediction of projected intermittent energy over an upcoming period may be obtained, e.g., calculated or received from an external source. The upcoming period may be an upcoming 4 hour, 8 hour, 12 hour, 24 hour, 48 hour, and/or 72 hour or more time period. The optimization model may be ran to produce a library of optimal solutions based on the prediction of projected intermittent energy over the upcoming period, e.g., produce a set of operating control scenarios for an upcoming 72 hour period's expected available wind power off the grid from a plurality of preferred wind farms.

The optimization model may be ran to determine optimal heating rates for each electrical heater and a plurality of power inputs within a range of between 0 MW to 1000 MW. Determining available power for the electrical heaters at regular, predetermined intervals may include receiving data from a utility grid indicating one or more of available power from the grid, source of the available power, and/or utility rates associated with the available power from the grid. Determining available power for the electrical heaters includes determining available wind power in a particular geographic region. Determining available power for the electrical heaters may include receiving data relating to one or more wind farms and their available power. The received data may include one or more of predicted wind speed, actual real-time wind speed, available wind power, and/or utility rates, and the selectively controlled heating rates may be controlled based upon one or more of wind speed, actual real-time wind speed, available wind power, or utility rates from the received data. Determining available power for the electrical heaters includes determining available solar power in a particular geographic region. Determining available power for the electrical heaters includes receiving data relating to one or more solar power generation facilities and their available power. The received data may include one or more of predicted solar power, available wind power, and/or utility rates. Selectively controlling heating rates of the one or more electrical heaters based on the determined available power may include switching one or more electrical heaters to a heating or non-heating condition based on the determined available power and based on an optimal solution from the optimization model. Selectively controlling heating rates of the one or more electrical heaters includes load shedding heaters in response to drops in determined available power. Selectively controlling heating rates of the one or more electrical heaters includes selectively altering voltage allocated to each of the one or more heaters based on the determined available power. Selectively altering voltage includes designating a tap for a multi-tap transformer allocated to an individual heater or group of heaters based on determined, available power. The subterranean formation may include an oil shale formation, a tar sands formation, a coal formation, and/or a conventional hydrocarbon formation.

In another general aspect, a method of treating a subterranean formation that contains solid organic matter includes (a) heating a treatment interval within the subterranean formation with one or more in situ heating processes; (b) determining one or more available resources for the treatment of the subterranean formation; and (c) selectively controlling heating rates of the one or more electrical heaters or another process parameter associated with the treatment interval based on the determined available resources and based on an optimization model that outputs optimal process controls based on the determined available resource.

Implementations of this aspect may include one or more of the following features. For example, determining available resources for the treatment of the subterranean formation may include determining at least one of available surface water and/or ground water for the treatment of the subterranean formation. Estimating water availability may be based on predicted snowmelt for a watershed utilized to source process water. Selectively controlling heating rates of the one or more electrical heaters or other process parameters associated with the treatment interval may be based on the estimated water availability. One or more heating rates may be reduced in response to an estimated water availability being above or below a predetermined value. One or more heating rates may be increased in response to estimated water availability being above or below a predetermined value. The heating rates may be set to values determined by the optimization model and based on the determined available resource. The determined available resource may include one or more of available renewable energy, available ground water, available surface water, available production equipment, and/or sales prices for a product produced from the treatment interval. Selectively controlling the heating rates may include controlling heating rates when market prices for a predetermined product or derivative product produced from the subterranean formation have changed relative to a threshold value or range. Selectively controlling the one or more heating rates may be performed dynamically based on real-time feedback concerning availability of a production resource. Activating additional heaters in the treatment interval may be based on a solution provided by the optimization model and in response to the determined available resource changing relative to a threshold value. The one or more in situ heating processes may include at least one heating process selected from the group consisting of heating the formation with a heat transfer fluid introduced into the formation at a sustained temperature above 265 degrees C., electrically conductive fractures, or electrically conductive, resistive heating elements relying upon thermal conduction as a primary heat transfer mechanism. Recovering one or more formation water-soluble minerals from the formation may be accomplished by flushing the formation with an aqueous fluid to dissolve one or more first water-soluble minerals in the aqueous fluid to form a first aqueous solution. The first aqueous solution may be produced to the surface, and the water-soluble mineral extracted by a subsequent process, e.g., dehydration. Flushing the formation may be initiated based on determining at least one of available surface water or available ground water for the treatment of the subterranean formation. Flushing of the formation for producing the first aqueous solution to the surface may be performed before or after substantially heating the formation and producing hydrocarbons from the formation. The one or more formation water-soluble minerals may include sodium, nahcolite (sodium bicarbonate), dawsonite, soda ash, or combinations thereof.

According to another general aspect, a tangible computer-readable storage medium includes embodied thereon a computer program configured to, when executed by a processor, calculate at least one optimal solution for selectively adjusting heating rates for one or more in situ heaters for a treatment interval within a subterranean formation based on running a optimization model utilizing one or more of variable, intermittent source power, utility prices, and/or estimated available production resources, the computer-readable storage medium comprising one or more code segments configured to run the optimization model to output the at least one optimal solution. The tangible computer-readable storage medium may include embodied thereon a computer program configured to, when executed by a processor, calculate any combination of the process features described hereinabove with the aforementioned methods.

DESCRIPTION OF THE DRAWINGS

So that the present description can be better understood, certain drawings, charts, graphs and flow charts are appended hereto. It is to be noted, however, that the drawings illustrate only selected embodiments and are therefore not to be considered limiting of scope, for the embodiments may admit to other equally effective embodiments and applications.

Figure 1:
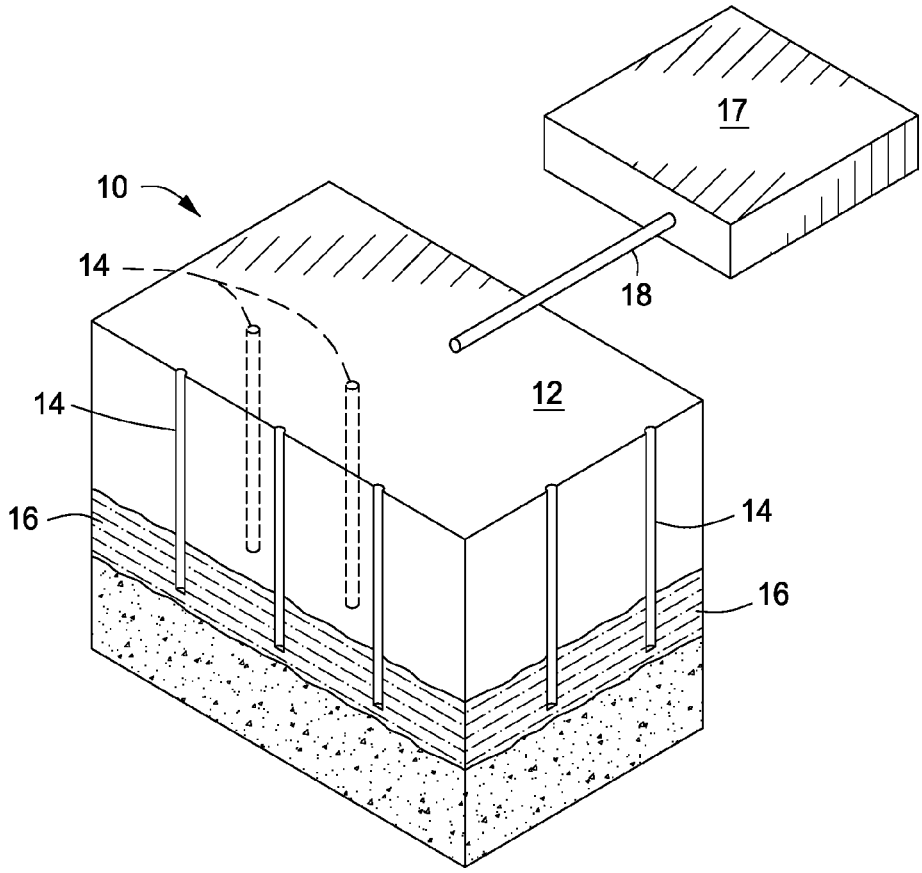
FIG. 1 is a cross-sectional isometric view of an illustrative subsurface area. The subsurface area includes an organic-rich rock matrix that defines a subsurface formation.

While the description will be described in connection with its preferred embodiments, it will be understood that the description is not limited thereto. On the contrary, the description is intended to cover all alternatives, modifications, and equivalents which may be included within the spirit and scope of the present disclosure, as defined by the appended claims.

BRIEF DESCRIPTION

One or more of the embodiments described herein is associated with the recognition that in the course of a commercial oil shale development, demand for certain resources may fluctuate throughout the development. Accordingly, the present inventors have determined that it may be desirable to plan the need for resources (power, water) when these resources are plentiful and/or to optimize operations based upon analysis of the availability of variable and/or scare production resources. The background art discusses the concept of sizing an industrial shale oil production facility to accommodate baseline loads of electrical power and/or to utilize peak electrical power (when available) when it is economical.

For example, the present inventors have determined that oil shale (tar sand, coal formations, and other heavy hydrocarbon based resources) production operations can be designed to accommodate intermittent power so that operations may be optimized to maximize effective heat transfer throughout a range of intermittent power inputs, e.g., where power input is a variable instead of a requirement. The power supply to and heating rates associated with one or more heaters in a large field which includes numerous electrical heaters may be selectively controlled based upon the available power at the time. The control of individual heating rates may be implemented dynamically based on feedback concerning available power supply to the oil shale production facility, e.g., the oil shale production facility can receive real-time information concerning the available power supply (such as available power and from a preferred source, such as 500 MW of wind power being available) so that industrial operations can be controlled in response to the available power supply.

One or more of the following embodiments permits an industrial nonconventional hydrocarbon production operation to schedule operations such that periods of peak resource demand correspond when that resource is cheap and plentiful. For example, after production is finished on a particular portion of an oil shale formation, process water is usually used to flush the system of contaminants and to recover sodium minerals. Scheduling the time of demand for water to correspond to periods of snowmelt when the nearby rivers have plenty of flow would alleviate demands on a scarce resource. If the operations are scheduled to demand water when the streams are dry, then either the project will be delayed or expensive storage facilities would be needed. This optimization can also incorporate other operations nearby, e.g. oil and gas production, nahcohlite mining, etc. Water quality may also vary over time.

As aforementioned, the present inventors have determined that the development of an unconventional hydrocarbon resource, e.g., target area of oil shale or heavy hydrocarbons, may also incorporate the use of intermittent power supplies better than most industrial operations. For example, renewable energy is readily available in sufficient quantities in some areas associated with unconventional hydrocarbon resources, e.g., thousands of MW of wind power is available within several hundred miles of rich oil shale deposits. Power from local wind farms may be capable of being transmitted from nearby locales, such as southeastern Wyoming and northeastern Colorado, through existing high voltage transmission lines and with fewer transmission losses typically associated with power generation across extending through the Piceance Basin.

Traditional power generation and distribution operations, e.g., for a utility, rely upon incorporating renewables (such as wind power) into a utility's portfolio of power generation sources. However, due to the intermittent nature of renewable energy, renewable power generation is typically limited to penetration levels of between 10-20%. In addition, utilities must cycle non-renewable sources (such as gas turbine power generation units) on-off the grid to accommodate fluctuations from renewable power sources, e.g., electrical generation and demand must remain in balance to maintain grid stability, thus raising costs for regulation, incremental operating reserve, energy demand management and prediction, load shedding, or storage solutions. Due to the low thermal conductivity of the shale, the oil shale formation can store heat within the formation for long periods of time. Intermittent power sources that can be problematic for a utility, can be accommodated by a large scale oil shale operation that may take all available wind power during peak operating periods, and reduce or even stop heating during periods where wind power has dropped (during daily or seasonal dips in wind patterns).

The oil shale operation can incorporate a power management routine that selectively distributes intermittent power across an oil shale heating area. The power distribution at the oil shale facility can be synchronized with power predictions (such as based on daily and hourly wind forecasts, such as wind forecasts for wind farms in SE Wyoming) and/or actual real-time data (anemometers or actual detected power levels at a sub-station collecting power for a specific wind farm) obtained at the renewable energy source. As power cyclically (or unexpectedly) varies throughout a day or season, optimal power management plans can be implemented on the demand side, for example, reducing power uniformly across an entire treatment area, and/or maintaining minimum levels in certain early production zones while reducing or even shutting off power at peripheral zones targeted for later production. The costs of the power to the oil shale facility would likely be significantly reduced when transmission losses, reduction of power/load management on utility, and/or those costs associated with the carbon footprint typically associated with heating an unconventional hydrocarbon source are factored into the operation.

Optimization

For example, developing and managing hydrocarbon resources often entails committing large economic investments over many years with an expectation of receiving correspondingly large financial returns. Whether a hydrocarbon resource yields profit or loss depends largely upon the strategies and tactics implemented for resource development and management. Resource development planning involves devising and/or selecting strong strategies and tactics that will yield favorable economic results over the long term.

Resource development planning may include making decisions regarding size, timing, and location of production platforms as well as subsequent expansions and connections, for example. Key decisions can involve the number, location, allocation to platforms, and timing of production wells and heaters (such as electric wellbore heaters or electrically conductive fractures) to be drilled, formed and/or completed in each field. Post drilling decisions may include determining production rate allocations across multiple production wells. Any one decision or action may have system-wide implications, for example, propagating positive or negative impact across a petroleum operation or a reservoir. In view of the aforementioned aspects of reservoir development planning, which are only a representative few of the many decisions facing a manager of petroleum resources, one can appreciate the value and impact of planning.

Computer-based modeling holds significant potential for resource development planning, particularly when combined with advanced mathematical techniques. Computer-based planning tools support making good decisions in the field. One type of planning tool includes methodology for identifying an optimal solution to a set of decisions based on processing various information inputs. For example, an exemplary optimization model may work towards finding solutions that yield the best outcome from known possibilities with a defined set of constraints. In the context of the development of a hydrocarbon resource containing organic rich rock, e.g., tar sands, oil shale, and/or coal formations, the present inventors have determined that exemplary optimization models may work towards finding solutions that yield optimal heating rates (including individual optimized heating rates for each in situ heater in a large commercial application and/or average heating rates across a selected volume of a resource and thus, multiple heaters) to achieve a completion date or in response to a change in power input, minimal water use, and/or achieves various stages of completion at predetermined times, e.g., controlling heating rates so that optimal reclamation conditions are coincident with peak water flows in the vicinity of the oil shale operation.

The present inventors have identified several optimizations models that can support commercial operations that have the potential to significantly reduce greenhouse gas emissions and/or conserve scarce resources, such as water. A first unique optimization model treats power inputs, e.g., source power from the grid or a local power plant, e.g., as a variable that can vary over time. This model is particularly useful in utilizing intermittent power sources such as wind and/or solar power, such as from the utility grid, not just as a peak resource but as a substantial contribution to overall commercial power requirements, e.g., 20% or more of power being sourced by intermittent power, 40% or more of power being sourced by intermittent power, 60% or more of power being source by intermittent power, and/or 80% or more of power being sourced by intermittent power. Rather than relying upon fossil fuel power as a baseline power source, the aforementioned optimization model can be applied to provide recommended voltages/power inputs for individual heaters based on available power from the grid at a particularly time, e.g., real-time control schemes dependent upon available intermittent power. In contrast to a typical oil shale operation suggested by the background art, by treating power inputs as a variable (and not as a fixed power requirement) the oil shale operation can potentially utilize electrical power sourced from power generation sources with little or no carbon footprint. Accordingly, an oil shale operation (or other heavy or conventional hydrocarbon operation) may achieve great economic benefit via properly applying optimization models for optimizing the development plans and management of oil shale resources, particularly those involving decision-making for multiple resource areas over multiple years.

The terms "optimal," "optimizing," "optimize," "optimality," "optimization" (as well as derivatives and other forms of those terms and linguistically related words and phrases), as used herein, are not intended to be limiting in the sense of requiring the present description to find the best solution or to make the best decision. Although a mathematically optimal solution may in fact arrive at the best of all mathematically available possibilities, real-world embodiments of optimization routines, methods, models, and processes may work towards such a goal without ever actually achieving perfection. Accordingly, one of ordinary skill in the art having benefit of the present disclosure will appreciate that these terms, in the context of the scope of the present description, are more general. The terms can describe working towards a solution which may be the best available solution, a preferred solution, or a solution that offers a specific benefit within a range of constraints; or continually improving; or refining; or searching for a high point or a maximum for an objective; or processing to reduce a penalty function; etc.

In certain exemplary embodiments, an optimization model can be an algebraic system of functions and equations comprising (1) decision variables of either continuous or integer variety which may be limited to specific domain ranges, (2) constraint equations, which are based on input data (parameters) and the decision variables, that restrict activity of the variables within a specified set of conditions that define feasibility of the optimization problem being addressed, and/or (3) an objective function based on input data (parameters) and the decision variables being optimized, either by maximizing the objective function or minimizing the objective function. In some variations, optimization models may include non-differentiable, black-box and other non-algebraic functions or equations.

A typical (deterministic) mathematical optimization problem involves minimization or maximization of some objective function subject to a set of constraints on problem variables. This is commonly known as mathematical programming in the scientific and engineering community. Sub-categories of mathematical programming include linear programming (LP), mixed integer programming (MIP), nonlinear programming (NLP) and mixed-integer nonlinear programming (MINLP). A deterministic optimization model is typically posed in the following form in which an objective function "f" is optimized subject to an array of constraint functions "g" that must be satisfied by setting the values of decision variable arrays "x" and "y". The constraint functions generally include a combination of known data parameters and unknown variable values when a mathematical programming model is posed.

$$\min f(x, y) \qquad \text{i}$$

$$\text{s.t. } g(x, y) \leq 0.$$

Solving the problem to mathematical optimality can comprise finding values for the decision variables such that all constraints are satisfied, wherein it is essentially mathematically impossible to improve upon the value of the objective function by changing variable values while still remaining feasible with respect to all of the constraints. When some of the "known" fixed parameters of the problem are actually uncertain in practice, the solution to the deterministic optimization problem may be sub-optimal, or possibly even infeasible, especially if the problem parameters take values that are ultimately different than those values chosen to be used as input into the optimization model that is solved. The present embodiments may utilize any combination of LP, MIP, NLP, and/or MINLP.

The optimization process of resource development planning can be challenging, even under the assumption that the economics and behavior of in situ heaters and surface facilities are fully known. Typically, a large number of soft and hard constraints apply to an even larger number of decision variables. In practice, however, there exists uncertainty in resource behavior, economics, and/or other components of the decision process, which complicate the optimization process.

This exemplary embodiment uses models of the in situ conversion process to determine how the input parameters, such as current to the fracture or well pressure, would affect the production rates, product quality, and operating expense. Models would also predict how other measured quantities, such as well temperature, would be affected by the changes. This would allow verification of the models and could potentially identify future situations to avoid. In one embodiment of this invention, the changes could be implemented automatically by a computer. Voltage and amperage meters on an Electrofrac fracture could be used to balance the power entering a set of fractures. This would be desireable so that the well temperature does not rise too quickly. Models could also be used in the development phase of the project to optimize capital expenditures as well. This exemplary embodiment allows the management of a large scale oil shale development, which would contain hundreds of wells. Without additional technology, management of a large scale development may be challenging.

In the course of a commercial oil shale development, many operating parameters can be changed to better lower costs, increase product quality, or increase production rates. A systematic approach is desired to change the operating parameters to optimize the profitability of the development. In some cases, electrical resistivity of the heating element may vary with time (e.g., as thermal expansion occurs or as resistivity of the element material changes with temperature). Without control, the heating rate provided by the heating element may also change. In other cases, the composition of produced fluids may change and reduce sales value or ability to effectively use as local fuel. Actively adjusting residence times (e.g., flow rates) for sets of wells may proved more stable compositions of total produced fluids.

Figure 30:
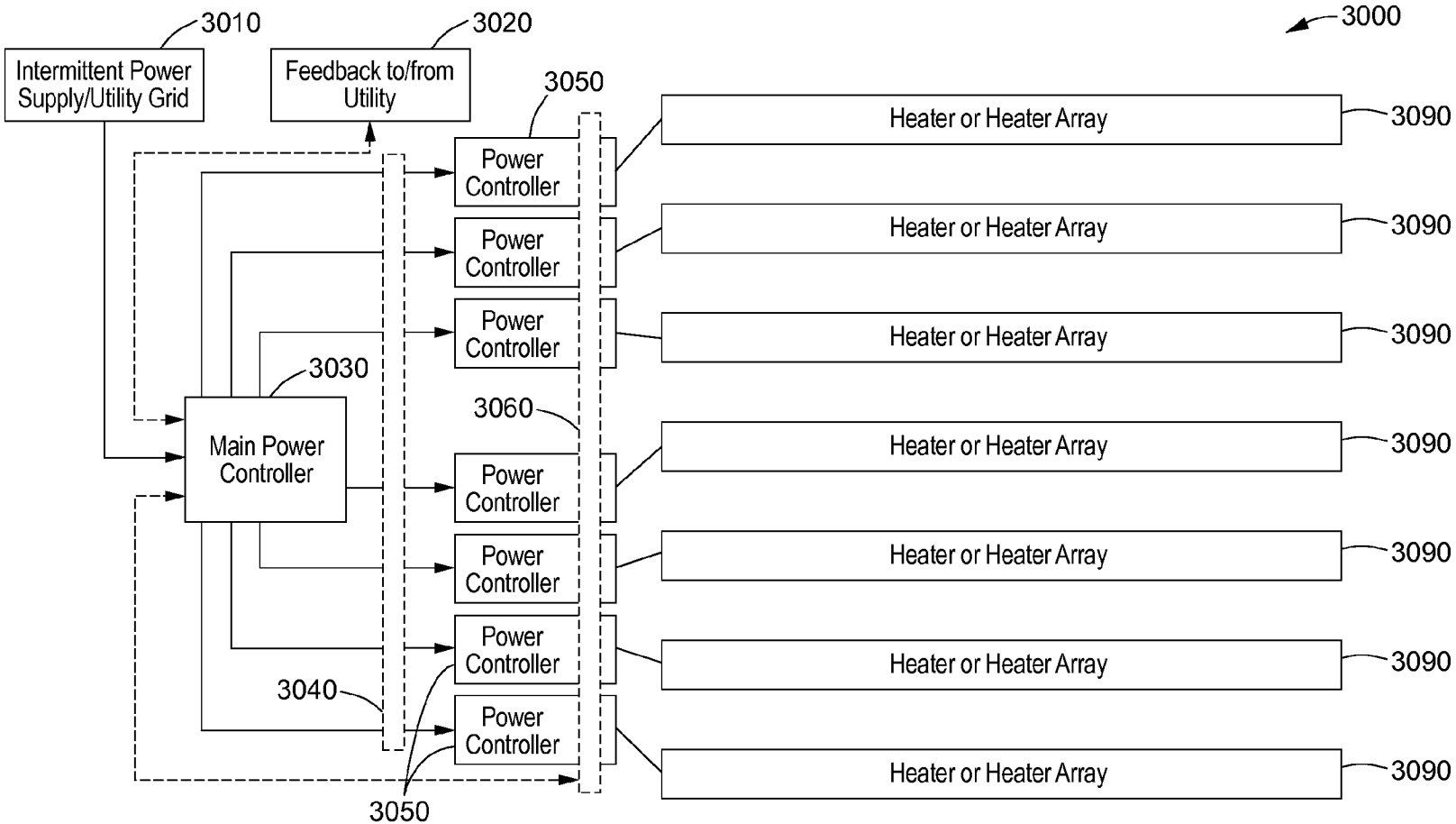
FIG. 30 is a schematic view of an oil shale development area including multiple heaters (or multiple groups of heaters) capable of being selectively controlled to individually alter heating rates, e.g., power inputs, based on a range production schedules.
Figure 31:
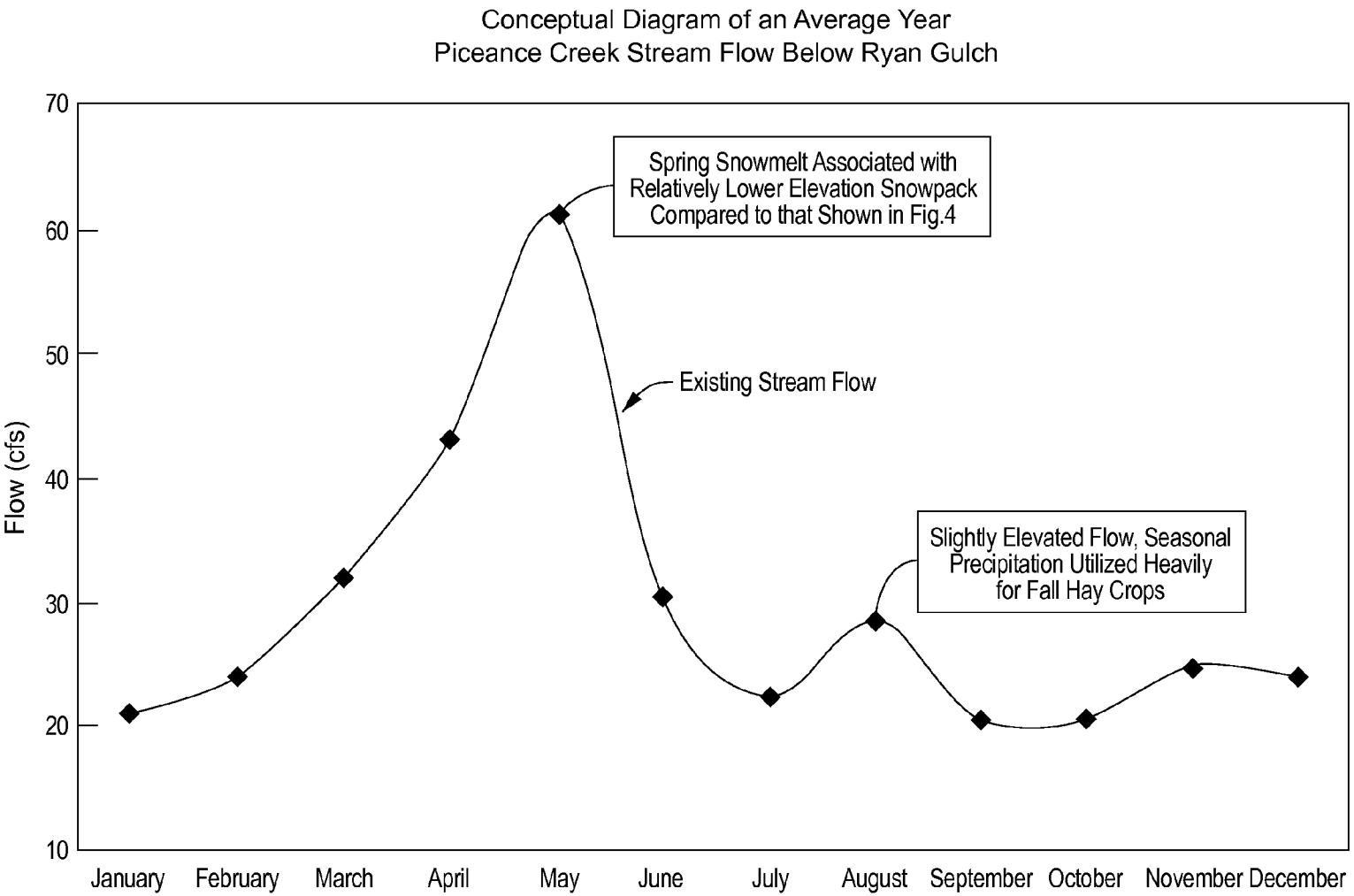
FIG. 31 is a graphical view of seasonal water flows in the Piceance Creek watershed of Colorado.
Figure 32:
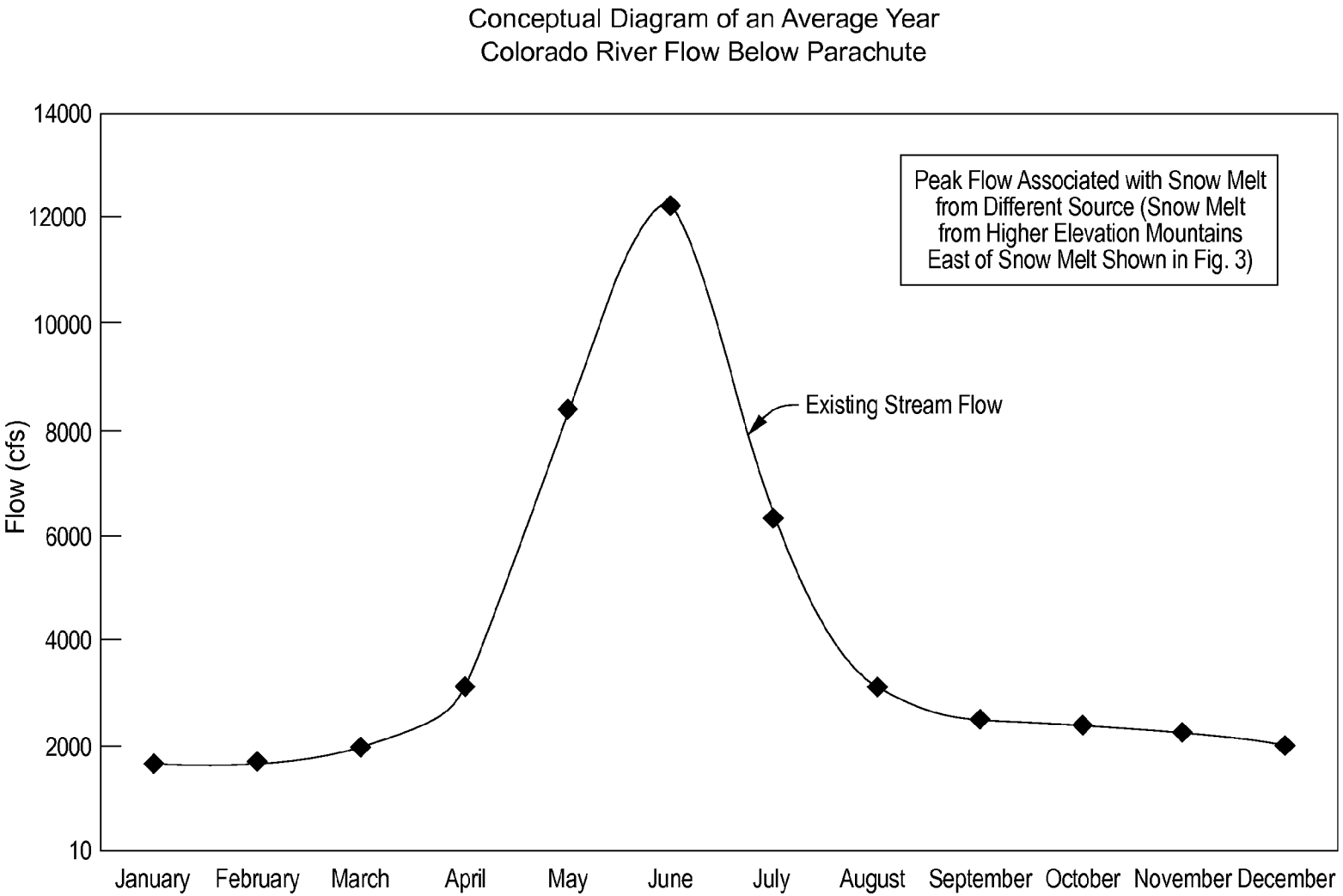
FIG. 32 is a graphical view of seasonal water flows in the Colorado River watershed of Colorado.
Figure 33:
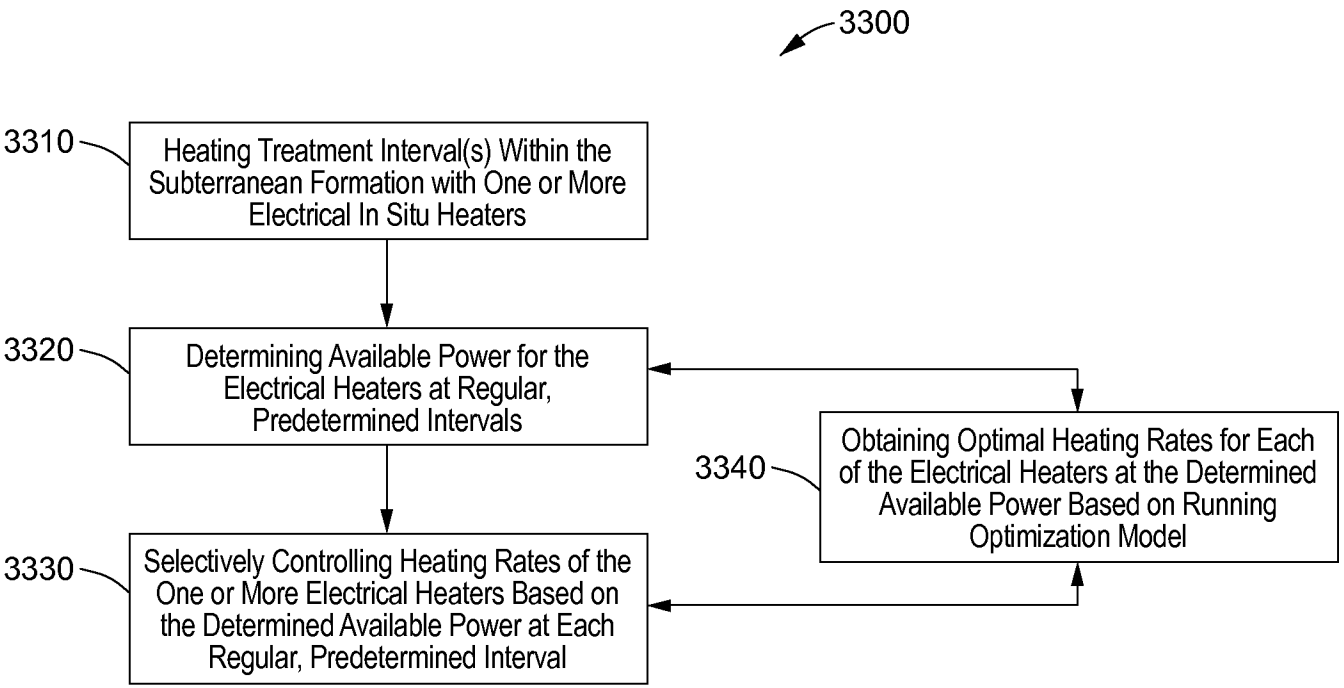
FIG. 33 is a flowchart of an exemplary process for treating a subterranean formation with an in situ heating process.

The temperature (or power) of the oil shale reservoir can be controlled in various ways. Referring to FIG. 30, an exemplary commercial shale oil operation includes numerous electrical resistive heaters (or groups of heaters controlled individually or each group is controlled individually). The heaters are to the bus, e.g., three phase AC power through one or more step-down transformers, in parallel electrically. Depending upon the type of heater used, each heater will different impedances or resistances. For example, electrically conductive fractures will have unique geometries (and thus varying treatment volumes), unique resistivities, thermal conductivity, etc. The heaters can each be connected individually, or in subgroups to the bus via multi-tap transformers, such as one transformer for one or certain resistive heaters. Based on actual temperature measurement received from the treatment interval, the tap may be auto selected and therefore output voltage will be regulated. Accordingly, the higher/lower voltage, the more/less power applied to the reservoir and the quicker/slower for temperature to increase. Furthermore, a more sophisticated algorithm to optimize the whole system power distribution can be employed. Since the total available electric power is always limited at certain time, the algorithm can calculate the voltage (or power) applied to each heater or group of heaters on the temperature feedbacks, given heating profile, power limits, or a predetermined treatment schedule, e.g., production is controlled so that the resource is pyrolyzed and produced by a certain date (that may optimally coincide with peak water flows shown in FIGS. 31 and 32) so that reclamation efforts can be initiated during peak production resource availability, such as recycled water from nearby tight gas operations or water drawn from local watersheds suring peak flows.

A method to optimize the development of an oil shale resource may include defining the objective of the optimization, e.g., maximum production, minimize water use, minimize greenhouse gas emissions, maximum net present value, optimal heating rates for each heater based on variable power inputs (a range of power inputs or multiple power inputs creating a variety of control scenarios). A model is constructed of the development that calculates the objective. The model incorporates heat transfer and/or heat energy models, such as a conduction model based on thermal conductivity of formation, desired temperature increase, and treatment volume or mass, such as $Q=m*cp*\Delta T$ for defining heat energy, Q is heat energy, m is mass, cp is specific heat, and T is the desired change in temperature. Density and volume may be substituted for mass to calculate based on treatment volume rather than directly using mass. Voltage, current, and power equations for AC circuits can be used to describe relationships of individual heaters selectively connected through multi-tap transformers. For example, the power p converted in a resistor, e.g., the rate of conversion of electrical energy to heat, may be described as $p(t)=iv=v^2/R=i^2R$.

Additional AC power equations applicable for each heater, such as voltage, current, and power equations that can be used to determine an optimal combination of heaters (each of varying resistance) to utilize to obtain a maximum desired heating rate for a production area, include for example: $V=V_o \sin 2\Pi ft$ (AC voltage equation), $I=I_o \sin 2\Pi ft$ (AC current equation), and $P=VI=V_o I_o \sin^2 2\Pi ft$ (AC power equation), and $P_{rms}=V_{rms}I_{rms}=V^2_{rms}/R=I^2_{rms}R$ (average power). For example, heaters 1, 11, and 20 may produce an overall combined resistance that is more desirable for the field operation than the combination of heaters 2, 17, and 105 for a given power input. In addition, as may be experienced with resistive heating elements in the field, the actual resistance of a heating element may change over time, e.g., the resistance value of a resistive heater may change as the surrounding environment (temperature, pressure, rock mechanics, and surrounding fluids change throughout the pyrolysis of a selected section of a formation).

Next, input parameters are chosen for the model. In one or more preferred embodiments, power input is known (not calculated as a requirement), and serves as a constraint or input in the optimization model. This aspect of the optimization model has not been described or suggested in any of the systems of the background art that suggest using intermittent power sources, such as a renewable energy. Instead, each of the background art systems seem to focus on increasing power when cheap peak power is available. The present embodiments contemplate optimizing for both load shedding and peak load operations. The input parameters may include one or more of resistances (or impedances) of each of the heaters, power factors (as electrically conductive, resistance heaters or conductive fractures are highly resistive devices, power factors will likely be high, such as in the range of 0.7 to 1.0), associated treatment volumes for each of the heaters, thermal properties for the formation associated with each heater, e.g., thermal conductivity or specific heat of oil shale in the formation based on Fischer Assay of the oil shale, and power input to the entire treatment area (this may be based on real-time feedback concerning availability of specific amount of available inexpensive or low-carbon footprint sourced energy, such as 500 MW of renewable energy being available at time t1 to time t2. The model is then used to predict the value of the objective and other desired outputs, such as provide desired heating rates for each heater. For example, for a field of 100 heaters operating during a period having 300 MW of available wind power, perhaps 1-30 heaters are suggested as being switched off during the time interval (and associated with the determined power level), 31-50 heaters are tapped to achieve maximum heating rates, and heaters 51-100 are idled/tapped to achieve relatively low heating rates during a period of relatively low, available power from the utility grid. The heaters may also be selected based upon other input parameters, such as heaters 1-30 being in a pretreatment period (non-pyrolysis preheating period elevating oil shale formation from 20-270 deg C.), heaters 31-50 being in a near completion state at pyrolysis temperatures of 270-400 deg C.), and heaters 51-100 being in final stages of production or near completion (thus permitting even lower heating rates as a thermal heat front continues to move through that section of the formation).

The implementation of the model scenario(s) in the field may include adjusting heating rates to achieve the desired effect. Outputs from the field may also be continuously monitored to dynamically update the model/scenarios and thus control heating rates. For example, real-time temperature, voltage, current, and power inputs will be obtained and input to the optimization model to determine the next desired control scenario as power inputs fluctuate throughout the course of a day. The predetermined intervals for obtaining feedback data can range from milliseconds to hours, or even days, e.g., feedback from the grid concerning available power will more likely be on the order of milliseconds to seconds. f) Each of the foregoing procedures may be repeated until the desired objective is obtained and/or inputs stop changing, e.g., power inputs stabilize during a period of constant wind speeds and thus all power requirements are being met. The cost of the energy may also be factored into the optimal solution, e.g., low cost wind energy available off the grid may be utilized during off peak periods and avoided when current pricing for the same energy days or even months later render the heat source incompatible with the heating process. Accordingly, lowest cost wind energy from a first group of wind farms may be utilized during a first time period and a separate group of wind farms power output may be utilized during a second time period.

An exemplary method for real time field management of a field undergoing electrical heating of an organic-rich rock may include installing at least one sensor in the field to estimate an electrical resistivity of a subsurface electrical heating element, coupling the at least one sensor to a CPU memory located at the field, programming the CPU to collect and store data from the coupled sensors, programming the CPU to at least partially analyze the data and control an electrical power input to one or more subsurface heating elements; and providing remote access to the data. The heating elements may be resistive heaters and the electrical power may be controlled to maintain a target heating rate. The controlled heating element neighbors the heating element whose electrical resistivity is estimated. The target heating rate may be zero if the electrical resistivity exceeds are predetermined value. The controlling of flow rates may be based on a model comprising pyrolysis reaction kinetics, residence time estimation, and in situ temperatures or other pyrolysis conditions.

This description suggests using an electrically conductive material as a resistive heater, e.g., for electrically conductive fractures. Alternatively, wellbore heaters such as those described by Vinegar in U.S. Pat. No. 4,886,118 or U.S. Pat. No. 6,745,831 may be utilized in any of the aforementioned embodiments, the entirety of each of which are hereby incorporated by reference. With respect to a preferred embodiment, electrical current flows primarily through the resistive heater comprised of the electrically conductive material. Within the resistive heater, electrical energy is converted to thermal energy, and that energy is transported to the formation by thermal conduction.

Referring to FIGS. 30-33, an exemplary method of treating a subterranean formation that contains solid organic matter includes (a) heating a treatment interval within the subterranean formation with one or more electrical in situ heaters; (b) determining available power for the electrical heaters at regular, predetermined intervals; and (c) selectively controlling heating rates of the one or more electrical heaters based on the determined available power at each regular, predetermined interval and based on an optimization model that outputs optimal heating rates for each of the electrical heaters at the determined available power.

Referring to FIG. 30, an exemplary system 3000 for implementing the described method includes a power controller, e.g., including step down transformer(s) for stepping down and distributing power from the utility grid to the formation, individual power controllers (or multi-tap transformers) permitting individual heaters to be switched on/off, or have voltages altered, a feedback module for receiving data from the grid, e.g., concerning real-time power inputs, a distribution bus, sensors for obtaining real-time temperature, voltage, or current measurements, and a main processor (standalone or server based) and/or expert system containing operatively connected to the optimization model for implementing various control scenarios based on determined power inputs. The power may also be supplied or augmented locally by virtue of a baseload power plant provided on site or nearby, e.g., a base natural gas fired turbo-generator, such as operating off of natural gas produced from concurrent operation or from nearby tight gas operations.

Referring to FIGS. 30-33, an exemplary method 3300 of treating a subterranean formation that contains solid organic matter includes 3310 heating a treatment interval within the subterranean formation with one or more electrical in situ heaters, 3320 determining available power for the electrical heaters at regular, predetermined intervals, and 3330 selectively controlling heating rates of the one or more electrical heaters based on the determined available power at each regular, predetermined interval and based on an optimization model that outputs optimal heating rates for each of the electrical heaters at the determined available power. Implementations of this aspect may include one or more of the following features. For example, the method 3300 may include 3340 running an optimization model to determine optimal heating rates for the one or more electrical heaters based on a first power input. The optimization model may be run prior to determining available power from a power source. The available power may include real-time available power data, e.g., sourced from a utility or directly from a power source (wind farm or powerplant) or may include predicted available power for an upcoming period, e.g., involve forecasting of likely wind conditions in southeast Wyoming over an upcoming 72 hour period (and anticipated, available power).

Referring to FIG. 30, an exemplary power supply, transmission, and distribution system 3000 for an oil shale or other heavy hydrocarbon processing operation (portions of the power source and the transmission system are represented schematically) includes an intermittent power supply 3010, such as any combination of baseload power sourced from conventional power sources (coal-fired, gas-fired, fuel-oil, hydroelectric, nuclear) and at least one one intermittent power source (such as wind power sourced from a wind farm, solar power sourced from a solar farm, and/or geothermal energy). The baseload power may also be supplied, if at all, through a completely separate system fed into the system 3000, e.g., through a separate sub-station or parallel distribution system. The intermittent power supply may be supplied off the utility grid, e.g., in coordination with a utility, or directly from one or more wind farms directly connected via a network of transmission lines to the system 3000. A main power controller 3030 includes any number of distribution and control equipment, e.g., including one or more transformers that will likely step down transmission voltages down to distribution voltages more suitable for individual heaters (or groups of heaters) within the distribution component of system 3000. The main power controller 3030 may include, or connect to one or more distribution busses 3040, that will typically separate the incoming power from the power source to multiple connections, e.g., directly to individual heaters or groups of heaters 3090. The distribution bus 3040 may also connect to one or more heaters through additional power controllers 3050 containing power distribution and power control hardware and software. The main power controller 3030, and optionally one or more of the power controllers 3050 for individual heaters or heater arrays may include one or more circuit breakers and switches so that the main power controller 3030 (or sub power controller 3050) substation can be disconnected from the transmission grid or separate distribution lines can be disconnected from the substation when necessary. The system 3000 also includes a data component, generally represented by an optional data bus 3060, that is configured to send, receive, and/or transmit data to and from the main power controller 3030 to the individual power controllers 3050 for the heaters. The main power controller 3030 also has the capability of sending and receiving data through a communication link 3020 to and from the utility (managing the power source) or directly to participating power sources, e.g., a participating nuclear power plant, wind farm(s), and/or solar farm(s) sourcing any combination of baseload and/or intermittent power to the system 3000 and not necessarily run through a separate utility. The main power controller 3030, and optionally individual power controllers 3050, contain hardware and software for implementing one or more aspects of the aforementioned embodiments. For example, a library of optimal solutions may be stored within one or more of the controllers 3050, 3030. One or more the controllers 3050, 3030 may also include processing capabilities allowing the processing of data to create the optimal solutions as well, e.g., running an optimization routine to determine an optimal solution of individual heating rates for heaters 3090 based on available power sensed through the data components providing feedback 3020, 3030, and through 3060 described above. Accordingly the main power controller (and optionally any number of the controllers 3030) may include a tangible computer-readable storage medium embodied thereon a computer program configured to, when executed by a processor, calculate at least one optimal solution for selectively adjusting heating rates for one or more in situ heaters for a treatment interval within a subterranean formation based on running a optimization model utilizing one or more of variable, intermittent source power, utility prices, and/or estimated available production resources. The computer-readable storage medium may include one or more code segments configured to run the optimization model to output the at least one optimal solution. The tangible computer-readable storage medium may include embodied thereon a computer program configured to, when executed by a processor, calculate any combination of the process features described hereinabove with the aforementioned methods.

Referring to FIGS. 30-33, system 3000 and multiple variations of method 3300 permit the selectively controlled heating rates to be selected from a library of optimal solutions predetermined by running the optimization model based on a plurality of different, available power values from the power source. The running of the optimization model may include determining optimal heating rates for each electrical heater and a plurality of power inputs within a range of between 10 MW to 600 MW. The optimization model may be run after determining available power from a power source. The power source may include one or more power sources providing electrical power through a utility grid. The electrical heaters may include one or more resistive heaters. The power factor for each resistive heater may be between 0.7 to 1.0, the power may be three-phase AC power, and each heater may be operatively connected through a transformer to a power distribution sub-station servicing the treatment interval. The electrical heaters may include one or more wellbore heaters. The electrical heaters may include one or more electrically conductive fractures. The optimization model may be ran to determine optimal heating rates based on a first power input to the treatment interval, and a prediction of projected intermittent energy over an upcoming period may be obtained, e.g., calculated or received from an external source. The upcoming period may be an upcoming 4 hour, 8 hour, 12 hour, 24 hour, 48 hour, and/or 72 hour (such as a 7 day renewable energy forecast for southeast Wyoming) or more time period. The optimization model may be ran to produce a library of optimal solutions based on the prediction of projected intermittent energy over the upcoming period, e.g., produce a set of operating control scenarios for an upcoming 72 hour period's expected available wind power off the grid from a plurality of preferred wind farms.

The optimization model may be ran to determine optimal heating rates for each electrical heater and a plurality of power inputs within a range of between 0 MW to 1000 MW. Determining available power for the electrical heaters at regular, predetermined intervals may include receiving data from a utility grid indicating one or more of available power from the grid, source of the available power, and/or utility rates associated with the available power from the grid. Determining available power for the electrical heaters includes determining available wind power in a particular geographic region. Determining available power for the electrical heaters may include receiving data relating to one or more wind farms and their available power. The received data may include one or more of predicted wind speed, actual real-time wind speed, available wind power, and/or utility rates, and the selectively controlled heating rates may be controlled based upon one or more of wind speed, actual real-time wind speed, available wind power, or utility rates from the received data. Determining available power for the electrical heaters includes determining available solar power in a particular geographic region. Determining available power for the electrical heaters includes receiving data relating to one or more solar power generation facilities and their available power. The received data may include one or more of predicted solar power, available wind power, and/or utility rates. Selectively controlling heating rates of the one or more electrical heaters based on the determined available power may include switching one or more electrical heaters to a heating or non-heating condition based on the determined available power and based on an optimal solution from the optimization model. Selectively controlling heating rates of the one or more electrical heaters includes load shedding heaters in response to drops in determined available power. Selectively controlling heating rates of the one or more electrical heaters includes selectively altering voltage allocated to each of the one or more heaters based on the determined available power. Selectively altering voltage includes designating a tap for a multi-tap transformer allocated to an individual heater or group of heaters based on determined, available power. The subterranean formation may include an oil shale formation, a tar sands formation, a coal formation, and/or a conventional hydrocarbon formation.

In another general aspect, a method of treating a subterranean formation that contains solid organic matter includes (a) heating a treatment interval within the subterranean formation with one or more in situ heating processes; (b) determining one or more available resources for the treatment of the subterranean formation; and (c) selectively controlling heating rates of the one or more electrical heaters or another process parameter associated with the treatment interval based on the determined available resources and based on an optimization model that outputs optimal process controls based on the determined available resource.

Implementations of this aspect may include one or more of the following features. For example, determining available resources for the treatment of the subterranean formation may include determining at least one of available surface water and/or ground water for the treatment of the subterranean formation. Estimating water availability may be based on predicted snowmelt for a watershed utilized to source process water. Selectively controlling heating rates of the one or more electrical heaters or other process parameters associated with the treatment interval may be based on the estimated water availability. One or more heating rates may be reduced in response to an estimated water availability being above or below a predetermined value. One or more heating rates may be increased in response to estimated water availability being above or below a predetermined value. The heating rates may be set to values determined by the optimization model and based on the determined available resource. The determined available resource may include one or more of available renewable energy, available ground water, available surface water, available production equipment, and/or sales prices for a product produced from the treatment interval. Selectively controlling the heating rates may include controlling heating rates when market prices for a predetermined product or derivative product produced from the subterranean formation have changed relative to a threshold value or range. Selectively controlling the one or more heating rates may be performed dynamically based on real-time feedback concerning availability of a production resource. Activating additional heaters in the treatment interval may be based on a solution provided by the optimization model and in response to the determined available resource changing relative to a threshold value. The one or more in situ heating processes may include at least one heating process selected from the group consisting of heating the formation with a heat transfer fluid introduced into the formation at a sustained temperature above 265 degrees C., electrically conductive fractures, or electrically conductive, resistive heating elements relying upon thermal conduction as a primary heat transfer mechanism. Recovering one or more formation water-soluble minerals from the formation may be accomplished by flushing the formation with an aqueous fluid to dissolve one or more first water-soluble minerals in the aqueous fluid to form a first aqueous solution. The first aqueous solution may be produced to the surface, and the water-soluble mineral extracted by a subsequent process, e.g., dehydration. Flushing the formation may be initiated based on determining at least one of available surface water or available ground water for the treatment of the subterranean formation. Flushing of the formation for producing the first aqueous solution to the surface may be performed before or after substantially heating the formation and producing hydrocarbons from the formation. The one or more formation water-soluble minerals may include sodium, nahcolite (sodium bicarbonate), dawsonite, soda ash, or combinations thereof.

Implementations of this aspect may include one or more of the following features. For example, the method may include running an optimization model to determine optimal heating rates based on a first power input. Running the optimization model may include determining optimal heating rates for each electrical heater and a plurality of power inputs within a range of between 10 MW to 600 MW. The electrical heaters may include resistive heaters. The power factor for each resistive heater may be between 0.7 to 1.0. The power may be AC or DC power. The power may be single-phase or three-phase AC power. Each heater may be operatively connected through a transformer to a power distribution sub-station servicing the treatment interval, such as through multi-tap transformers. The electrical heaters may be wellbore heaters. The electrical heaters may comprise electrically conductive fractures. Running an optimization model to determine optimal heating rates may be based on a first power input to the treatment interval. Running the optimization model may include determining optimal heating rates for each electrical heater and a plurality of power inputs within a range of between 0 MW to 1000 MW, or more preferably 10 MW to 600 MW, or more preferably 100 MW to 600 MW, or more preferably 100 MW to 500 MW. Determining available power for the electrical heaters at regular, predetermined intervals may include receiving data from a utility grid indicating one or more of available power from the grid, source of the available power, and/or utility rates associated with the available power from the grid. Determining available power for the electrical heaters includes determining available wind power in a particular geographic region, such as Wyoming, Colorado, or other area with optimal renewable energy. Determining available power for the electrical heaters may include receiving data relating to one or more wind farms and their available power. The received data may include one or more of predicted wind speed, actual real-time wind speed, available wind power, and/or utility rates. Determining available power for the electrical heaters may include determining available solar power in a particular geographic region. Determining available power for the electrical heaters may include receiving data relating to one or more solar power generation facilities and their available power.

The received data may include one or more of predicted solar power, available wind power, and/or utility rates. Selectively controlling heating rates of the one or more electrical heaters based on the determined available power may include switching one or more electrical heaters to a heating or non-heating condition based on the determined available power and based on an optimal solution from the optimization model. Selectively controlling heating rates of the one or more electrical heaters may include load shedding heaters in response to drops in determined available power. Selectively controlling heating rates of the one or more electrical heaters may include selectively altering voltage allocated to each of the one or more heaters based on the determined available power. Selectively altering voltage may include designating a tap for a multi-tap transformer allocated to an individual heater or group of heaters based on determined, available power. The subterranean formation may be an oil shale formation, a tar sands formation, a coal formation, a conventional hydrocarbon formation, or any combination thereof.

Implementations of one or more of the foregoing aspects may include one or more of the following features. For example, determining available resources for the treatment of the subterranean formation may include determining available surface water and/or ground water for the treatment of the subterranean formation. Water availability may be estimated based on predicted snowmelt for a watershed utilized to source process water, such as through seasonal flow estimates shown in FIGS. 31 and 32 of the present application. Selectively controlling heating rates of the one or more electrical heaters and/or other process parameters associated with the treatment interval, such as voltage, or number of heaters being utilized, is based on the estimated water availability. One or more heating rates may be reduced in response to a estimated water availability being above or below a predetermined value. One or more heating rates may be increased in response to estimated water availability being above or below a predetermined value. The heating rates may be set to values determined by the optimization model and based on the determined available resource. The determined available resource may include one or more of available renewable energy, available production equipment, or sales prices for a product produced from the treatment interval. Selectively controlling the heating rates may include controlling heating rates when market prices for a predetermined product or derivative product produced from the subterranean formation have changed relative to a threshold value or range. Selectively controlling the one or more heating rates may be performed dynamically based on real-time feedback concerning availability of a production resource. The aforementioned methods may include activating additional heaters in the treatment interval based on a solution provided by the optimization model and in response to the determined available resource changing relative to a threshold value.

In another general aspect, a tangible computer-readable storage medium includes embodied thereon a computer program configured to, when executed by a processor, calculate at least one optimal solution for selectively adjusting heating rates for one or more in situ heaters for a treatment interval within a subterranean formation based on running a optimization model utilizing one or more of variable, intermittent source power, utility prices, and/or estimated available production resources, the computer-readable storage medium comprising one or more code segments configured to run the optimization model to output the at least one optimal solution.

Referring to FIGS. 1-28, this description is a process that generates hydrocarbons from organic-rich rocks (i.e., source rocks, oil shale). The process utilizes electric heating of the organic-rich rocks. An in situ electric heater is created by delivering electrically conductive material into a fracture in the organic matter containing formation in which the process is applied. In describing this description, the term "hydraulic fracture" is used. However, this description is not limited to use in hydraulic fractures. The description is suitable for use in any fracture, created in any manner considered to be suitable by one skilled in the art. In one embodiment of this description, as will be described along with the drawings, the electrically conductive material may comprise a proppant material; however, this description is not limited thereto.

FIG. 1 shows an example application of the process in which heat 10 is delivered via a substantially horizontal hydraulic fracture 12 propped with essentially sand-sized particles of an electrically conductive material (not shown in FIG. 1). A voltage 14 is applied across two wells 16 and 18 that penetrate the fracture 12. An AC voltage 14 is preferred because AC is more readily generated and minimizes electrochemical corrosion, as compared to DC voltage. However, any form of electrical energy, including without limitation, DC, is suitable for use in this description. Propped fracture 12 acts as a heating element; electric current passed through it generates heat 10 by resistive heating. Heat 10 is transferred by thermal conduction to organic-rich rock 15 surrounding fracture 12. As a result, organic-rich rock 15 is heated sufficiently to convert kerogen contained in rock 15 to hydrocarbons. The generated hydrocarbons are then produced using well-known production methods. FIG. 1 depicts the process of this description with a single horizontal hydraulic fracture 12 and one pair of vertical wells 16, 18. The process of this description is not limited to the embodiment shown in FIG. 1. Possible variations include the use of horizontal wells and/or vertical fractures. Commercial applications might involve multiple fractures and several wells in a pattern or line-drive formation. The key feature distinguishing this description from other treatment methods for formations that contain organic matter is that an in situ heating element is created by the delivery of electric current through a fracture containing electrically conductive material such that sufficient heat is generated by electrical resistivity within the material to pyrolyze at least a portion of the organic matter into producible hydrocarbons.

Any means of generating the voltage/current through the electrically conductive material in the fractures may be employed, as will be familiar to those skilled in the art. Although variable with organic-rich rock type, the amount of heating required to generate producible hydrocarbons, and the corresponding amount of electrical current required, can be estimated by methods familiar to those skilled in the art. Kinetic parameters for Green River oil shale, for example, indicate that for a heating rate of 100° C. (180° F.) per year, complete kerogen conversion will occur at a temperature of about 324° C. (615° F.). Fifty percent conversion will occur at a temperature of about 291° C. (555° F.). Oil shale near the fracture will be heated to conversion temperatures within months, but it is likely to require several years to attain thermal penetration depths required for generation of economic reserves.

During the thermal conversion process, oil shale permeability is likely to increase. This may be caused by the increased pore volume available for flow as solid kerogen is converted to liquid or gaseous hydrocarbons, or it may result from the formation of fractures as kerogen converts to hydrocarbons and undergoes a substantial volume increase within a confined system. If initial permeability is too low to allow release of the hydrocarbons, excess pore pressure will eventually cause fractures.

The generated hydrocarbons may be produced via the same wells by which the electric power is delivered to the conductive fracture, or additional wells may be used. Any method of producing the producible hydrocarbons may be used, as will be familiar to those skilled in the art.

As used herein, the term "hydrocarbon(s)" refers to organic material with molecular structures containing carbon bonded to hydrogen. Hydrocarbons may also include other elements such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. and 1 atm pressure). Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Production fluids may include, but are not limited to, pyrolyzed shale oil, synthesis gas, a pyrolysis product of coal, carbon dioxide, hydrogen sulfide and water (including steam). Produced fluids may include both hydrocarbon fluids and non-hydrocarbon fluids.

As used herein, the term "condensable hydrocarbons" means those hydrocarbons that condense at 25° C. and one atmosphere absolute pressure. Condensable hydrocarbons may include a mixture of hydrocarbons having carbon numbers greater than 4.

As used herein, the term "non-condensable hydrocarbons" means those hydrocarbons that do not condense at 25° C. and one atmosphere absolute pressure. Non-condensable hydrocarbons may include hydrocarbons having carbon numbers less than 5.

As used herein, the term "heavy hydrocarbons" refers to hydrocarbon fluids that are highly viscous at ambient conditions (15° C. and 1 atm pressure). Heavy hydrocarbons may include highly viscous hydrocarbon fluids such as heavy oil, tar, and/or asphalt. Heavy hydrocarbons may include carbon and hydrogen, as well as smaller concentrations of sulfur, oxygen, and nitrogen. Additional elements may also be present in heavy hydrocarbons in trace amounts. Heavy hydrocarbons may be classified by API gravity. Heavy hydrocarbons generally have an API gravity below about 20 degrees. Heavy oil, for example, generally has an API gravity of about 10 to 20 degrees, whereas tar generally has an API gravity below about 10 degrees. The viscosity of heavy hydrocarbons is generally greater than about 100 centipoise at 15° C.

As used herein, the term "solid hydrocarbons" refers to any hydrocarbon material that is found naturally in substantially solid form at formation conditions. Non-limiting examples include kerogen, coal, shungites, asphaltites, and natural mineral waxes.

As used herein, the term "formation hydrocarbons" refers to both heavy hydrocarbons and solid hydrocarbons that are contained in an organic-rich rock formation. Formation hydrocarbons may be, but are not limited to, kerogen, oil shale, coal, bitumen, tar, natural mineral waxes, and asphaltites.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar in it.

As used herein, the term "kerogen" refers to a solid, insoluble hydrocarbon that principally contains carbon, hydrogen, nitrogen, oxygen, and sulfur. Oil shale contains kerogen.

As used herein, the term "bitumen" refers to a non-crystalline solid or viscous hydrocarbon material that is substantially soluble in carbon disulfide.

As used herein, the term "oil" refers to a hydrocarbon fluid containing a mixture of condensable hydrocarbons.

As used herein, the term "subsurface" refers to geologic strata occurring below the earth's surface.

As used herein, the term "hydrocarbon-rich formation" refers to any formation that contains more than trace amounts of hydrocarbons. For example, a hydrocarbon-rich formation may include portions that contain hydrocarbons at a level of greater than 5 volume percent. The hydrocarbons located in a hydrocarbon-rich formation may include, for example, oil, natural gas, heavy hydrocarbons, and solid hydrocarbons.

As used herein, the term "organic-rich rock" refers to any rock matrix holding solid hydrocarbons and/or heavy hydrocarbons. Rock matrices may include, but are not limited to, sedimentary rocks, shales, siltstones, sands, silicilytes, carbonates, and diatomites. Organic-rich rock may contain kerogen.

As used herein, the term "formation" refers to any finite subsurface region. The formation may contain one or more hydrocarbon-containing layers, one or more non-hydrocarbon containing layers, an overburden, and/or an underburden of any subsurface geologic formation. An "overburden" is geological material above the formation of interest, while an "underburden" is geological material below the formation of interest. An overburden or underburden may include one or more different types of substantially impermeable materials. For example, overburden and/or underburden may include rock, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

As used herein, the term "organic-rich rock formation" refers to any formation containing organic-rich rock. Organic-rich rock formations include, for example, oil shale formations, coal formations, and tar sands formations.

As used herein, the term "pyrolysis" refers to the breaking of chemical bonds through the application of heat. For example, pyrolysis may include transforming a compound into one or more other substances by heat alone or by heat in combination with an oxidant. Pyrolysis may include modifying the nature of the compound by addition of hydrogen atoms which may be obtained from molecular hydrogen, water, carbon dioxide, or carbon monoxide. Heat may be transferred to a section of the formation to cause pyrolysis.

As used herein, the term "water-soluble minerals" refers to minerals that are soluble in water. Water-soluble minerals include, for example, nahcolite (sodium bicarbonate), soda ash (sodium carbonate), dawsonite ($NaAl(CO_3)(OH)_2$), or combinations thereof. Substantial solubility may require heated water and/or a non-neutral pH solution.

As used herein, the term "formation water-soluble minerals" refers to water-soluble minerals that are found naturally in a formation.

As used herein, the term "subsidence" refers to a downward movement of a surface relative to an initial elevation of the surface.

As used herein, the term "thickness" of a layer refers to the distance between the upper and lower boundaries of a cross section of a layer, wherein the distance is measured normal to the average tilt of the cross section.

As used herein, the term "thermal fracture" refers to fractures created in a formation caused directly or indirectly by expansion or contraction of a portion of the formation and/or fluids within the formation, which in turn is caused by increasing/decreasing the temperature of the formation and/or fluids within the formation, and/or by increasing/decreasing a pressure of fluids within the formation due to heating. Thermal fractures may propagate into or form in neighboring regions significantly cooler than the heated zone.

As used herein, the term "hydraulic fracture" refers to a fracture at least partially propagated into a formation, wherein the fracture is created through injection of pressurized fluids into the formation. While the term "hydraulic fracture" is used, the descriptions herein are not limited to use in hydraulic fractures. The description is suitable for use in any fracture created in any manner considered to be suitable by one skilled in the art. The fracture may be artificially held open by injection of a proppant material. Hydraulic fractures may be substantially horizontal in orientation, substantially vertical in orientation, or oriented along any other plane.

As used herein, the term "wellbore" refers to a hole in the subsurface made by drilling or insertion of a conduit into the subsurface. A wellbore may have a substantially circular cross section, or other cross-sectional shapes (e.g., circles, ovals, squares, rectangles, triangles, slits, or other regular or irregular shapes). As used herein, the term "well", when referring to an opening in the formation, may be used interchangeably with the term "wellbore."

The descriptions are described herein in connection with certain specific embodiments. However, to the extent that the following detailed description is specific to a particular embodiment or a particular use, such is intended to be illustrative only and is not to be construed as limiting the scope of the description.

As discussed herein, some embodiments of the description include or have application related to an in situ method of recovering natural resources. The natural resources may be recovered from an organic-rich rock formation including, for example, an oil shale formation. The organic-rich rock formation may include formation hydrocarbons including, for example, kerogen, coal, and heavy hydrocarbons. In some embodiments of the description the natural resources may include hydrocarbon fluids including, for example, products of the pyrolysis of formation hydrocarbons such as shale oil. In some embodiments of the description the natural resources may also include water-soluble minerals including, for example, nahcolite (sodium bicarbonate, or $2NaHCO_3$), soda ash (sodium carbonate, or $Na_2CO_3$) and dawsonite ($NaAl(CO_3)(OH)_2$).

FIG. 1 presents a perspective view of an illustrative oil shale development area 10. A surface 12 of the development area 10 is indicated. Below the surface is an organic-rich rock formation 16. The illustrative subsurface formation 16 contains formation hydrocarbons (such as, for example, kerogen) and possibly valuable water-soluble minerals (such as, for example, nahcolite). It is understood that the representative formation 16 may be any organic-rich rock formation, including a rock matrix containing coal or tar sands, for example. In addition, the rock matrix making up the formation 16 may be permeable, semi-permeable or essentially non-permeable. The present descriptions are particularly advantageous in oil shale development areas initially having very limited or effectively no fluid permeability.

In order to access formation 16 and recover natural resources therefrom, a plurality of wellbores is formed. Wellbores are shown at 14 in FIG. 1. The representative wellbores 14 are essentially vertical in orientation relative to the surface 12. However, it is understood that some or all of the wellbores 14 could deviate into an obtuse or even horizontal orientation. In the arrangement of FIG. 1, each of the wellbores 14 is completed in the oil shale formation 16. The completions may be either open or cased hole. The well completions may also include propped or unpropped hydraulic fractures emanating therefrom.

In the view of FIG. 1, only seven wellbores 14 are shown. However, it is understood that in an oil shale development project, numerous additional wellbores 14 will most likely be drilled. The wellbores 14 may be located in relatively close proximity, being from 10 feet to up to 300 feet in separation. In some embodiments, a well spacing of 15 to 25 feet is provided. Typically, the wellbores 14 are also completed at shallow depths, being from 200 to 5,000 feet at total depth. In some embodiments the oil shale formation targeted for in situ retorting is at a depth greater than 200 feet below the surface or alternatively 400 feet below the surface. Alternatively, conversion and production occur at depths between 500 and 2,500 feet.

The wellbores 14 will be selected for certain functions and may be designated as heat injection wells, water injection wells, oil production wells and/or water-soluble mineral solution production wells. In one aspect, the wellbores 14 are dimensioned to serve two, three, or all four of these purposes in designated sequences. Suitable tools and equipment may be sequentially run into and removed from the wellbores 14 to serve the various purposes.

A fluid processing facility 17 is also shown schematically. The fluid processing facility 17 is equipped to receive fluids produced from the organic-rich rock formation 16 through one or more pipelines or flow lines 18. The fluid processing facility 17 may include equipment suitable for receiving and separating oil, gas, and water produced from the heated formation. The fluid processing facility 17 may further include equipment for separating out dissolved water-soluble minerals and/or migratory contaminant species, including, for example, dissolved organic contaminants, metal contaminants, or ionic contaminants in the produced water recovered from the organic-rich rock formation 16. The contaminants may include, for example, aromatic hydrocarbons such as benzene, toluene, xylene, and tri-methylbenzene. The contaminants may also include polyaromatic hydrocarbons such as anthracene, naphthalene, chrysene and pyrene. Metal contaminants may include species containing arsenic, boron, chromium, mercury, selenium, lead, vanadium, nickel, cobalt, molybdenum, or zinc. Ionic contaminant species may include, for example, sulfates, chlorides, fluorides, lithium, potassium, aluminum, ammonia, and nitrates.

Figure 2:
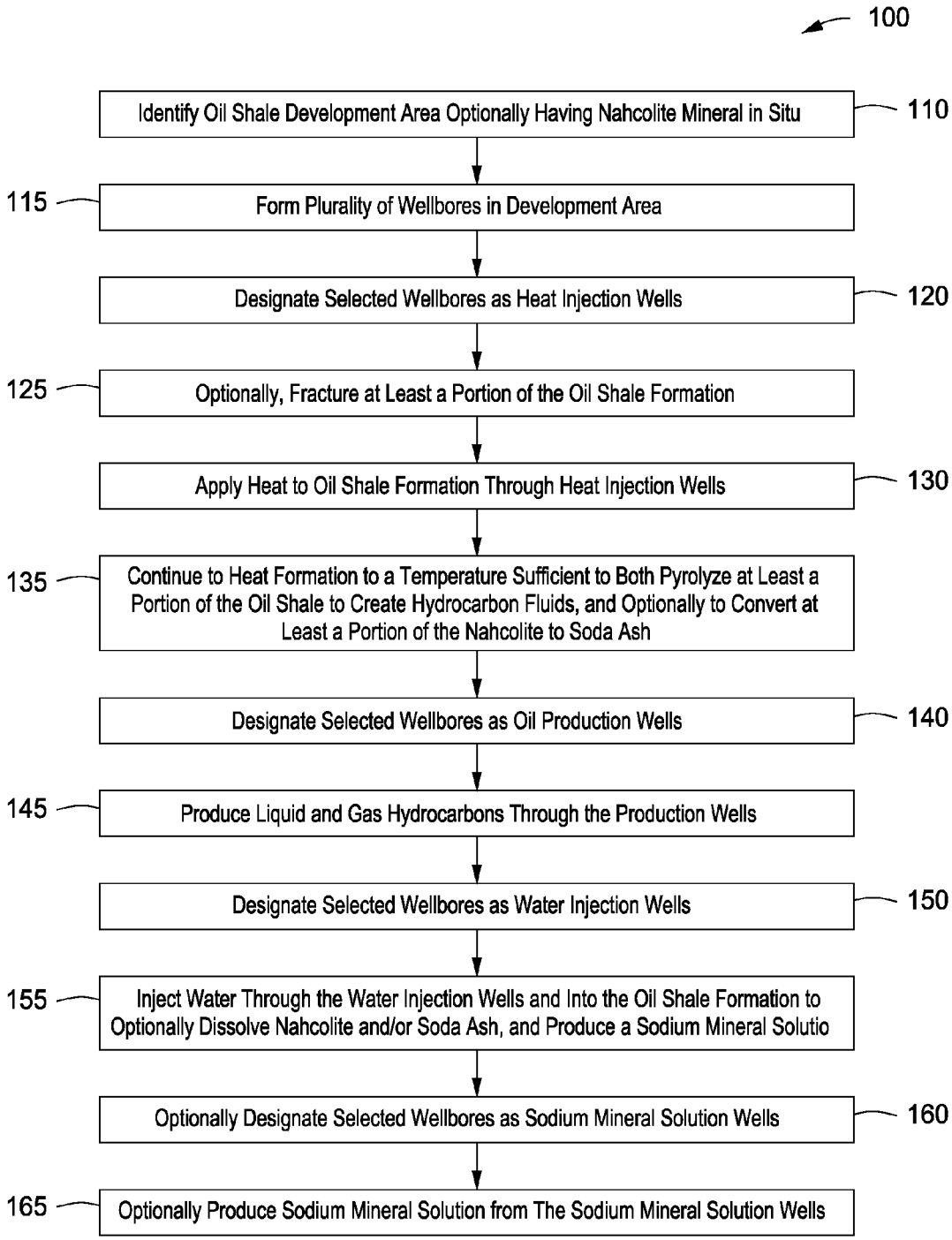
FIG. 2 is a flow chart demonstrating a general method of in situ thermal recovery of oil and gas from an organic-rich rock formation, in one embodiment.

In order to recover oil, gas, and sodium (or other) water-soluble minerals, a series of steps may be undertaken. FIG. 2 presents a flow chart demonstrating a method of in situ thermal recovery of oil and gas from an organic-rich rock formation 100, in one embodiment. It is understood that the order of some of the steps from FIG. 2 may be changed, and that the sequence of steps is merely for illustration.

First, the oil shale (or other organic-rich rock) formation 16 is identified within the development area 10. This step is shown in box 110. Optionally, the oil shale formation may contain nahcolite or other sodium minerals. The targeted development area within the oil shale formation may be identified by measuring or modeling the depth, thickness and organic richness of the oil shale as well as evaluating the position of the organic-rich rock formation relative to other rock types, structural features (e.g. faults, anticlines or synclines), or hydrogeological units (i.e. aquifers). This is accomplished by creating and interpreting maps and/or models of depth, thickness, organic richness and other data from available tests and sources. This may involve performing geological surface surveys, studying outcrops, performing seismic surveys, and/or drilling boreholes to obtain core samples from subsurface rock. Rock samples may be analyzed to assess kerogen content and hydrocarbon fluid generating capability.

The kerogen content of the organic-rich rock formation may be ascertained from outcrop or core samples using a variety of data. Such data may include organic carbon content, hydrogen index, and modified Fischer assay analyses. Subsurface permeability may also be assessed via rock samples, outcrops, or studies of ground water flow. Furthermore the connectivity of the development area to ground water sources may be assessed.

Next, a plurality of wellbores 14 is formed across the targeted development area 10. This step is shown schematically in box 115. The purposes of the wellbores 14 are set forth above and need not be repeated. However, it is noted that for purposes of the wellbore formation step of box 115, only a portion of the wells need be completed initially. For instance, at the beginning of the project heat injection wells are needed, while a majority of the hydrocarbon production wells are not yet needed. Production wells may be brought in once conversion begins, such as after 4 to 12 months of heating.

It is understood that petroleum engineers will develop a strategy for the best depth and arrangement for the wellbores 14, depending upon anticipated reservoir characteristics, economic constraints, and work scheduling constraints. In addition, engineering staff will determine what wellbores 14 shall be used for initial formation 16 heating. This selection step is represented by box 120.

Concerning heat injection wells, there are various methods for applying heat to the organic-rich rock formation 16. The present methods are not limited to the heating technique employed unless specifically so stated in the claims. The heating step is represented generally by box 130. Preferably, for in situ processes the heating of a production zone takes place over a period of months, or even four or more years.

The formation 16 is heated to a temperature sufficient to pyrolyze at least a portion of the oil shale in order to convert the kerogen to hydrocarbon fluids. The bulk of the target zone of the formation may be heated to between 270° C. to 800° C. Alternatively, the targeted volume of the organic-rich formation is heated to at least 350° C. to create production fluids. The conversion step is represented in FIG. 2 by box 135. The resulting liquids and hydrocarbon gases may be refined into products which resemble common commercial petroleum products. Such liquid products include transportation fuels such as diesel, jet fuel and naphtha. Generated gases include light alkanes, light alkenes, $H_2$, $CO_2$, CO, and $NH_3$.

Conversion of the oil shale will create permeability in the oil shale section in rocks that were originally impermeable. Preferably, the heating and conversion processes of boxes 130 and 135, occur over a lengthy period of time. In one aspect, the heating period is from three months to four or more years. Also as an optional part of box 135, the formation 16 may be heated to a temperature sufficient to convert at least a portion of nahcolite, if present, to soda ash. Heat applied to mature the oil shale and recover oil and gas will also convert nahcolite to sodium carbonate (soda ash), a related sodium mineral. The process of converting nahcolite (sodium bicarbonate) to soda ash (sodium carbonate) is described herein.

In connection with the heating step 130, the rock formation 16 may optionally be fractured to aid heat transfer or later hydrocarbon fluid production. The optional fracturing step is shown in box 125. Fracturing may be accomplished by creating thermal fractures within the formation through application of heat. By heating the organic-rich rock and transforming the kerogen to oil and gas, the permeability of portions of the formation are increased via thermal fracture formation and subsequent production of a portion of the hydrocarbon fluids generated from the kerogen. Alternatively, a process known as hydraulic fracturing may be used. Hydraulic fracturing is a process known in the art of oil and gas recovery where a fracture fluid is pressurized within the wellbore above the fracture pressure of the formation, thus developing fracture planes within the formation to relieve the pressure generated within the wellbore. Hydraulic fractures may be used to create additional permeability in portions of the formation and/or be used to provide a planar source for heating.

U.S. Pat. No. 7,331,385 entitled "Methods of Treating a Subterranean Formation to Convert Organic Matter into Producible Hydrocarbons" describes one use of hydraulic fracturing, and is incorporated herein by reference in its entirety. This patent teaches the use of electrically conductive fractures to heat oil shale. A heating element is constructed by forming wellbores and then hydraulically fracturing the oil shale formation around the wellbores. The fractures are filled with an electrically conductive material which forms the heating element. Calcined petroleum coke is an exemplary suitable conductant material. Preferably, the fractures are created in a vertical orientation extending from horizontal wellbores. Electricity may be conducted through the conductive fractures from the heel to the toe of each well. The electrical circuit may be completed by an additional horizontal well that intersects one or more of the vertical fractures near the toe to supply the opposite electrical polarity. The U.S. Pat. No. 7,331,385 process creates an "in situ toaster" that artificially matures oil shale through the application of electric heat. Thermal conduction heats the oil shale to conversion temperatures in excess of 300° C., causing artificial maturation.

It is noted that U.S. Pat. No. 3,137,347 also describes the use of granular conductive materials to connect subsurface electrodes for the in situ heating of oil shale. The '347 patent envisions the granular material being a primary source of heat until the oil shale undergoes pyrolysis. At that point, the oil shale itself is said to become electrically conductive. Heat generated within the formation and heat conducted into the surrounding formation due to the passing of current through the shale oil material itself is claimed to generate hydrocarbon fluids for production.

As part of the hydrocarbon fluid production process 100, certain wells 14 may be designated as oil and gas production wells. This step is depicted by box 140. Oil and gas production might not be initiated until it is determined that the kerogen has been sufficiently retorted to allow maximum recovery of oil and gas from the formation 16. In some instances, dedicated production wells are not drilled until after heat injection wells (box 130) have been in operation for a period of several weeks or months. Thus, box 140 may include the formation of additional wellbores 14. In other instances, selected heater wells are converted to production wells.

After certain wellbores 14 have been designated as oil and gas production wells, oil and/or gas is produced from the wellbores 14. The oil and/or gas production process is shown at box 145. At this stage (box 145), any water-soluble minerals, such as nahcolite and converted soda ash may remain substantially trapped in the rock formation 16 as finely disseminated crystals or nodules within the oil shale beds, and are not produced. However, some nahcolite and/or soda ash may be dissolved in the water created during heat conversion (box 135) within the formation. Thus, production fluids may contain not only hydrocarbon fluids, but also aqueous fluid containing water-soluble minerals. In such case, the production fluids may be separated into a hydrocarbon stream and an aqueous stream at a surface facility. Thereafter the water-soluble minerals and any migratory contaminant species may be recovered from the aqueous stream.

Box 150 presents an optional next step in the oil and gas recovery method 100. Here, certain wellbores 14 are designated as water or aqueous fluid injection wells. Aqueous fluids are solutions of water with other species. The water may constitute "brine," and may include dissolved inorganic salts of chloride, sulfates and carbonates of Group I and II elements of The Periodic Table of Elements. Organic salts can also be present in the aqueous fluid. The water may alternatively be fresh water containing other species. The other species may be present to alter the pH. Alternatively, the other species may reflect the availability of brackish water not saturated in the species wished to be leached from the subsurface.

Preferably, the water injection wells are selected from some or all of the wellbores used for heat injection or for oil and/or gas production. However, the scope of the step of box 150 may include the drilling of yet additional wellbores 14 for use as dedicated water injection wells. In this respect, it may be desirable to complete water injection wells along a periphery of the development area 10 in order to create a boundary of high pressure.

Next, optionally water or an aqueous fluid is injected through the water injection wells and into the oil shale formation 16. This step is shown at box 155. The water may be in the form of steam or pressurized hot water. Alternatively the injected water may be cool and becomes heated as it contacts the previously heated formation. The injection process may further induce fracturing. This process may create fingered caverns and brecciated zones in the nahcolite-bearing intervals some distance, for example up to 200 feet out, from the water injection wellbores. In one aspect, a gas cap, such as nitrogen, may be maintained at the top of each "cavern" to prevent vertical growth.

Along with the designation of certain wellbores 14 as water injection wells, the design engineers may also designate certain wellbores 14 as water or water-soluble mineral solution production wells. This step is shown in box 160. These wells may be the same as wells used to previously produce hydrocarbons or inject heat. These recovery wells may be used to produce an aqueous solution of dissolved water-soluble minerals and other species, including, for example, migratory contaminant species. For example, the solution may be one primarily of dissolved soda ash. This step is shown in box 165. Alternatively, single wellbores may be used to both inject water and then to recover a sodium mineral solution. Thus, box 165 includes the option of using the same wellbores 14 for both water injection and solution production (Box 165).

Temporary control of the migration of the migratory contaminant species, especially during the pyrolysis process, can be obtained via placement of the injection and production wells 14 such that fluid flow out of the heated zone is minimized. Typically, this involves placing injection wells at the periphery of the heated zone so as to cause pressure gradients which prevent flow inside the heated zone from leaving the zone.

Figure 3:
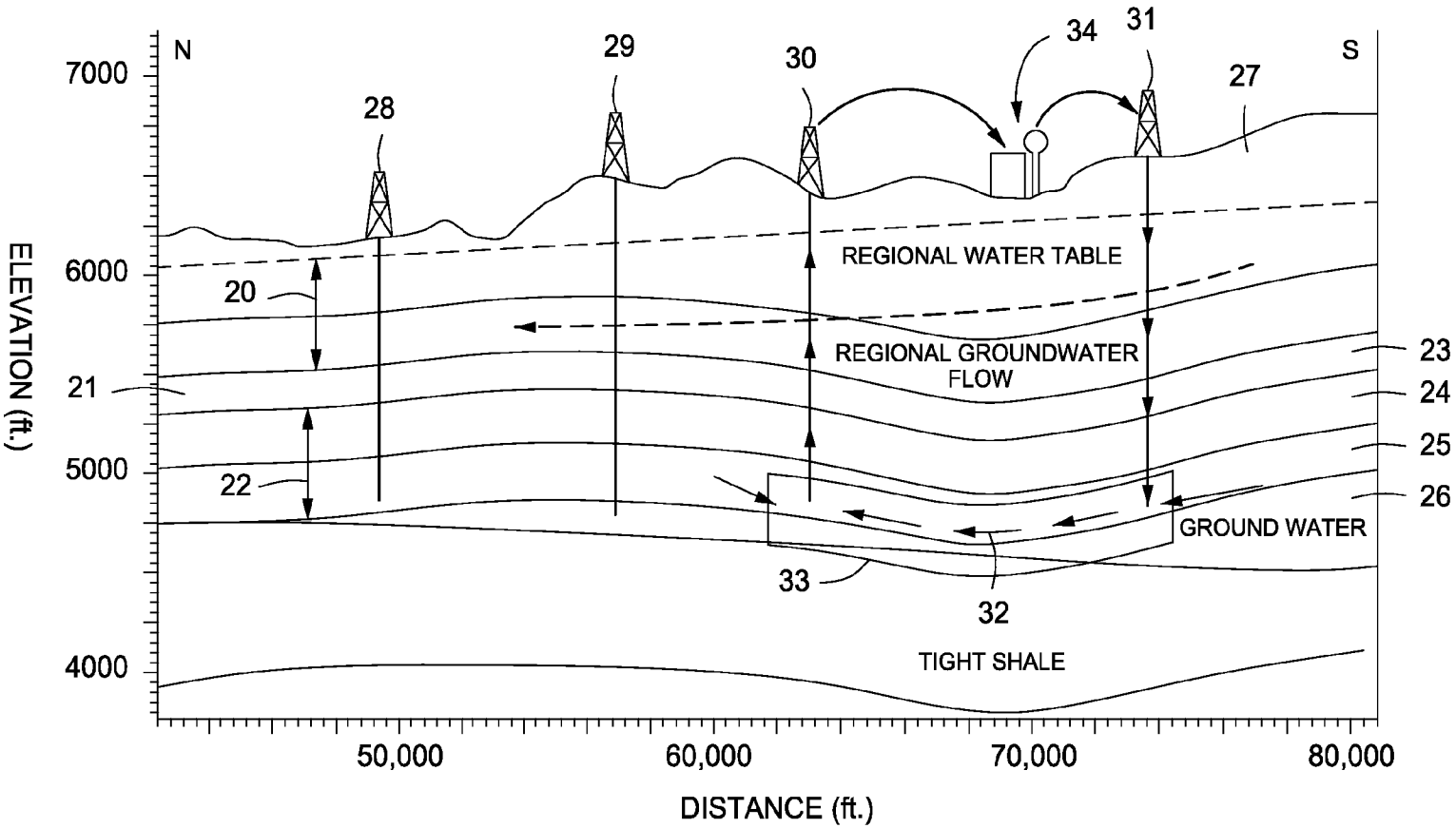
FIG. 3 is a cross-sectional side view of an illustrative oil shale formation that is within or connected to groundwater aquifers, and a formation leaching operation.

FIG. 3 is a cross-sectional view of an illustrative oil shale formation that is within or connected to ground water aquifers and a formation leaching operation. Four separate oil shale formation zones are depicted (23, 24, 25 and 26) within the oil shale formation. The water aquifers are below the ground surface 27, and are categorized as an upper aquifer 20 and a lower aquifer 22. Intermediate the upper and lower aquifers is an aquitard 21. It can be seen that certain zones of the formation are both aquifers or aquitards and oil shale zones. A plurality of wells (28, 29, 30 and 31) is shown traversing vertically downward through the aquifers. One of the wells is serving as a water injection well 31, while another is serving as a water production well 30. In this way, water is circulated 32 through at least the lower aquifer 22.

FIG. 3 shows diagrammatically water circulating 32 through an oil shale volume 33 that was heated, that resides within or is connected to an aquifer 22, and from which hydrocarbon fluids were previously recovered. Introduction of water via the water injection well 31 forces water into the previously heated oil shale 33 and water-soluble minerals and migratory contaminants species are swept to the water production well 30. The water may then be processed in a facility 34 wherein the water-soluble minerals (e.g. nahcolite or soda ash) and the migratory contaminants may be substantially removed from the water stream. Water is then reinjected into the oil shale volume 33 and the formation leaching is repeated. This leaching with water is intended to continue until levels of migratory contaminant species are at environmentally acceptable levels within the previously heated oil shale zone 33. This may require 1 cycle, 2 cycles, 5 cycles or more cycles of formation leaching, where a single cycle indicates injection and production of approximately one pore volume of water. It is understood that there may be numerous water injection and water production wells in an actual oil shale development. Moreover, the system may include monitoring wells (28 and 29) which can be utilized during the oil shale heating phase, the shale oil production phase, the leaching phase, or during any combination of these phases to monitor for migratory contaminant species and/or water-soluble minerals.

In some fields, formation hydrocarbons, such as oil shale, may exist in more than one subsurface formation. In some instances, the organic-rich rock formations may be separated by rock layers that are hydrocarbon-free or that otherwise have little or no commercial value. Therefore, it may be desirable for the operator of a field under hydrocarbon development to undertake an analysis as to which of the subsurface, organic-rich rock formations to target or in which order they should be developed.

The organic-rich rock formation may be selected for development based on various factors. One such factor is the thickness of the hydrocarbon containing layer within the formation. Greater pay zone thickness may indicate a greater potential volumetric production of hydrocarbon fluids. Each of the hydrocarbon containing layers may have a thickness that varies depending on, for example, conditions under which the formation hydrocarbon containing layer was formed. Therefore, an organic-rich rock formation will typically be selected for treatment if that formation includes at least one formation hydrocarbon-containing layer having a thickness sufficient for economical production of produced fluids.

An organic-rich rock formation may also be chosen if the thickness of several layers that are closely spaced together is sufficient for economical production of produced fluids. For example, an in situ conversion process for formation hydrocarbons may include selecting and treating a layer within an organic-rich rock formation having a thickness of greater than about 5 meters, 10 meters, 50 meters, or even 100 meters. In this manner, heat losses (as a fraction of total injected heat) to layers formed above and below an organic-rich rock formation may be less than such heat losses from a thin layer of formation hydrocarbons. A process as described herein, however, may also include selecting and treating layers that may include layers substantially free of formation hydrocarbons or thin layers of formation hydrocarbons.

The richness of one or more organic-rich rock formations may also be considered. Richness may depend on many factors including the conditions under which the formation hydrocarbon containing layer was formed, an amount of formation hydrocarbons in the layer, and/or a composition of formation hydrocarbons in the layer. A thin and rich formation hydrocarbon layer may be able to produce significantly more valuable hydrocarbons than a much thicker, less rich formation hydrocarbon layer. Of course, producing hydrocarbons from a formation that is both thick and rich is desirable.

The kerogen content of an organic-rich rock formation may be ascertained from outcrop or core samples using a variety of data. Such data may include organic carbon content, hydrogen index, and modified Fischer assay analyses. The Fischer Assay is a standard method which involves heating a sample of a formation hydrocarbon containing layer to approximately 500° C. in one hour, collecting fluids produced from the heated sample, and quantifying the amount of fluids produced.

Subsurface formation permeability may also be assessed via rock samples, outcrops, or studies of ground water flow. Furthermore the connectivity of the development area to ground water sources may be assessed. Thus, an organic-rich rock formation may be chosen for development based on the permeability or porosity of the formation matrix even if the thickness of the formation is relatively thin.

Other factors known to petroleum engineers may be taken into consideration when selecting a formation for development. Such factors include depth of the perceived pay zone, stratigraphic proximity of fresh ground water to kerogen-containing zones, continuity of thickness, and other factors. For instance, the assessed fluid production content within a formation will also effect eventual volumetric production.

In producing hydrocarbon fluids from an oil shale field, it may be desirable to control the migration of pyrolyzed fluids. In some instances, this includes the use of injection wells such as well 31, particularly around the periphery of the field. Such wells may inject water, steam, $CO_2$, heated methane, or other fluids to drive cracked kerogen fluids inwardly towards production wells. In some embodiments, physical barriers may be placed around the area of the organic-rich rock formation under development. One example of a physical barrier involves the creation of freeze walls. Freeze walls are formed by circulating refrigerant through peripheral wells to substantially reduce the temperature of the rock formation. This, in turn, prevents the pyrolyzation of kerogen present at the periphery of the field and the outward migration of oil and gas. Freeze walls will also cause native water in the formation along the periphery to freeze.

The use of subsurface freezing to stabilize poorly consolidated soils or to provide a barrier to fluid flow is known in the art. Shell Exploration and Production Company has discussed the use of freeze walls for oil shale production in several patents, including U.S. Pat. No. 6,880,633 and U.S. Pat. No. 7,032,660. Shell's '660 patent uses subsurface freezing to protect against groundwater flow and groundwater contamination during in situ shale oil production. Additional patents that disclose the use of so-called freeze walls are U.S. Pat. No. 3,528,252, U.S. Pat. No. 3,943,722, U.S. Pat. No. 3,729,965, U.S. Pat. No. 4,358,222, U.S. Pat. No. 4,607,488, and international application WO 1990/06480.

As noted above, several different types of wells may be used in the development of an organic-rich rock formation, including, for example, an oil shale field. For example, the heating of the organic-rich rock formation may be accomplished through the use of heater wells. The heater wells may include, for example, electrical resistance heating elements. The production of hydrocarbon fluids from the formation may be accomplished through the use of wells completed for the production of fluids. The injection of an aqueous fluid may be accomplished through the use of injection wells. Finally, the production of an aqueous solution may be accomplished through use of solution production wells.

The different wells listed above may be used for more than one purpose. Stated another way, wells initially completed for one purpose may later be used for another purpose, thereby lowering project costs and/or decreasing the time required to perform certain tasks. For example, one or more of the production wells may also be used as injection wells for later injecting water into the organic-rich rock formation. Alternatively, one or more of the production wells may also be used as solution production wells for later producing an aqueous solution from the organic-rich rock formation.

In other aspects, production wells (and in some circumstances heater wells) may initially be used as dewatering wells (e.g., before heating is begun and/or when heating is initially started). In addition, in some circumstances dewatering wells can later be used as production wells (and in some circumstances heater wells). As such, the dewatering wells may be placed and/or designed so that such wells can be later used as production wells and/or heater wells. The heater wells may be placed and/or designed so that such wells can be later used as production wells and/or dewatering wells. The production wells may be placed and/or designed so that such wells can be later used as dewatering wells and/or heater wells. Similarly, injection wells may be wells that initially were used for other purposes (e.g., heating, production, dewatering, monitoring, etc.), and injection wells may later be used for other purposes. Similarly, monitoring wells may be wells that initially were used for other purposes (e.g., heating, production, dewatering, injection, etc.). Finally, monitoring wells may later be used for other purposes such as water production.

It is desirable to arrange the various wells for an oil shale field in a pre-planned pattern. For instance, heater wells may be arranged in a variety of patterns including, but not limited to triangles, squares, hexagons, and other polygons. The pattern may include a regular polygon to promote uniform heating through at least the portion of the formation in which the heater wells are placed. The pattern may also be a line drive pattern. A line drive pattern generally includes a first linear array of heater wells, a second linear array of heater wells, and a production well or a linear array of production wells between the first and second linear array of heater wells. Interspersed among the heater wells are typically one or more production wells. The injection wells may likewise be disposed within a repetitive pattern of units, which may be similar to or different from that used for the heater wells.

One method to reduce the number of wells is to use a single well as both a heater well and a production well. Reduction of the number of wells by using single wells for sequential purposes can reduce project costs. One or more monitoring wells may be disposed at selected points in the field. The monitoring wells may be configured with one or more devices that measure a temperature, a pressure, and/or a property of a fluid in the wellbore. In some instances, a heater well may also serve as a monitoring well, or otherwise be instrumented.

Another method for reducing the number of heater wells is to use well patterns. Regular patterns of heater wells equidistantly spaced from a production well may be used. The patterns may form equilateral triangular arrays, hexagonal arrays, or other array patterns. The arrays of heater wells may be disposed such that a distance between each heater well is less than about 70 feet (21 meters). A portion of the formation may be heated with heater wells disposed substantially parallel to a boundary of the hydrocarbon formation.

In alternative embodiments, the array of heater wells may be disposed such that a distance between each heater well may be less than about 100 feet, or 50 feet, or 30 feet. Regardless of the arrangement of or distance between the heater wells, in certain embodiments, a ratio of heater wells to production wells disposed within a organic-rich rock formation may be greater than about 5, 8, 10, 20, or more.

In one embodiment, individual production wells are surrounded by at most one layer of heater wells. This may include arrangements such as 5-spot, 7-spot, or 9-spot arrays, with alternating rows of production and heater wells. In another embodiment, two layers of heater wells may surround a production well, but with the heater wells staggered so that a clear pathway exists for the majority of flow away from the further heater wells. Flow and reservoir simulations may be employed to assess the pathways and temperature history of hydrocarbon fluids generated in situ as they migrate from their points of origin to production wells.

Figure 4:
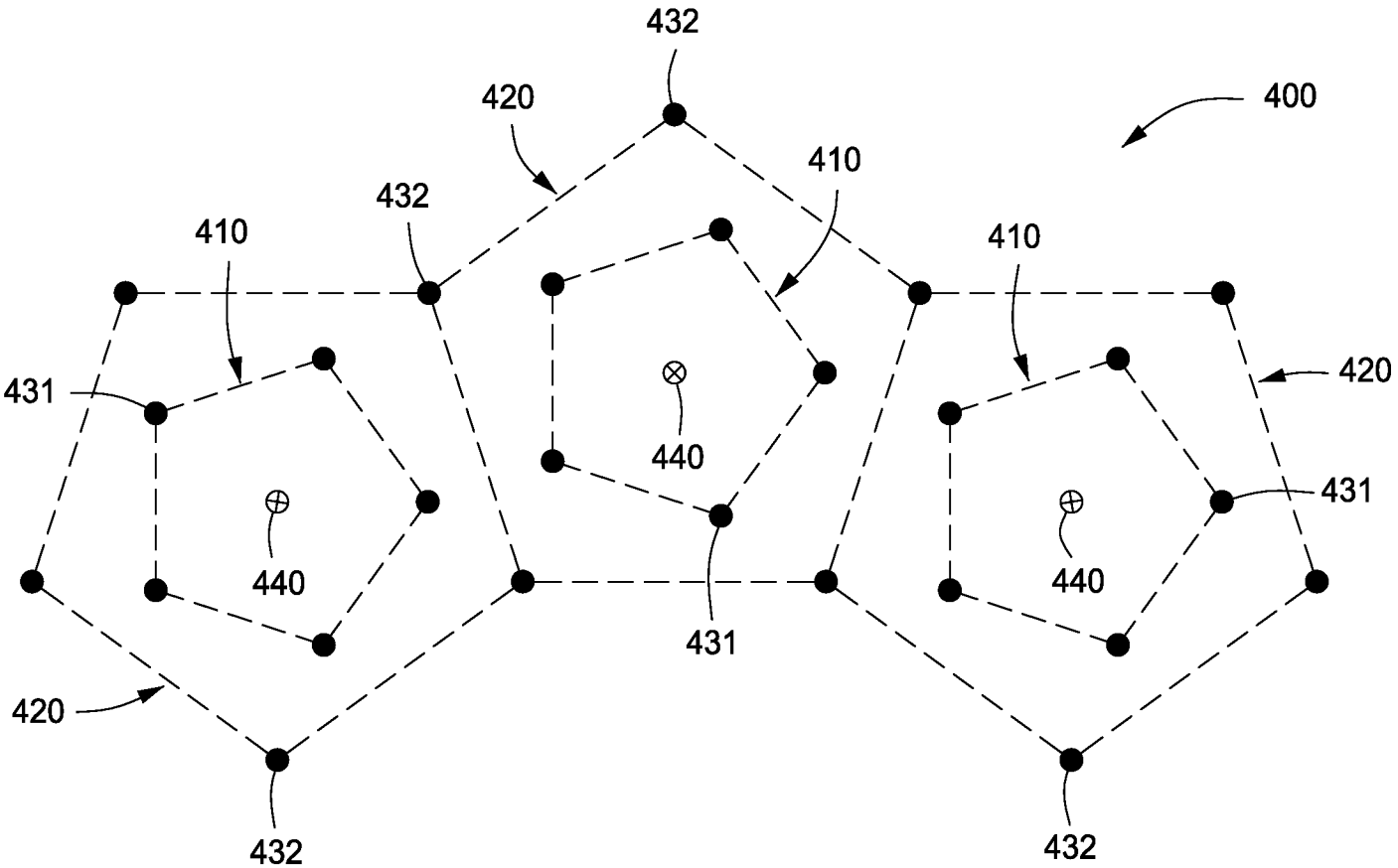
FIG. 4 is a plan view of an illustrative heater well pattern. Two layers of heater wells are shown around respective production wells.

FIG. 4 provides a plan view of an illustrative heater well arrangement using more than one layer of heater wells. The heater well arrangement is used in connection with the production of hydrocarbons from a shale oil development area 400. In FIG. 4, the heater well arrangement employs a first layer of heater wells 410, surrounded by a second layer of heater wells 420. The heater wells in the first layer 410 are referenced at 431, while the heater wells in the second layer 420 are referenced at 432.

A production well 440 is shown central to the well layers 410 and 420. It is noted that the heater wells 432 in the second layer 420 of wells are offset from the heater wells 431 in the first layer 410 of wells, relative to the production well 440. The purpose is to provide a flowpath for converted hydrocarbons that minimizes travel near a heater well in the first layer 410 of heater wells. This, in turn, minimizes secondary cracking of hydrocarbons converted from kerogen as hydrocarbons flow from the second layer of wells 420 to the production wells 440.

In the illustrative arrangement of FIG. 4, the first layer 410 and the second layer 420 each defines a 5-spot pattern. However, it is understood that other patterns may be employed, such as 3-spot or 6-spot patterns. In any instance, a plurality of heater wells 431 comprising a first layer of heater wells 410 is placed around a production well 440, with a second plurality of heater wells 432 comprising a second layer of heater wells 420 placed around the first layer 410.

The heater wells in the two layers also may be arranged such that the majority of hydrocarbons generated by heat from each heater well 432 in the second layer 420 are able to migrate to a production well 440 without passing substantially near a heater well 431 in the first layer 410. The heater wells 431, 432 in the two layers 410, 420 further may be arranged such that the majority of hydrocarbons generated by heat from each heater well 432 in the second layer 420 are able to migrate to the production well 440 without passing through a zone of substantially increasing formation temperature.

Another method for reducing the number of heater wells is to use well patterns that are elongated in a particular direction, particularly in a direction determined to provide the most efficient thermal conductivity. Heat convection may be affected by various factors such as bedding planes and stresses within the formation. For instance, heat convection may be more efficient in the direction perpendicular to the least horizontal principal stress on the formation. In some instances, heat convection may be more efficient in the direction parallel to the least horizontal principal stress. Elongation may be practiced in, for example, line drive patterns or spot patterns.

In connection with the development of a shale oil field, it may be desirable that the progression of heat through the subsurface in accordance with steps 130 and 135 be uniform. However, for various reasons the heating and maturation of formation hydrocarbons in a subsurface formation may not proceed uniformly despite a regular arrangement of heater and production wells. Heterogeneities in the oil shale properties and formation structure may cause certain local areas to be more or less efficient in terms of pyrolysis. Moreover, formation fracturing which occurs due to the heating and maturation of the oil shale can lead to an uneven distribution of preferred pathways and, thus, increase flow to certain production wells and reduce flow to others. Uneven fluid maturation may be an undesirable condition since certain subsurface regions may receive more heat energy than necessary where other regions receive less than desired. This, in turn, leads to the uneven flow and recovery of production fluids. Produced oil quality, overall production rate, and/or ultimate recoveries may be reduced.

To detect uneven flow conditions, production and heater wells may be instrumented with sensors. Sensors may include equipment to measure temperature, pressure, flow rates, and/or compositional information. Data from these sensors can be processed via simple rules or input to detailed simulations to reach decisions on how to adjust heater and production wells to improve subsurface performance. Production well performance may be adjusted by controlling backpressure or throttling on the well. Heater well performance may also be adjusted by controlling energy input. Sensor readings may also sometimes imply mechanical problems with a well or downhole equipment which requires repair, replacement, or abandonment.

In one embodiment, flow rate, compositional, temperature and/or pressure data are utilized from two or more wells as inputs to a computer algorithm to control heating rate and/or production rates. Unmeasured conditions at or in the neighborhood of the well are then estimated and used to control the well. For example, in situ fracturing behavior and kerogen maturation are estimated based on thermal, flow, and compositional data from a set of wells. In another example, well integrity is evaluated based on pressure data, well temperature data, and estimated in situ stresses. In a related embodiment the number of sensors is reduced by equipping only a subset of the wells with instruments, and using the results to interpolate, calculate, or estimate conditions at uninstrumented wells. Certain wells may have only a limited set of sensors (e.g., wellhead temperature and pressure only) where others have a much larger set of sensors (e.g., wellhead temperature and pressure, bottomhole temperature and pressure, production composition, flow rate, electrical signature, casing strain, etc.).

As noted above, there are various methods for applying heat to an organic-rich rock formation. For example, one method may include electrical resistance heaters disposed in a wellbore or outside of a wellbore. One such method involves the use of electrical resistive heating elements in a cased or uncased wellbore. Electrical resistance heating involves directly passing electricity through a conductive material such that resistive losses cause it to heat the conductive material. Other heating methods include the use of downhole combustors, in situ combustion, radio-frequency (RF) electrical energy, or microwave energy. Still others include injecting a hot fluid into the oil shale formation to directly heat it. The hot fluid may or may not be circulated.

One method for formation heating involves the use of electrical resistors in which an electrical current is passed through a resistive material which dissipates the electrical energy as heat. This method is distinguished from dielectric heating in which a high-frequency oscillating electric current induces electrical currents in nearby materials and causes them to heat. The electric heater may include an insulated conductor, an elongated member disposed in the opening, and/or a conductor disposed in a conduit. An early patent disclosing the use of electrical resistance heaters to produce oil shale in situ is U.S. Pat. No. 1,666,488. The '488 patent issued to Crawshaw in 1928. Since 1928, various designs for downhole electrical heaters have been proposed. Illustrative designs are presented in U.S. Pat. No. 1,701,884, U.S. Pat. No. 3,376,403, U.S. Pat. No. 4,626,665, U.S. Pat. No. 4,704,514, and U.S. Pat. No. 6,023,554).

A review of application of electrical heating methods for heavy oil reservoirs is given by R. Sierra and S. M. Farouq Ali, "Promising Progress in Field Application of Reservoir Electrical Heating Methods", Society of Petroleum Engineers Paper 69709, 2001. The entire disclosure of this reference is hereby incorporated by reference.

Certain previous designs for in situ electrical resistance heaters utilized solid, continuous heating elements (e.g., metal wires or strips). However, such elements may lack the necessary robustness for long-term, high temperature applications such as oil shale maturation. As the formation heats and the oil shale matures, significant expansion of the rock occurs. This leads to high stresses on wells intersecting the formation. These stresses can lead to bending and stretching of the wellbore pipe and internal components. Cementing (e.g., U.S. Pat. No. 4,886,118) or packing (e.g., U.S. Pat. No. 2,732,195) a heating element in place may provide some protection against stresses, but some stresses may still be transmitted to the heating element.

Although the above processes are applied in these examples to generate hydrocarbons from oil shale, the idea may also be applicable to heavy oil reservoirs, tar sands, or gas hydrates. In these instances, the electrical heat supplied would serve to reduce hydrocarbon viscosity or to melt hydrates. U.S. Pat. No. 6,148,911 discusses the use of an electrically conductive proppant to release gas from a hydrate formation. It is also known to apply a voltage across a formation using brine as the electrical conductor and heating element. However, it is believed that the use of formation brine as a heating element is inadequate for shale conversion as it is limited to temperatures below the in situ boiling point of water. Thus, the circuit fails when the water vaporizes.

The purpose for heating the organic-rich rock formation is to pyrolyze at least a portion of the solid formation hydrocarbons to create hydrocarbon fluids. The solid formation hydrocarbons may be pyrolyzed in situ by raising the organic-rich rock formation, (or zones within the formation), to a pyrolyzation temperature. In certain embodiments, the temperature of the formation may be slowly raised through the pyrolysis temperature range. For example, an in situ conversion process may include heating at least a portion of the organic-rich rock formation to raise the average temperature of the zone above about 270° C. at a rate less than a selected amount (e.g., about 10° C., 5° C.; 3° C., 1° C., 0.5° C., or 0.1° C.) per day. In a further embodiment, the portion may be heated such that an average temperature of the selected zone may be less than about 375° C. or, in some embodiments, less than about 400° C. The formation may be heated such that a temperature within the formation reaches (at least) an initial pyrolyzation temperature, that is, a temperature at the lower end of the temperature range where pyrolyzation begins to occur.

The pyrolysis temperature range may vary depending on the types of formation hydrocarbons within the formation, the heating methodology, and the distribution of heating sources. For example, a pyrolysis temperature range may include temperatures between about 270° C. and about 900° C. Alternatively, the bulk of the target zone of the formation may be heated to between 300° to 600° C. In an alternative embodiment, a pyrolysis temperature range may include temperatures between about 270° C. to about 500° C.

Preferably, for in situ processes the heating of a production zone takes place over a period of months, or even four or more years. Alternatively, the formation may be heated for one to fifteen years, alternatively, 3 to 10 years, 1.5 to 7 years, or 2 to 5 years. The bulk of the target zone of the formation may be heated to between 270° to 800° C. Preferably, the bulk of the target zone of the formation is heated to between 300° to 600° C. Alternatively, the bulk of the target zone is ultimately heated to a temperature below 400° C. (752° F.).

In the production of oil and gas resources, it may be desirable to use the produced hydrocarbons as a source of power for ongoing operations. This may be applied to the development of oil and gas resources from oil shale. In this respect, when electrically resistive heaters are used in connection with in situ shale oil recovery, large amounts of power are required.

Electrical power may be obtained from turbines that turn generators. It may be economically advantageous to power the gas turbines by utilizing produced gas from the field. However, such produced gas must be carefully controlled so not to damage the turbine, cause the turbine to misfire, or generate excessive pollutants (e.g., $NO_x$).

One source of problems for gas turbines is the presence of contaminants within the fuel. Contaminants include solids, water, heavy components present as liquids, and hydrogen sulfide. Additionally, the combustion behavior of the fuel is important. Combustion parameters to consider include heating value, specific gravity, adiabatic flame temperature, flammability limits, autoignition temperature, autoignition delay time, and flame velocity. Wobbe Index (WI) is often used as a key measure of fuel quality. WI is equal to the ratio of the lower heating value to the square root of the gas specific gravity. Control of the fuel's Wobbe Index to a target value and range of, for example, ±10% or ±20% can allow simplified turbine design and increased optimization of performance.

Fuel quality control may be useful for shale oil developments where the produced gas composition may change over the life of the field and where the gas typically has significant amounts of $CO_2$, CO, and $H_2$ in addition to light hydrocarbons. Commercial scale oil shale retorting is expected to produce a gas composition that changes with time.

Inert gases in the turbine fuel can increase power generation by increasing mass flow while maintaining a flame temperature in a desirable range. Moreover inert gases can lower flame temperature and thus reduce $NO_x$ pollutant generation. Gas generated from oil shale maturation may have significant $CO_2$ content. Therefore, in certain embodiments of the production processes, the $CO_2$ content of the fuel gas is adjusted via separation or addition in the surface facilities to optimize turbine performance.

Achieving a certain hydrogen content for low-BTU fuels may also be desirable to achieve appropriate burn properties. In certain embodiments of the processes herein, the $H_2$ content of the fuel gas is adjusted via separation or addition in the surface facilities to optimize turbine performance. Adjustment of $H_2$ content in non-shale oil surface facilities utilizing low BTU fuels has been discussed in the patent literature (e.g., U.S. Pat. No. 6,684,644 and U.S. Pat. No. 6,858,049, the entire disclosures of which are hereby incorporated by reference).

As noted, the process of heating formation hydrocarbons within an organic-rich rock formation, for example, by pyrolysis, may generate fluids. The heat-generated fluids may include water which is vaporized within the formation. In addition, the action of heating kerogen produces pyrolysis fluids which tend to expand upon heating. The produced pyrolysis fluids may include not only water, but also, for example, hydrocarbons, oxides of carbon, ammonia, molecular nitrogen, and molecular hydrogen. Therefore, as temperatures within a heated portion of the formation increase, a pressure within the heated portion may also increase as a result of increased fluid generation, molecular expansion, and vaporization of water. Thus, some corollary exists between subsurface pressure in an oil shale formation and the fluid pressure generated during pyrolysis. This, in turn, indicates that formation pressure may be monitored to detect the progress of a kerogen conversion process.

The pressure within a heated portion of an organic-rich rock formation depends on other reservoir characteristics. These may include, for example, formation depth, distance from a heater well, a richness of the formation hydrocarbons within the organic-rich rock formation, the degree of heating, and/or a distance from a producer well.

It may be desirable for the developer of an oil shale field to monitor formation pressure during development. Pressure within a formation may be determined at a number of different locations. Such locations may include, but may not be limited to, at a wellhead and at varying depths within a wellbore. In some embodiments, pressure may be measured at a producer well. In an alternate embodiment, pressure may be measured at a heater well. In still another embodiment, pressure may be measured downhole of a dedicated monitoring well.

The process of heating an organic-rich rock formation to a pyrolysis temperature range not only will increase formation pressure, but will also increase formation permeability. The pyrolysis temperature range should be reached before substantial permeability has been generated within the organic-rich rock formation. An initial lack of permeability may prevent the transport of generated fluids from a pyrolysis zone within the formation. In this manner, as heat is initially transferred from a heater well to an organic-rich rock formation, a fluid pressure within the organic-rich rock formation may increase proximate to that heater well. Such an increase in fluid pressure may be caused by, for example, the generation of fluids during pyrolysis of at least some formation hydrocarbons in the formation.

Alternatively, pressure generated by expansion of pyrolysis fluids or other fluids generated in the formation may be allowed to increase. This assumes that an open path to a production well or other pressure sink does not yet exist in the formation. In one aspect, a fluid pressure may be allowed to increase to or above a lithostatic stress. In this instance, fractures in the hydrocarbon containing formation may form when the fluid pressure equals or exceeds the lithostatic stress. For example, fractures may form from a heater well to a production well. The generation of fractures within the heated portion may reduce pressure within the portion due to the production of produced fluids through a production well.

Once pyrolysis has begun within an organic-rich rock formation, fluid pressure may vary depending upon various factors. These include, for example, thermal expansion of hydrocarbons, generation of pyrolysis fluids, rate of conversion, and withdrawal of generated fluids from the formation. For example, as fluids are generated within the formation, fluid pressure within the pores may increase. Removal of generated fluids from the formation may then decrease the fluid pressure within the near wellbore region of the formation.

In certain embodiments, a mass of at least a portion of an organic-rich rock formation may be reduced due, for example, to pyrolysis of formation hydrocarbons and the production of hydrocarbon fluids from the formation. As such, the permeability and porosity of at least a portion of the formation may increase. Any in situ method that effectively produces oil and gas from oil shale will create permeability in what was originally a very low permeability rock. The extent to which this will occur is illustrated by the large amount of expansion that must be accommodated if fluids generated from kerogen are unable to flow. The concept is illustrated in FIG. 5.

Figure 5:
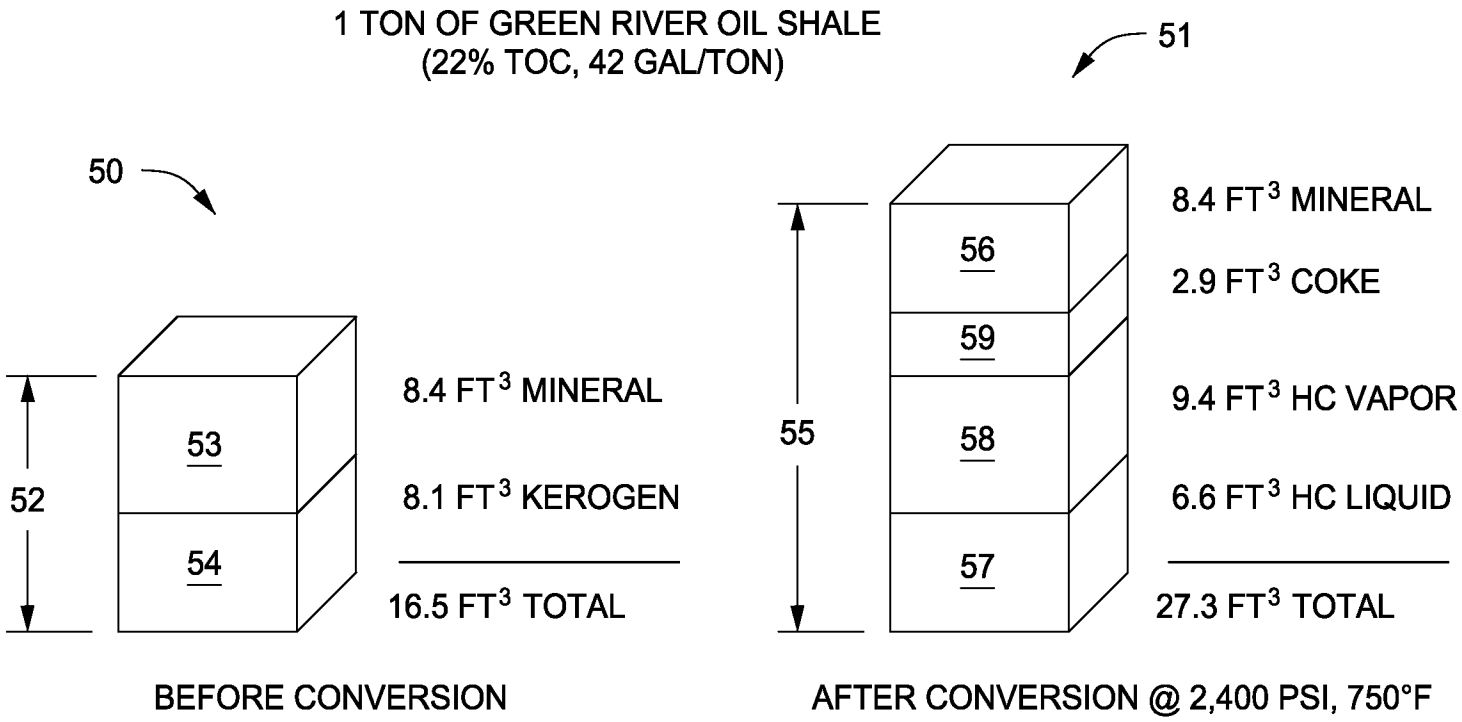
FIG. 5 is a bar chart comparing one ton of Green River oil shale before and after a simulated in situ, retorting process.

FIG. 5 provides a bar chart comparing one ton of Green River oil shale before 50 and after 51 a simulated in situ, retorting process. The simulated process was carried out at 2,400 psi and 750° F. (about 400° C.) on oil shale having a total organic carbon content of 22 wt. % and a Fisher assay of 42 gallons/ton. Before the conversion, a total of 16.5 $ft^3$ of rock matrix 52 existed. This matrix comprised 8.4 $ft^3$ of mineral 53, i.e., dolomite, limestone, etc., and 8.1 $ft^3$ of kerogen 54 imbedded within the shale. As a result of the conversion the material expanded to 27.3 $ft^3$ 55. This represented 8.4 $ft^3$ of mineral 56 (the same number as before the conversion), 6.6 $ft^3$ of hydrocarbon liquid 57, 9.4 $ft^3$ of hydrocarbon vapor 58, and 2.9 $ft^3$ of coke 59. It can be seen that substantial volume expansion occurred during the conversion process. This, in turn, increases permeability of the rock structure.

Figure 6:
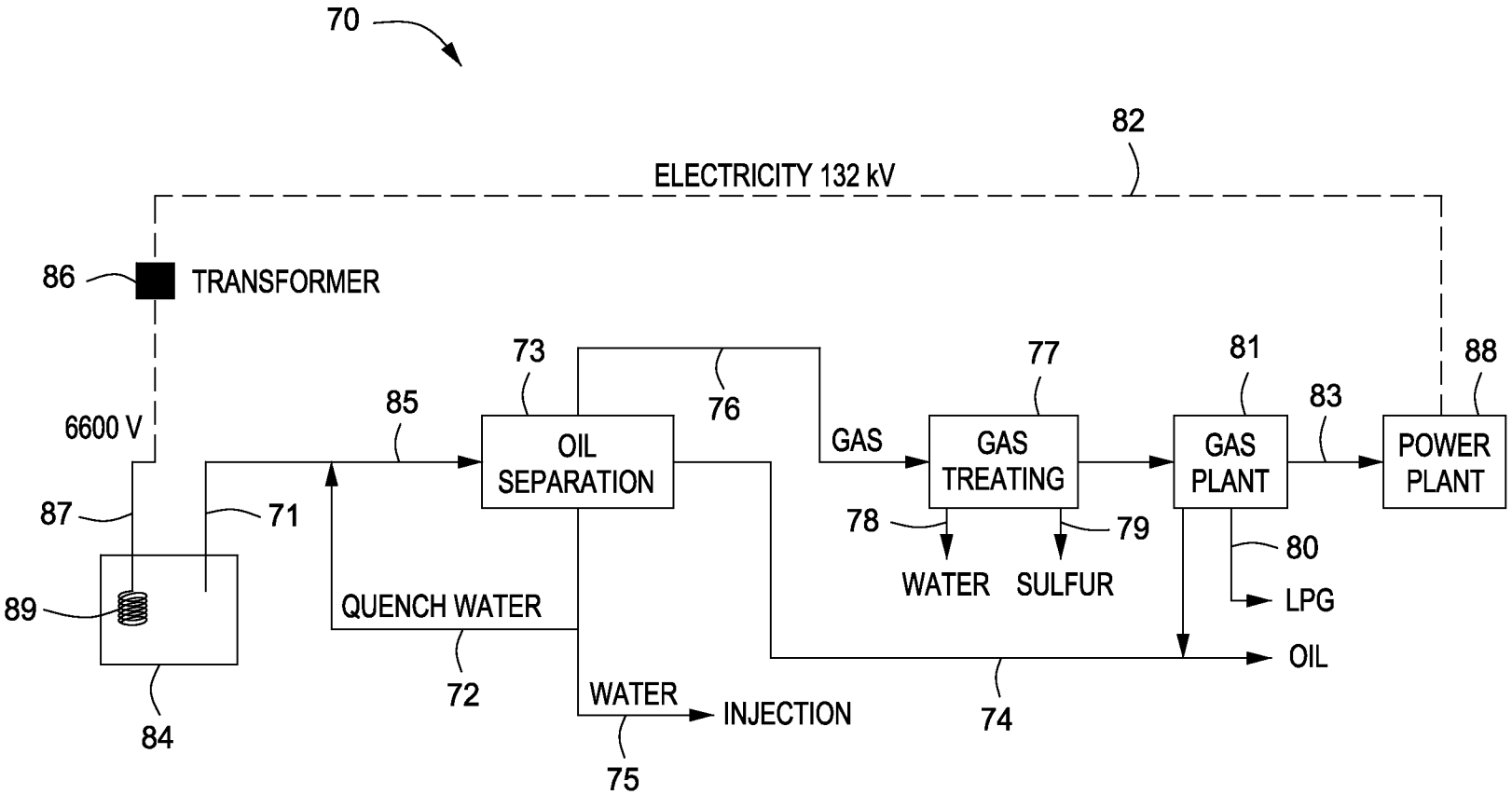
FIG. 6 is a process flow diagram of exemplary surface processing facilities for a subsurface formation development.

FIG. 6 illustrates a schematic diagram of an embodiment of surface facilities 70 that may be configured to treat a produced fluid. The produced fluid 85 produced from a subsurface formation, shown schematically at 84, though a production well 71. The produced fluid 85 may include any of the produced fluids produced by any of the methods as described herein. The subsurface formation 84 may be any subsurface formation including, for example, an organic-rich rock formation containing any of oil shale, coal, or tar sands for example. In the illustrative surface facilities 70, the produced fluids are quenched 72 to a temperature below 300° F., 200° F., or even 100° F. This serves to separate out condensable components (i.e., oil 74 and water 75).

Produced fluids 85 from in situ oil shale production contain a number of components which may be separated in the surface facilities 70. The produced fluids 85 typically contain water 78, noncondensable hydrocarbon alkane species (e.g., methane, ethane, propane, n-butane, isobutane), noncondensable hydrocarbon alkene species (e.g., ethene, propene), condensable hydrocarbon species composed of (alkanes, olefins, aromatics, and polyaromatics among others), $CO_2$, CO, $H_2$, $H_2S$, and $NH_3$. In a surface facility such as facility 70, condensable components 74 may be separated from non-condensable components 76 by reducing temperature and/or increasing pressure. Temperature reduction may be accomplished using heat exchangers cooled by ambient air or available water 72. Alternatively, the hot produced fluids may be cooled via heat exchange with produced hydrocarbon fluids previously cooled. The pressure may be increased via centrifugal or reciprocating compressors. Alternatively, or in conjunction, a diffuser-expander apparatus may be used to condense out liquids from gaseous flows. Separations may involve several stages of cooling and/or pressure changes.

In the arrangement of FIG. 6, the surface facilities 70 include an oil separator 73 for separating liquids, or oil 74, from hydrocarbon vapors, or gas 76. The noncondensable vapor components 76 are treated in a gas treating unit 77 to remove water 78 and sulfur species 79. Heavier components are removed from the gas (e.g., propane and butanes) in a gas plant 81 to form liquid petroleum gas (LPG) 80. The LPG 80 may be placed into a truck or line for sale. Water 78 in addition to condensable hydrocarbons 74 may be dropped out of the gas 76 when reducing temperature or increasing pressure. Liquid water may be separated from condensable hydrocarbons 74 via gravity settling vessels or centrifugal separators. Demulsifiers may be used to aid in water separation.

The surface facilities also operate to generate electrical power 82 in a power plant 88 from the remaining gas 83. The electrical power 82 may be used as an energy source for heating the subsurface formation 84 through any of the methods described herein. For example, the electrical power 82 may be fed at a high voltage, for example 132 kV, to a transformer 86 and let down to a lower voltage, for example 6600 V, before being fed to an electrical resistance heater element 89 located in a heater well 87 in the subsurface formation 84. In this way all or a portion of the power required to heat the subsurface formation 84 may be generated from the non-condensable portion 76 of the produced fluids 85. Excess gas, if available, may be exported for sale.

In an embodiment, heating a portion of an organic-rich rock formation in situ to a pyrolysis temperature may increase permeability of the heated portion. For example, permeability may increase due to formation of thermal fractures within the heated portion caused by application of heat. As the temperature of the heated portion increases, water may be removed due to vaporization. The vaporized water may escape and/or be removed from the formation. In addition, permeability of the heated portion may also increase as a result of production of hydrocarbon fluids from pyrolysis of at least some of the formation hydrocarbons within the heated portion on a macroscopic scale.

Certain systems and methods described herein may be used to treat formation hydrocarbons in at least a portion of a relatively low permeability formation (e.g., in "tight" formations that contain formation hydrocarbons). Such formation hydrocarbons may be heated to pyrolyze at least some of the formation hydrocarbons in a selected zone of the formation. Heating may also increase the permeability of at least a portion of the selected zone. Hydrocarbon fluids generated from pyrolysis may be produced from the formation, thereby further increasing the formation permeability.

Permeability of a selected zone within the heated portion of the organic-rich rock formation may also rapidly increase while the selected zone is heated by conduction. For example, permeability of an impermeable organic-rich rock formation may be less than about 0.1 millidarcy before heating. In some embodiments, pyrolyzing at least a portion of organic-rich rock formation may increase permeability within a selected zone of the portion to greater than about 10 millidarcies, 100 millidarcies, 1 Darcy, 10 Darcies, 20 Darcies, or 50 Darcies. Therefore, a permeability of a selected zone of the portion may increase by a factor of more than about 10, 100, 1,000, 10,000, or 100,000. In one embodiment, the organic-rich rock formation has an initial total permeability less than 1 millidarcy, alternatively less than 0.1 or 0.01 millidarcies, before heating the organic-rich rock formation. In one embodiment, the organic-rich rock formation has a post heating total permeability of greater than 1 millidarcy, alternatively, greater than 10, 50 or 100 millidarcies, after heating the organic-rich rock formation.

In connection with the production of hydrocarbons from a rock matrix, particularly those of shallow depth, a concern may exist with respect to earth subsidence. This is particularly true in the in situ heating of organic-rich rock where a portion of the matrix itself is thermally converted and removed. Initially, the formation may contain formation hydrocarbons in solid form, such as, for example, kerogen. The formation may also initially contain water-soluble minerals. Initially, the formation may also be substantially impermeable to fluid flow.

The in situ heating of the matrix pyrolyzes at least a portion of the formation hydrocarbons to create hydrocarbon fluids. This, in turn, creates permeability within a matured (pyrolyzed) organic-rich rock zone in the organic-rich rock formation. The combination of pyrolyzation and increased permeability permits hydrocarbon fluids to be produced from the formation. At the same time, the loss of supporting matrix material also creates the potential for subsidence relative to the earth surface.

In some instances, subsidence is sought to be minimized in order to avoid environmental or hydrogeological impact. In this respect, changing the contour and relief of the earth surface, even by a few inches, can change runoff patterns, affect vegetation patterns, and impact watersheds. In addition, subsidence has the potential of damaging production or heater wells formed in a production area. Such subsidence can create damaging hoop and compressional stresses on wellbore casings, cement jobs, and equipment downhole.

In order to avoid or minimize subsidence, it is proposed to leave selected portions of the formation hydrocarbons substantially unpyrolyzed. This serves to preserve one or more unmatured, organic-rich rock zones. In some embodiments, the unmatured organic-rich rock zones may be shaped as substantially vertical pillars extending through a substantial portion of the thickness of the organic-rich rock formation.

The heating rate and distribution of heat within the formation may be designed and implemented to leave sufficient unmatured pillars to prevent subsidence. In one aspect, heat injection wellbores are formed in a pattern such that untreated pillars of oil shale are left therebetween to support the overburden and prevent subsidence.

In some embodiments, compositions and properties of the hydrocarbon fluids produced by an in situ conversion process may vary depending on, for example, conditions within an organic-rich rock formation. Controlling heat and/or heating rates of a selected section in an organic-rich rock formation may increase or decrease production of selected produced fluids.

In one embodiment, operating conditions may be determined by measuring at least one property of the organic-rich rock formation. The measured properties may be input into a computer executable program. At least one property of the produced fluids selected to be produced from the formation may also be input into the computer executable program. The program may be operable to determine a set of operating conditions from at least the one or more measured properties. The program may also be configured to determine the set of operating conditions from at least one property of the selected produced fluids. In this manner, the determined set of operating conditions may be configured to increase production of selected produced fluids from the formation.

Certain heater well embodiments may include an operating system that is coupled to any of the heater wells such as by insulated conductors or other types of wiring. The operating system may be configured to interface with the heater well. The operating system may receive a signal (e.g., an electromagnetic signal) from a heater that is representative of a temperature distribution of the heater well. Additionally, the operating system may be further configured to control the heater well, either locally or remotely. For example, the operating system may alter a temperature of the heater well by altering a parameter of equipment coupled to the heater well. Therefore, the operating system may monitor, alter, and/or control the heating of at least a portion of the formation.

In some embodiments, a heater well may be turned down and/or off after an average temperature in a formation may have reached a selected temperature. Turning down and/or off the heater well may reduce input energy costs, substantially inhibit overheating of the formation, and allow heat to substantially transfer into colder regions of the formation.

Temperature (and average temperatures) within a heated organic-rich rock formation may vary, depending on, for example, proximity to a heater well, thermal conductivity and thermal diffusivity of the formation, type of reaction occurring, type of formation hydrocarbon, and the presence of water within the organic-rich rock formation. At points in the field where monitoring wells are established, temperature measurements may be taken directly in the wellbore. Further, at heater wells the temperature of the immediately surrounding formation is fairly well understood. However, it is desirable to interpolate temperatures to points in the formation intermediate temperature sensors and heater wells.

In accordance with one aspect of the production processes of the present descriptions, a temperature distribution within the organic-rich rock formation may be computed using a numerical simulation model. The numerical simulation model may calculate a subsurface temperature distribution through interpolation of known data points and assumptions of formation conductivity. In addition, the numerical simulation model may be used to determine other properties of the formation under the assessed temperature distribution. For example, the various properties of the formation may include, but are not limited to, permeability of the formation.

The numerical simulation model may also include assessing various properties of a fluid formed within an organic-rich rock formation under the assessed temperature distribution. For example, the various properties of a formed fluid may include, but are not limited to, a cumulative volume of a fluid formed in the formation, fluid viscosity, fluid density, and a composition of the fluid formed in the formation. Such a simulation may be used to assess the performance of a commercial-scale operation or small-scale field experiment. For example, a performance of a commercial-scale development may be assessed based on, but not limited to, a total volume of product that may be produced from a research-scale operation.

In the present disclosure, methods for heating a subsurface formation using electrical resistance heating are provided. The resistive heat is generated primarily from electrically conductive material injected into the formation from wellbores. An electrical current is then passed through the conductive material so that electrical energy is converted to thermal energy. The thermal energy is transported to the formation by thermal conduction to heat the organic-rich rocks.

In one preferred embodiment of the current disclosure, conductive granular material is used as a downhole heating element. The granular heating element is able to withstand geomechanical stresses created during the formation heating process. In this respect, the granular material can readily change shape as needed without losing electrical connectivity. Thus, methods are provided herein for applying heat to a subsurface formation wherein a granular material provides a resistively conductive pathway between electrically conductive members within adjacent wellbores. However, non-granular conductive material such as conductive liquids that gel in place may be used.

Figure 7:
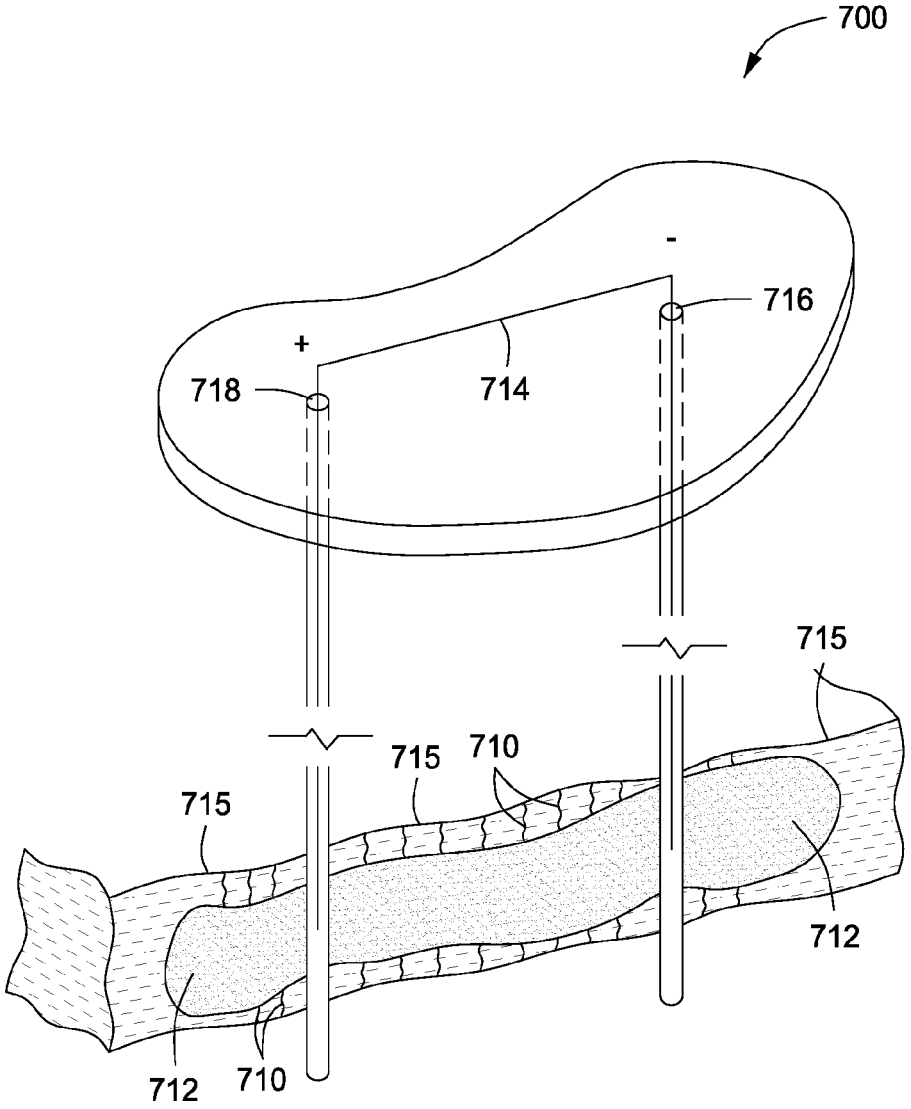
FIG. 7 is a perspective view of a hydrocarbon development area. A subsurface formation is being heated via resistive heating. A mass of conductive granular material has been injected into the formation between two adjacent wellbores.

FIG. 7 is a perspective view of a hydrocarbon production area 700. The hydrocarbon production area 700 includes a subsurface formation 715. The subsurface formation 715 comprises organic-rich rock. In one instance the organic-rich rock contains kerogen.

A substantially vertical fracture 712 has been created within the subsurface formation 715. The fracture 712 is preferably hydraulically formed. The fracture 712 is propped with particles of an electrically conductive material (not shown in FIG. 7). In accordance with the methods herein, an electrical current is sent through the conductive material to generate resistive heat within the formation 715.

FIG. 7 demonstrates the heat 710 emanating from the fracture 712. In order to provide electrical current and generate the heat 710, a voltage 714 is applied across two adjacent wells 716 and 718. The fracture 712 intersects the wells 716, 718 so that current travels from a first well (such as well 716), through fracture 712, and to a second well (such as well 718).

Various ways of running current through the fracture 712 may be arranged. In the arrangement of FIG. 7, an AC voltage 714 is preferred. This is because AC voltage is more readily generated and minimizes electrochemical corrosion as compared to DC voltage. However, any form of electrical energy, including without limitation, DC voltage, is suitable for use in the methods herein.

In the example of FIG. 7, a negative pole is set up at wellbore 716 while a positive pole is set up at wellbore 718. Each wellbore 716, 718 has a conductive member that runs to the subsurface formation 715 to deliver current. An amount of electrical current sufficient to generate heat necessary to cause pyrolysis of solid hydrocarbons is provided. Kinetic parameters for Green River oil shale, for example, indicate that for a heating rate of 100° C. (180° F.) per year, complete kerogen conversion will occur at a temperature of about 324° C. (615° F.). Fifty percent conversion will occur at a temperature of about 291° C. (555° F.). Oil shale near the fracture will be heated to conversion temperatures within months, but it is likely to require several years to attain thermal penetration depths required for generation of economic reserves across a subsurface volume.

Within the fracture 712, the granular material acts as a heating element. As electric current is passed through the fracture 712, heat 710 is generated by resistive heating. Heat 710 is transferred by thermal conduction to the formation 715 surrounding the fracture 712. As a result, the organic-rich rock within the formation 715 is heated sufficiently to convert kerogen to hydrocarbons. The generated hydrocarbons are then produced using well-known production methods.

In the arrangement of FIG. 7, the formation 715 is shown primarily along a single vertical plane. Further, the heat 710 is shown emanating from the fracture 712 within that vertical plane. However, it is understood that the formation 715 is a three-dimensional subsurface volume, and that the heat 710 will conduct across a portion of that volume.

As described above, FIG. 7 depicts a heating process using a single vertical hydraulic fracture 712 and a pair of vertical wells 716, 718. In practice, a number of wellbore pairs 716, 718 would be completed with an intersecting fracture 712. However, other wellbore and completion arrangements may be provided. Examples include the use of horizontal wells and/or horizontal fractures. Commercial applications may involve multiple fractures with the placement of multiple wells in a pattern or line-drive formation.

During the thermal conversion process, oil shale permeability is likely to increase. This may be caused by the increased pore volume available for flow as solid kerogen is converted to liquid or gaseous hydrocarbons. Alternatively, increased permeability may result from the formation of fractures as kerogen converts to hydrocarbons and undergoes a substantial volume increase within a confined system. In this respect, if initial permeability is too low to allow release of the hydrocarbons, excess pore pressure will eventually cause fractures to develop. These are in addition to the hydraulic fractures initially formed during completion of the wellbores 716, 718.

Figure 8A:
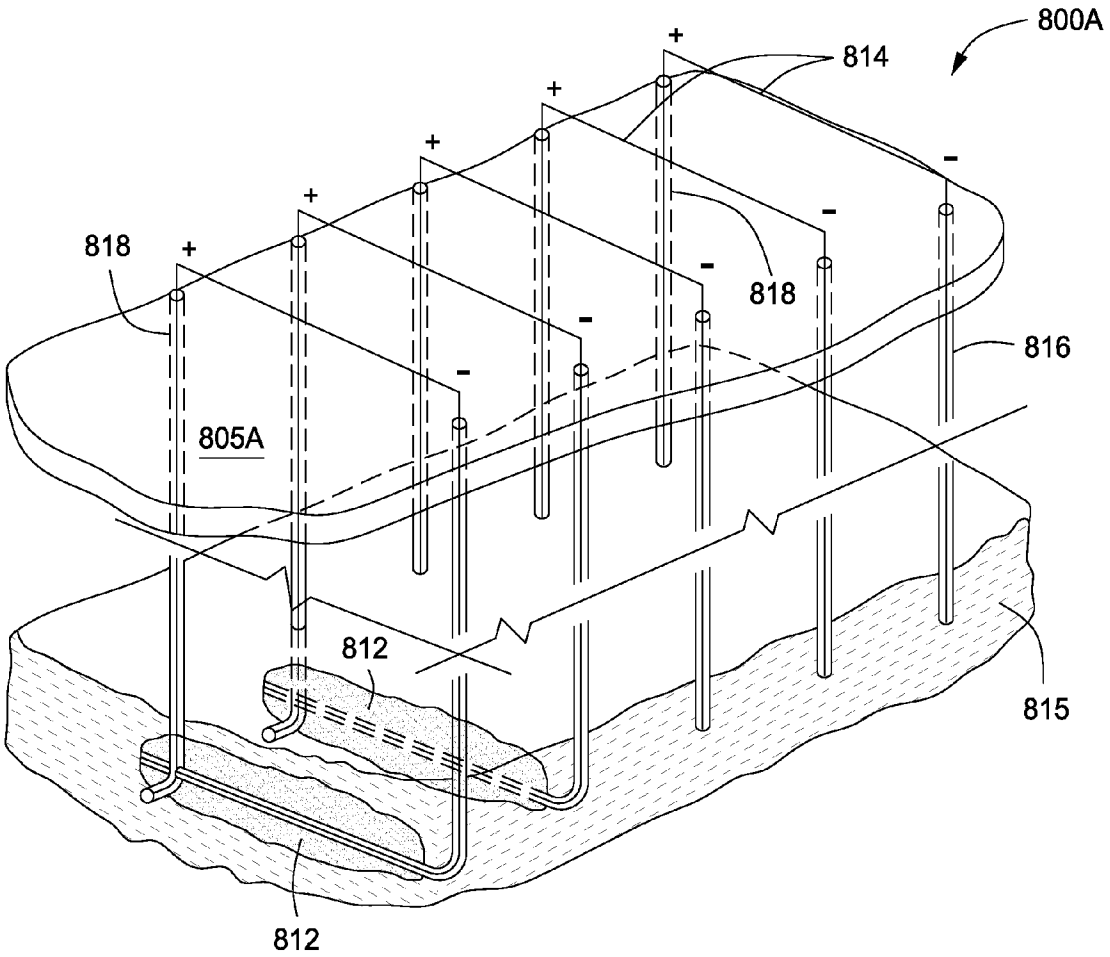
FIG. 8A is a perspective view of another hydrocarbon development area. A subsurface formation is once again being heated via resistive heating. A mass of conductive granular material has been injected into the formation from a plurality of horizontally completed wellbores. Corresponding wellbores are completed horizontally through the individual masses of conductive granular material.
Figure 8B:
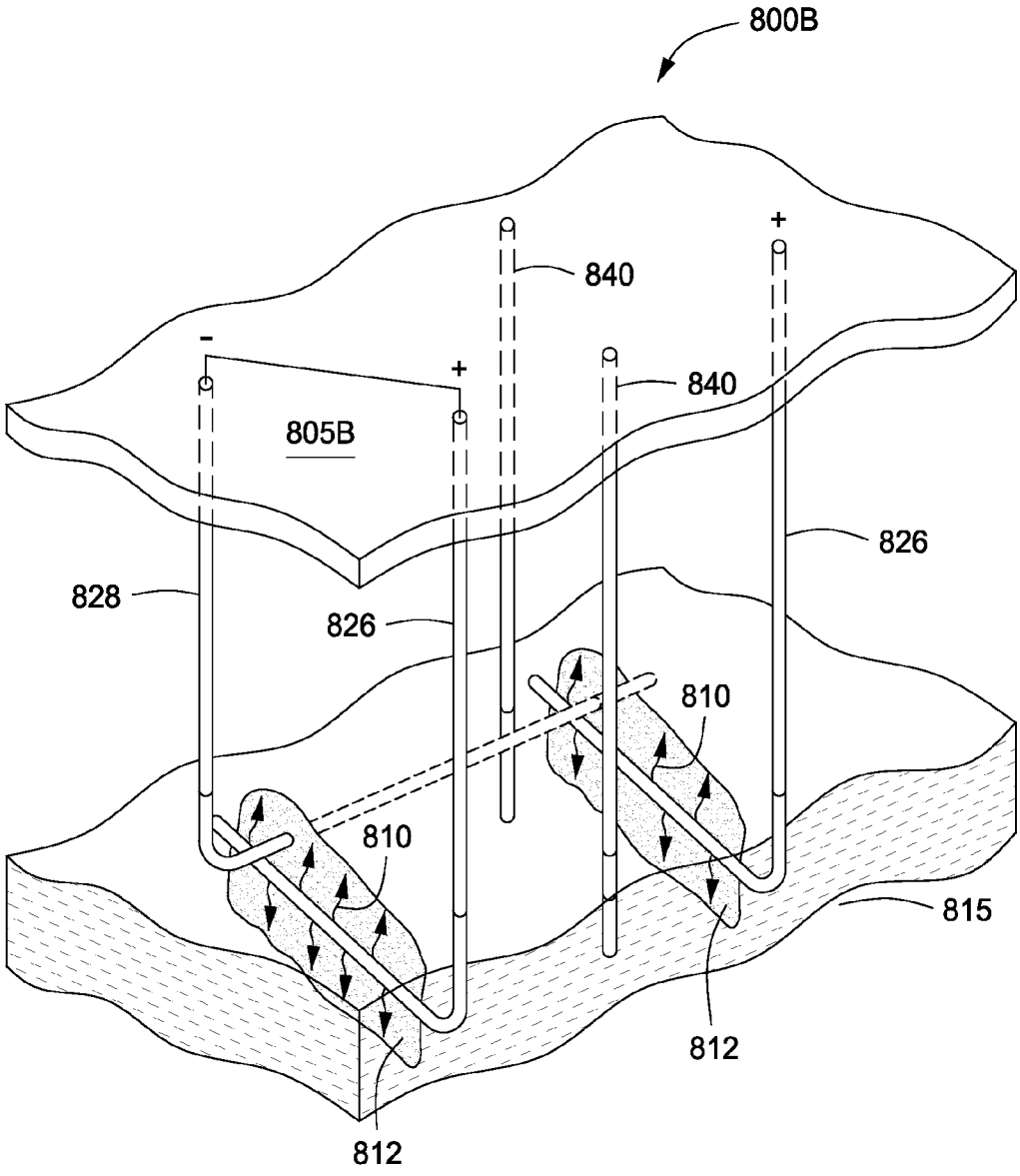
FIG. 8B is yet another perspective view of a hydrocarbon development area. A subsurface formation is once again being heated via resistive heating. A mass of conductive granular material has been injected into the formation from a pair of horizontally completed wellbores. A third wellbore is completed horizontally through the masses of conductive granular material.

Referring now to FIGS. 8A and 8B, alternate arrangements 800A, 800B for heating a subsurface formation are illustrated. First, FIG. 8A shows a hydrocarbon production area 805A that includes a subsurface formation 815. The subsurface formation 815 comprises organic-rich rock. An example of such an organic-rich rock is oil shale.

In the arrangement of FIG. 8A, a first plurality of wellbores 816 is provided. Each wellbore 816 has a vertical portion and a deviated, substantially horizontal portion. Heat is once again delivered via a plurality of hydraulic fractures propped with particles of an electrically conductive material. The fractures are shown at 812 and are substantially vertical. Each hydraulic fracture 812 is longitudinal (or runs along) the horizontal portion of the wells 816.

A separate second plurality of wells 818 is also provided in the hydrocarbon production area 800A. These wells 818 also have a substantially vertical portion and a substantially horizontal portion. The substantially horizontal portions of the respective wells 818 intersect respective fractures 812.

In the arrangement of FIG. 8A, a voltage is applied across pairs of wells from the first plurality 816 and the second plurality 818 of wells. The wells 816 in the first plurality of wells comprise negative poles while the wells 818 in the second plurality of wells comprise positive poles. Of course, the reverse could also be established. A voltage 814 is applied across respective wells 816, 818 that penetrate the fractures 812. Once again, an AC voltage 814 is preferred. However, any form of electrical energy, including without limitation, DC voltage, is suitable for use in this description.

The pairs of wells from the respective pluralities of wells 816, 818 make up individual electrical circuits. The circuits are "completed" by placing conductive granular material within the fractures 812. This, in turn, generates heat via resistive heating. This heat is transferred by thermal conduction to organic-rich rock within the subsurface formation 815. As a result, the organic-rich rock is heated sufficiently to convert kerogen contained in the subsurface formation 815 to hydrocarbons. The generated hydrocarbons are then produced through production wells (not shown).

It is noted that the fractures 812 in FIG. 8A are vertical. Reciprocally, the intersecting portion of the second plurality of wellbores 818 is horizontal. However, it is understood that this arrangement could be reversed. This means that the fractures 812 may be horizontal while the intersecting portion of the second plurality of wellbores 818 is vertical. In this latter arrangement it would not be necessary for the second plurality of wellbores 818 to be deviated. As a practical matter, the orientation of the fractures may be dependent on the depth of the subsurface formation. For example, some Green River oil shale formations completed at or above 1,000 feet tend to create horizontal fractures while formations completed below about 1,000 feet tend to create vertical fractures. This, of course, is highly dependent on the actual location and the geomechanical forces at work.

FIG. 8B shows a second hydrocarbon production area 805B that includes a subsurface formation 815. The subsurface formation 815 comprises organic-rich rock which may include kerogen. In the arrangement of FIG. 8B, a first plurality of wellbores 826 is provided. Each wellbore 826 has a vertical portion and a deviated, substantially horizontal portion. Heat is once again delivered via a plurality of hydraulic fractures propped with particles of an electrically conductive material. The fractures are shown at 812 and are substantially vertical. Each hydraulic fracture 812 is longitudinal (or runs along) the horizontal portion of the wells 826.

A separate second plurality of wells 828 is also provided in the hydrocarbon production area 800B. These wells 818 also have a substantially vertical portion and a substantially horizontal portion. The substantially vertical portions of the respective wells 828 intersect respective fractures 812.

In the arrangement of FIG. 8B, a voltage is applied across the first plurality of wells 826 to one of the second plurality of wells 828. The wells 826 in the first plurality of wells may comprise positive poles while the second well 828 may comprise a negative pole. Of course, the reverse could also be established. A voltage 824 is applied across respective wells 826, 828 that penetrate the fractures 812. Once again, an AC voltage 824 is preferred. However, any form of electrical energy, including without limitation, DC voltage, is suitable for use in this description.

The wells 826, 828 work together to make up individual electrical circuits. The circuits are "completed" by placing conductive granular material within the fractures 812. This, in turn, generates heat via resistive heating. This heat is transferred by thermal conduction to organic-rich rock within the subsurface formation 815. As a result, the organic-rich rock is heated sufficiently to convert kerogen contained in the subsurface formation 815 to hydrocarbons. The generated hydrocarbons are then produced through production wells (not shown).

It is noted that the fractures 812 in FIG. 8B are vertical. Reciprocally, the intersecting portion of the second plurality of wellbores 828 is horizontal. In the production area 800B, the horizontal portion of the second wellbores 828 intersect fractures 812 associated with more than one fracture 812 from more than one horizontal portion of the respective first wellbores 826.

In either of production areas 800A, 800B, various materials may be used as the electrically conductive granular material. First, sands having a thin metal coating may be employed. Second, composite metal and ceramic materials may be used. Third, carbon-based materials may be employed. Each of these examples is not only conductive but also serves as a proppant. Several additional conductive materials may be used which are less desirable as proppants. One example is a conductive cement. Also, green or black silicon carbide, boron carbide, or calcined petroleum coke may be used as a proppant. It is also noted that combinations of the above materials may be utilized. In this respect, the electrically conductive material is not required to be homogeneous, but may comprise a mixture of two or more suitable electrically conductive materials. For example, one or more conductive materials that serve as proppants may be mixed with one or more conductive materials that are non-proppants in order to achieve a desired conductivity while operating within a designated budget.

Regardless of the composition, the conductive material preferably meets several criteria. First, the electrical resistivity of the granular material under anticipated in situ stresses is preferably high enough to provide resistive heating while also being low enough to conduct the planned electric current from one well to another. The granular material also preferably meets the usual criteria for fracture proppants, e.g., sufficient strength to hold the fracture open, and a low enough density to be pumped into the fracture. Lastly, economic application of the process may set an upper limit on the cost of an acceptable granular material.

In each of production areas 800A, 800B, production wells are provided. Illustrative production wells 840 are shown in FIG. 8B. The production wells 840 are completed in the subsurface formation 815 to transport hydrocarbon fluids to the surface.

EXAMPLE

In order to demonstrate the transmission of current through a fracture in an organic-rich rock in order to generate resistive heat, a laboratory test was conducted. Test results showed that resistive heating using granular material successfully transforms kerogen in a laboratory specimen of rock into producible hydrocarbons.

Figure 9:
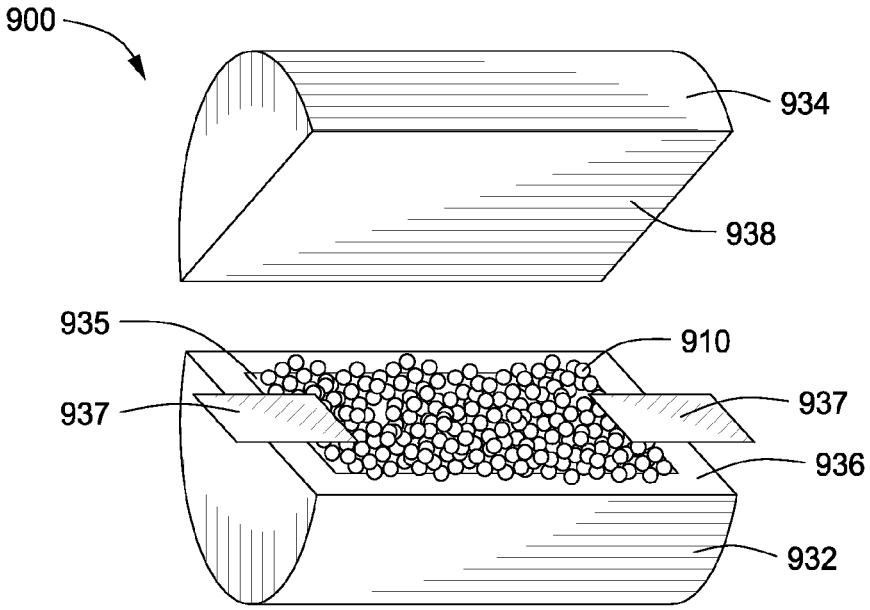
FIG. 9 is a perspective view of a core sample that has been opened along its longitudinal axis. Steel shot has been placed within a "tray" formed internal to the core sample.
Figure 10:
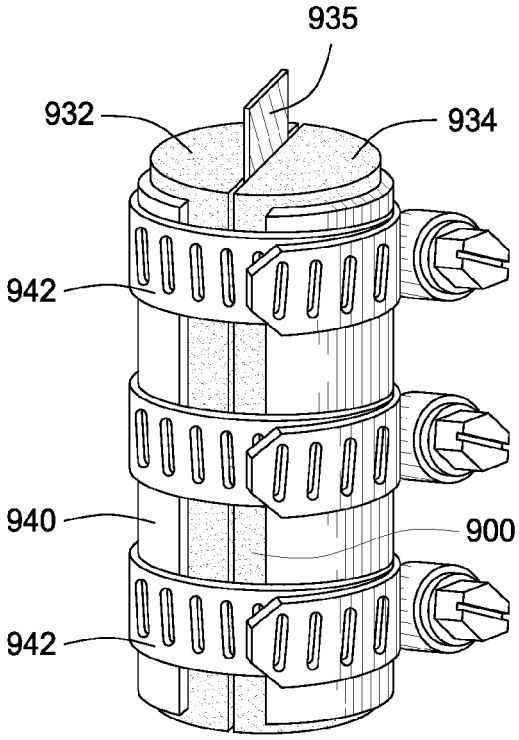
FIG. 10 shows the core sample of FIG. 9 having been closed and clamped for testing. A current is run through the length of the core sample to create resistive heating.

Referring now to FIG. 9 and FIG. 10, a core sample 900 was taken from a kerogen-containing subterranean formation. The core sample 900 was a three-inch long plug of oil shale with a diameter of 1.39 inches. The bedding of the oil shale was perpendicular to the core 900 axis. As illustrated in FIG. 9, core sample 900 was cut into two portions 932 and 934. Upper face 936 lies on portion 932 while lower face 938 corresponds to portion 934.

A tray 935 having a depth of about 0.25 mm (1/16 inch) was milled into sample portion 932 and a proxy proppant material 910 comprising #170 cast steel shot having a diameter of about 0.1 mm (0.02 inch) was placed in the tray 935. As illustrated, a sufficient quantity of conductive proppant material 910 to substantially fill tray 935 was used.

Electrodes 937 were placed at opposing ends of portion 932. The electrodes 937 extend from outside the bounds of the core 900 into contact with proppant material 910.

As shown in FIG. 10, sample portions 932 and 934 were placed in contact as if to reconstruct the core sample 900. The core 900 was then placed in a stainless steel sleeve 940 with portions 932 and 934 being held together with three stainless steel hose clamps 942.

The hose clamps 942 were tightened to apply stress to the proxy proppant (seen in FIG. 9), just as the proppant 910 would be required to support in situ stresses in a real application. The resistance between electrodes 937 was measured at 822 ohms before any electrical current was applied.

A small hole (not shown) was drilled in one half of the sample 900 in order to accommodate a thermocouple. The thermocouple was used to measure the temperature in the core sample 900 during heating. The thermocouple was positioned roughly mid-way between tray 935 and the outer diameter of core sample 900.

The clamped core sample 900 was placed in a pressure vessel (not shown in the Figures) with a glass liner. The purpose of the glass liner was to collect hydrocarbons generated from the heating process. The pressure vessel was equipped with electrical feeds. The pressure vessel was evacuated and charged with Argon at 500 psi to provide a chemically inert atmosphere for the experiment. Electrical current in the range of 18 to 19 amps was applied between electrodes 937 for 5 hours. The thermocouple in core sample 900 measured a temperature of 268° C. after about one hour, and thereafter tapered off to about 250° C. The high temperature reached at the location of tray 935 was inferred to be from about 350° C. to about 400° C.

After the experiment was completed and the core sample 900 had cooled to ambient temperature, the pressure vessel was opened. 0.15 ml of oil was recovered from the bottom of the glass liner in which the experiment was conducted. The core sample 900 was removed from the pressure vessel, and the resistance between electrodes 937 was again measured. This post-experiment resistance measurement was 49 ohms.

Figure 11:
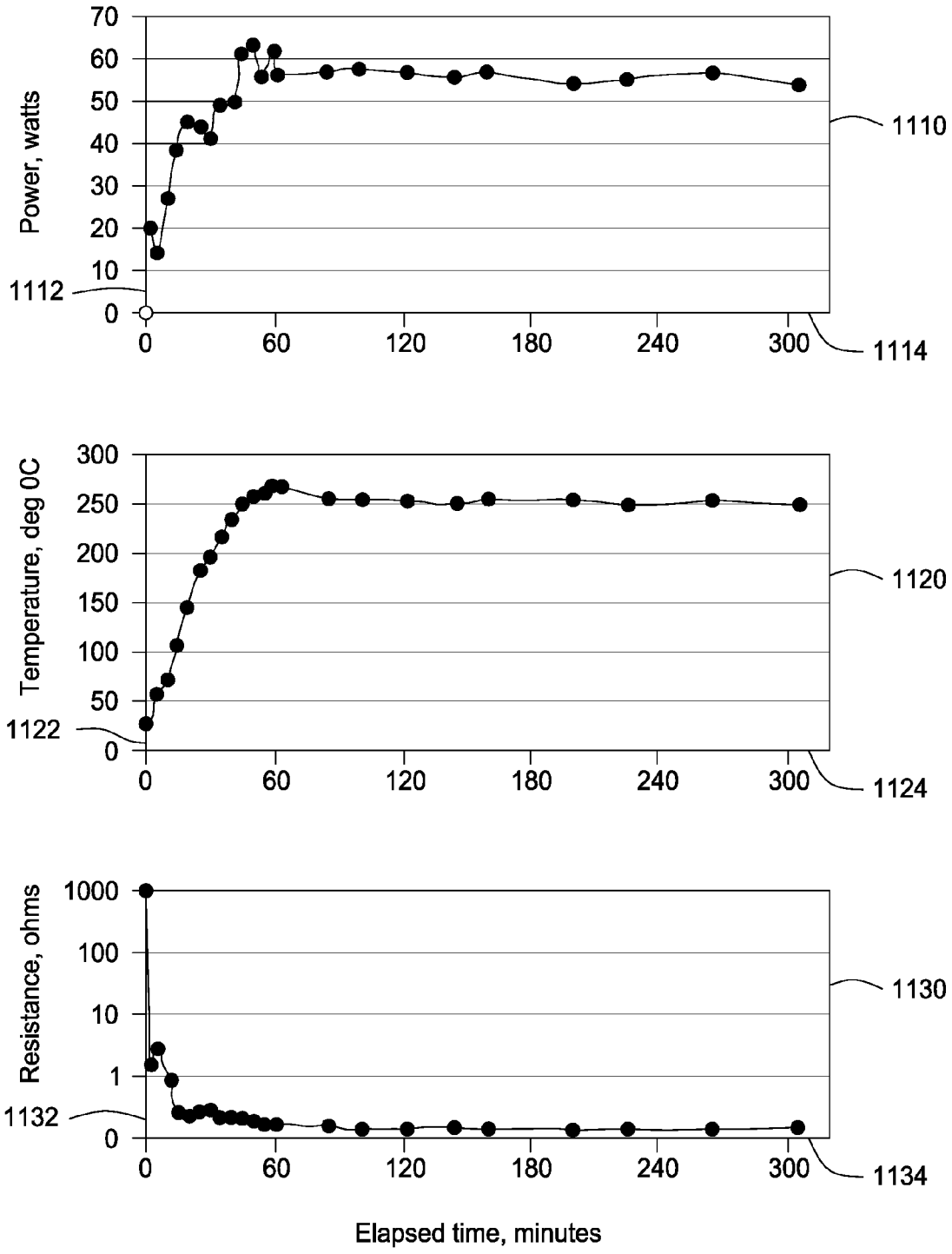
FIG. 11 provides a series of charts wherein power, temperature and resistance are measured as a function of time during the heating of the core sample of FIG. 9.

During the heating period the power consumption, electrical resistance and temperature at the thermocouple embedded in the sample 900 were recorded. FIG. 11 provides graphs showing power consumption 1112, temperature 1122, and electrical resistance 1132 recorded as a function of time.

First, FIG. 11 includes chart 1110. Chart 1110 has ordinate 1112 representing the electrical power, in watts, consumed during the experiment. Chart 1110 also has abscissa 1114, which shows the elapsed time in minutes for the experiment. The total time on the abscissa 1114 was 5 hours (300 minutes). It can be seen from chart 1110 that after one hour, power applied to the core sample 900 ranged between 50 and 60 watts.

Next, FIG. 11 includes chart 1120. Chart 1120 has ordinate 1122 representing the temperature in degrees Celsius measured at the thermocouple in the core sample 900 (FIGS. 9 and 10) throughout the experiment. Chart 1120 also has abscissa 1124 which shows the elapsed time in minutes during the experiment. Again, the total time is 5 hours. It is noted that the temperature 1122 reached a maximum value of 268° C. during the experiment. From this value it can be inferred that the temperature along the tray 935 should have reached a value of 350-400° C. This value is sufficient to cause pyrolysis.

Finally, FIG. 11 includes chart 1130. Chart 1130 has ordinate 1132 representing the resistance in ohms measured between electrodes 937 (FIGS. 9 and 10) during the experiment. Chart 1130 also has abscissa 1134 which again shows the elapsed time in minutes during the experiment. Only resistance measurements made during the heating experiment are included in chart 1130. Of interest, after the initial heat-up of the sample 900, the resistance 1132 remained relatively constant between 0.15 and 0.2 ohms. At no time during the experiment was a loss of electrical continuity observed. The pre-experiment and post-experiment resistance measurements (822 and 49 ohms) are omitted.

After the core sample 900 cooled to ambient temperature, it was removed from the pressure vessel and disassembled. The conductive proppant material 910 was observed to be impregnated in several places with tar-like hydrocarbons or bitumen, which were generated from the oil shale during the experiment. A cross section was taken through a crack that developed in the core sample 900 due to thermal expansion during the experiment. A crescent shaped section of converted oil shale adjacent to the proxy proppant 910 was observed.

Returning now to FIGS. 7, 8A and 8B, connections to the fracture heating element may be implemented in various ways. In each of these arrangements, connection points are provided between conductive metal devices along adjacent wellbores to intermediate conductive granular material within a fracture. Such point connections are made along vertical wellbores (FIG. 7), at the heel of a horizontal wellbore portion (FIG. 8A), at the toe of a horizontal wellbore portion (FIG. 8B).

A concern arises with respect to each of these resistive heater-well completion arrangements 700, 800A, 800B. This concern relates to the potential for very high electric current density in the area where the wellbores intersect the conductive granular material. This concern applies to any of the completion arrangements of FIGS. 7, 8A and 8B.

Electric current is an average quantity that describes the flow of electrons along a flow path. The SI unit for quantity of electricity or electrical charge is the coulomb. The coulomb is defined as the quantity of charge that has passed through the cross-section of an electrical conductor carrying one ampere within one second. The symbol Q is often used to denote a quantity of electricity or charge.

Electric current may have a current density representing the electric current per unit area of cross section. In SI units, this may be expressed as Amperes/$m^2$. A current density vector may be denoted as i and described mathematically:

$$i=nqv_d=Dv_d$$

where i=current density vector (amperes/$m^2$)
n=particle density in count per volume ($m^{-3}$);
q=individual particles' charge (coulombs);
D=charge density (Coulombs/$m^3$), or n q; and
$v_d$=particles' average drift velocity (m/sec).

The presence of excessive current density at electrical contact points downhole may result in an inconsistent heat distribution within a subsurface formation 715 or 815. In this respect, significant heating may occur primarily near the intersection of the wellbores with the granular material, leaving inadequate resistive heating within the remainder of the subsurface formation.

To address this issue, it is proposed herein to place a second type of granular material at or near the contact points downhole. This second type of granular material has an electrical conductivity that is different from the conductive granular material in the bulk of the fracture. Such an arrangement may operate in either of two ways. If the second material has a higher conductivity, it can operate by lowering the voltage drop across a contact point having a high current density. In this instance the high current density still exists but it does not lead to excessive local heat generation. Alternatively, if the second material has a much lower (even zero) conductivity, it can operate by changing the dominant current pathways to eliminate the area of high current density.

It is preferred to employ the first option wherein the second conductive material has a significantly higher conductivity than the conductive material in the bulk of the fracture. Preferably, the conductivity of the second conductive material is about ten to 100 times higher than the conductivity of the granular material. In one aspect, the bulk of a fracture is filled with calcined coke, while the conductive material immediately at the connection point comprises powdered metals, graphite, carbon black, or combinations thereof. Examples of powdered metals include powdered copper and steel.

For example, in an exemplary embodiment of the first option, e.g., where the second conductive material has a significantly higher conductivity than the conductive material in the bulk of the fracture, the present inventors have determined that granular mixtures of graphite with up to 50% by weight cement produce suitable resistivities. The present inventors have determined that mixtures within this compositional range are also 10-100 times more conductive than the granular proppant material. The present inventors have also determined that compositions with cement content above 50% by weight increase mixture resistivity above a preferred resistivity range. Water, which may be added to control the viscosity of the granular mixture, is typically added to the granular mixture to aid in adequate distribution of the conductive material into a proppant filled fracture. The pack thickness of the injected granular material may also be controlled by addition or subtraction of water to the granular mixture, e.g., more water will produce a thinner and more widely dispersed pack upon injection. Accordingly, the present inventors have determined that the granular mixtures within the aforementioned compositional ranges are conductive enough to not generate hot spots if used as the above-described second conductive material.

For example, an exemplary composition for the above-described second conductive material that has been determined to be suitable for use in the vicinity of electrical contact points downhole includes 10 g graphite (75% dry wt.), 3.3 g Portland cement (25% wt.), and 18 g water. In order to determine the differences in bulk resistivity between a first conductive material (representative of material within the fracture and intermediate to any electrical connections) and a second conductive material (the aforementioned mixture of 10 g graphite, 3.3 g Portland cement, and 18 g of water were injected between two marble slabs subjected to various loads and stress cured for 64 hours. The overall pack thickness of the second conductive material achieved was approximately 0.01" to approximately 0.028." The resistivity of the second conductive material was approximately 0.1638 ohm cm, which was approximately 10-100 times more conductive than the surrounding proppant. The resistivity of two representative samples of the second conductive material are shown below under various loads in Table I. Sample A included a 25% by dry weight cement and 75% by dry weight graphite, and sample B included a 50% by dry weight cement and 50% by dry weight graphite. The resistivity of sample A was consistently lower than that of the second sample across all subjected loads. While adequate resistivities were achieved in both samples, a preferred embodiment would include a mixture containing cement of less than or equal to 50% by weight (dry), and equal to or greater than 50% by weight of graphite, and more preferably a mixture containing between 25-50% by weight (dry) of cement and 50-75% by weight (dry) of graphite, or another electrically conductive material such as granular metal, metal coated particles, coke, graphite, and/or combinations thereof.

TABLE I

| | Resistivity (ohm cm) | | | | | |
|---|---|---|---|---|---|---|
| Sample ID | load lbs 0 lbs | load lbs 50 lbs | load lbs 100 lbs | load lbs 150 lbs | load lbs 200 lbs | load lbs 250 lbs |
| A | 0.11 | 0.09 | 0.08 | 0.07 | 0.07 | 0.07 |
| B | 0.45 | 0.18 | 0.14 | 0.12 | 0.10 | 0.10 |

Figure 12:
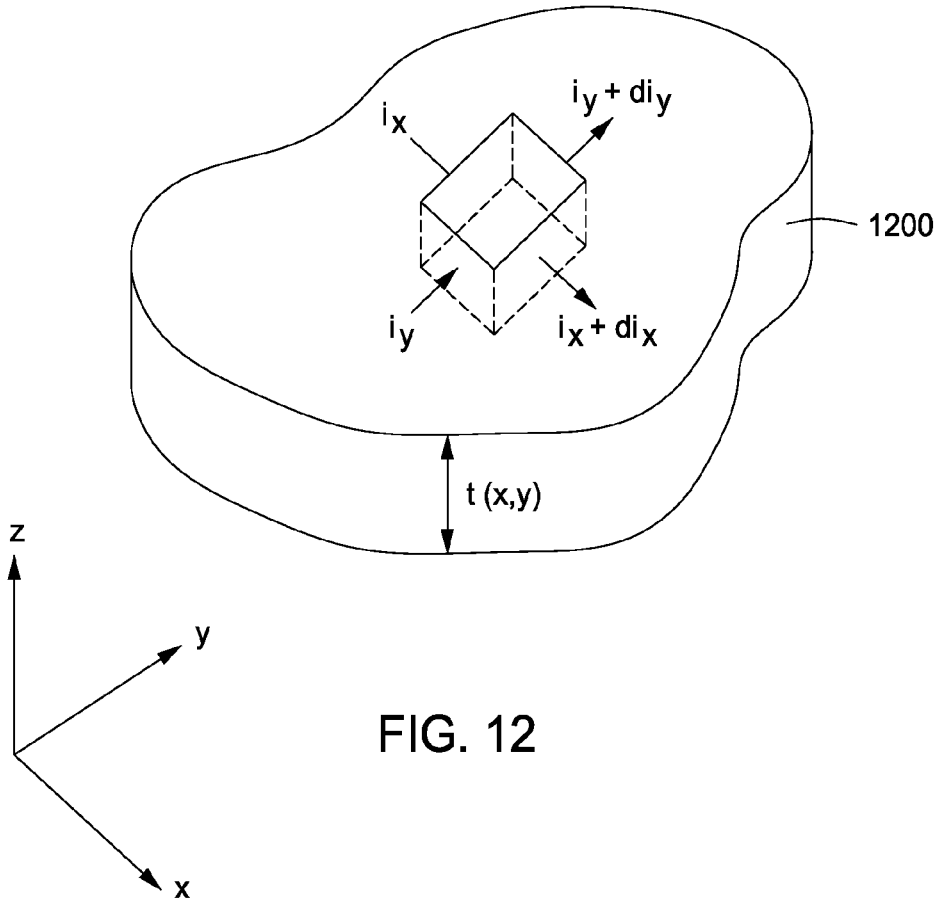
FIG. 12 demonstrates a flow of current through a geologic formation that has been fractured. Arrows demonstrate current increments in the x and y directions for partial derivative equations.

In order to understand the utility of using a strategically placed granular material at the connection point, it is helpful to consider mathematical concepts describing the flow of current through a body. FIG. 12 demonstrates a flow of current through a fracture plane 1200 in a geological formation. Arrows demonstrate current increments in the x and y directions for partial derivative equations. Arrow $i_x$ indicates electrical current flowing in the x direction while arrow $i_y$ indicates electrical current flowing in the y direction. Reference "t" indicates the thickness of the fracture 1200 at a point (x, y).

In fracture plane 1200, current moves in the x direction from a first point location x to a second location x+dx. The current value changes from $i_x+di_x$. Similarly, current moves in the y direction from a first point location y to a second point location y+dy. The current value changes from $i_y$ to $di_y$. If current enters or leaves the fracture at the location (x, y), this source term may be written as Q(x, y) and has units of Amperes/m$^2$. This represents a source of current at a point in a fracture.

As current moves charge is conserved. Charge conservation is the principle that electric charge can neither be created nor destroyed; the quantity of electric charge is always conserved. According to the theory of conservation of charge, the total electric charge of an isolated system remains constant regardless of changes within the system itself. Conservation of charge may be expressed mathematically using partial derivative equations:

$$\frac{\partial(ti_x)}{\partial x} + \frac{\partial(ti_y)}{\partial y} = Q(x, y)$$

wherein: $i_x$=current in the x direction within the reservoir
$i_y$=current in the y direction within the reservoir
t=thickness of a section of a reservoir
Q(x, y)=source of current at a point in a fracture
By Ohm's law:

$$i_x = \frac{-1}{p}\frac{\partial V}{\partial x};$$

$$i_y = \frac{-1}{p}\frac{\partial V}{\partial y}$$

wherein: ρ=resistivity of material in a reservoir
V=voltage of material

As noted, high heat generation may take place at the point connections between the metal conductors and the conductive granular material. A mathematical process has been developed for estimating the heat generation distribution for a fracture having resistive heat. This, in turn, allows for modeling of alternate methods for reducing heat generation at the downhole connection points.

A first step in this mathematical process is to provide a mapping of the product of conductivity and thickness. This may be expressed as:

$$\frac{t}{\rho} = \text{conductivity} \times \text{thickness}$$

As will be graphically demonstrated below, this first mapping step is conducted across the plane of the fracture.

A next step in the process is to provide a mapping of the input and output current. These currents may be represented as:

Q(x, y)

As will be graphically demonstrated below, this second mapping step is again conducted across the plane of the fracture.

The two mapping steps provide input maps. After the maps are created, an equation governing voltage can be solved based upon a voltage distribution in the fracture. An equation governing voltage may be expressed:

$$\frac{\partial}{\partial x}\left(\frac{t}{\rho}\frac{\partial V}{\partial x}\right) + \frac{\partial}{\partial y}\left(\frac{t}{\rho}\frac{\partial V}{\partial y}\right) = -Q(x, y)$$

Once the voltage distribution has been calculated, a heating distribution in the fracture can be calculated. This is done from a heat generation equation, as follows:

$$h(x, y) = -t\left(i_x \frac{\partial V}{\partial x} + i_x \frac{\partial V}{\partial y}\right)$$

Using the mathematical process described above, three different examples or "calculation scenarios" are provided herein to consider the problem of high current density around the power connections. The calculation scenarios involve an approximately 90 foot by 60 foot fracture filled with calcined coke as the granular conductant. The fracture is 0.035 inches thick at its center, with its thickness decreasing toward its periphery. Connections to the granular material within the fracture are made with steel plates. The current into and out of the fracture is introduced through these plates.

Various figures are provided in connection with the three calculation scenarios. In some instances the figures include a legend which provides the resistivities of the materials used in the three calculations. In the legends, $\rho_{coke}$ refers to the resistivity of the bulk proppant material used in all three scenarios; $\rho_{connector}$ refers to the resistivity of the more conductive material used around the connections in the second scenario; and $\rho_{steel}$, refers to the resistivity of the steel plates. Of course, this is merely illustrative as the plates could be fabricated from conductive materials other than steel.

Simulation No. 1

As noted, a solution to the problem of high current density leading to hot spots in the formation is implemented by placing a first type of granular material in the immediate vicinity of the connection between the conductors and the conductive granular material. To demonstrate the efficacy of this approach, a first simulation was conducted in which there was no intermediate material, meaning that the conductive granular material was homogeneous. Direct contact is provided between the steel plates and the homogeneous conductive material.

Figure 13:
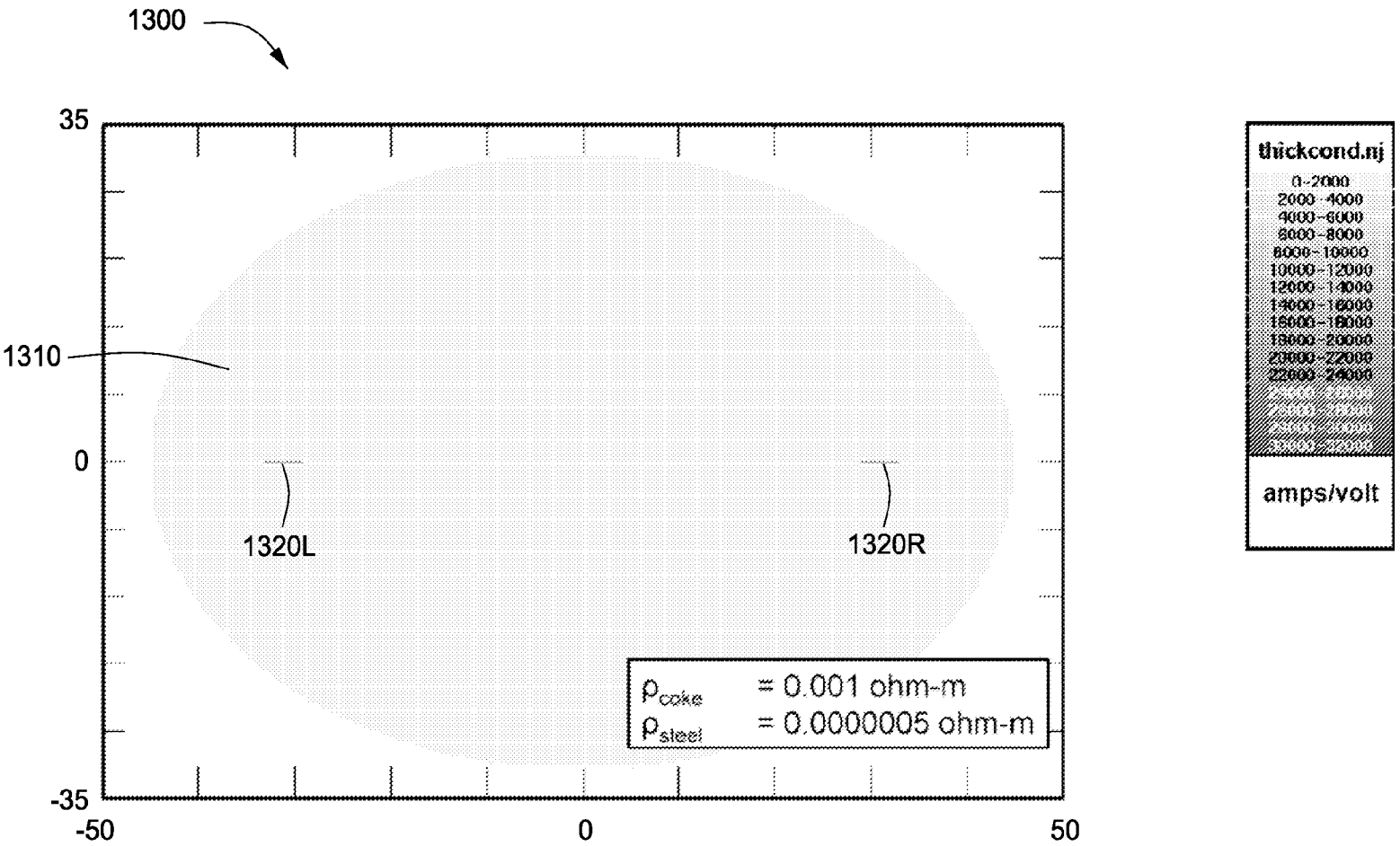
FIG. 13 is a thickness-conductivity map showing a plan view of a simulated fracture. Two steel plates are positioned within surrounding conductive granular proppant within the fracture. The map is gray-scaled to show the product value of conductivity multiplied by the thickness of the conductive granular proppant across the fracture.

The results of the first simulation are demonstrated in FIGS. 13 through 17. First, FIG. 13 provides a thickness-conductivity map 1300 showing a plan view of a simulated fracture. The fracture is shown at 1310. The fracture 1310 is filled with a conductive proppant. In this simulation, coke is used as the conductive proppant. The coke has a resistivity (indicated at $\rho_{coke}$) of 0.001 ohm-m.

Two steel plates are shown at 1320 within the fracture 1310. These represent a left plate 1320L and a right plate 1320R. The plates 1320 are modeled as four foot long plates that are three inches wide by ½-inch thick. The coke surrounds and immediately contacts each of the steel plates 1320. The steel plates 1320 serve to deliver current in the fracture 1310 and through the coke. The resistivity of the plates 1320 (indicated at $\rho_{steel}$) is 0.0000005 ohm-m.

The map 1300 is gray-scaled to show the value of conductivity of the granular proppant multiplied by its thickness across the map 1300. This means that the product of conductivity and thickness (t/ρ) for the fracture 1310 is mapped across a plan view of the fracture 1320. The values are measured in amps/volt. The scale starts at 0-2,000 amps/volt, and goes to 30,000-32,000 amps/volt. At this scale, the proppant in the fracture 1310 entirely falls within the 0-2,000 amps/volt range. Stated another way, the thickness-conductivity product is consistent between 0 and 2,000 amps/volt.

The plates 1320 are highly conductive. Therefore, the thickness-conductivity of the plates 1320 shows in the 30,000-32,000 amps/volt range.

Figure 14:
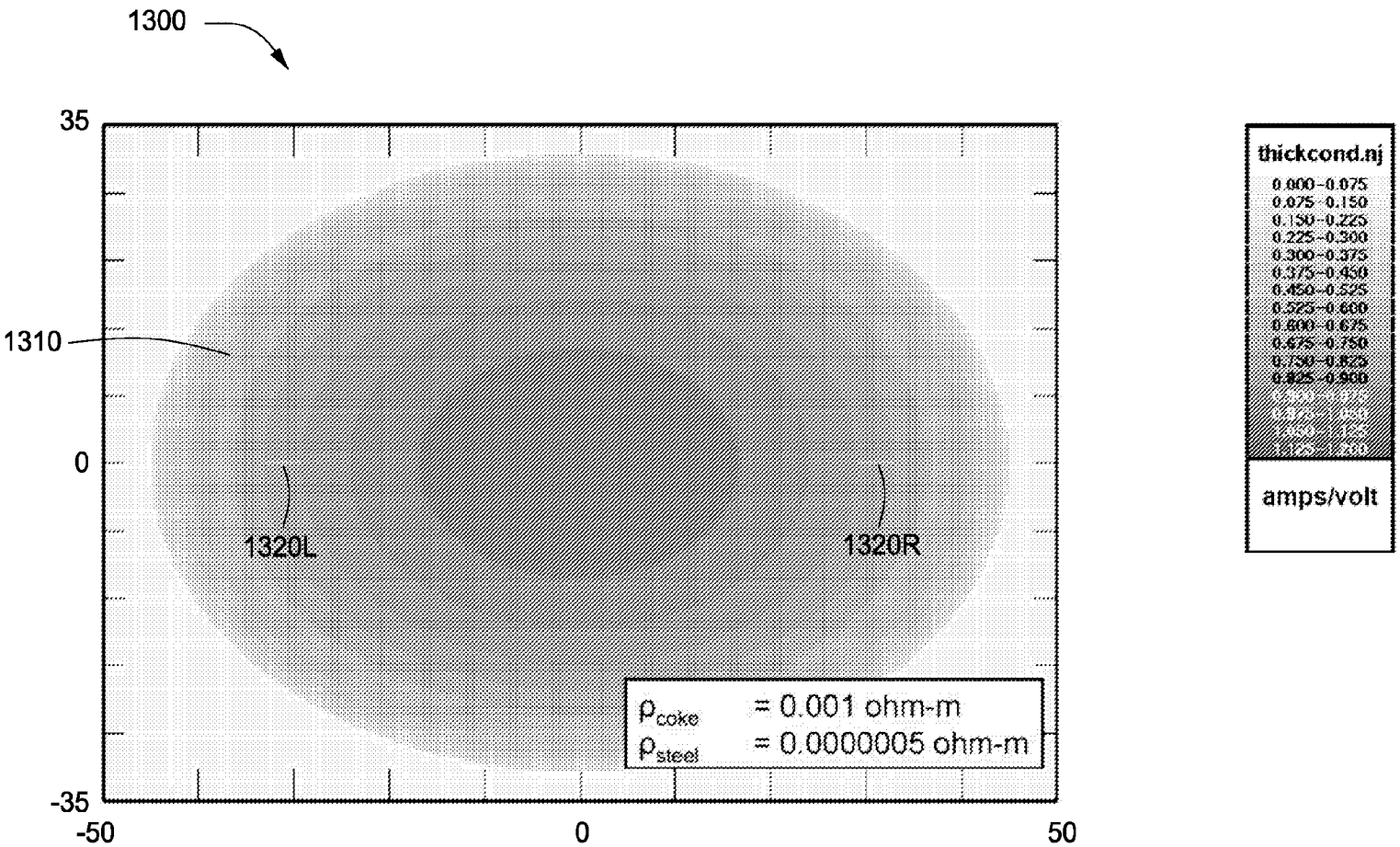
FIG. 14 is another view of the thickness-conductivity map of FIG. 13. The map is gray-scaled in finer increments of conductivity multiplied by thickness to distinguish variations in proppant thickness.

FIG. 14 is another view of the thickness-conductivity map 1300 of FIG. 13. The map 1300 is gray-scaled in finer increments of conductivity multiplied by thickness to distinguish variations in proppant conductivity-thickness within the fracture 1310. The scale starts at 0.000-0.075 amps/volt, and goes to 1.125-1.200 amps/volt. At this scale, variations in the thickness-conductivity product within the fracture 1310 become evident. At an outer ring, the thickness-conductivity product is within the smallest range of the scale—0.000-0.075 amps/volt. As one moves inward towards the center of the fracture 1310, concentric bands of increasing thickness-conductivity product are seen. At the center, the thickness-conductivity value is about 0.825 to 0.900 amps/volt.

It is noted that the conductivity of the coke within the fracture 1310 is constant. Therefore, the demonstrated variations are attributed to fracture thickness variations. The fracture 1310 is thin at the outer edge, and becomes increasingly thick towards its center. This tends to simulate actual fracture geometry.

The two steel plates 1320 are also seen in FIG. 14. As noted in connection with FIG. 13, the thickness-conductivity product of the plates 1320 falls in the 30,000-32,000 amps/volt range. Therefore, the plates 1320 are off of the chart in FIG. 13 and simply show up as being white.

Figure 15:
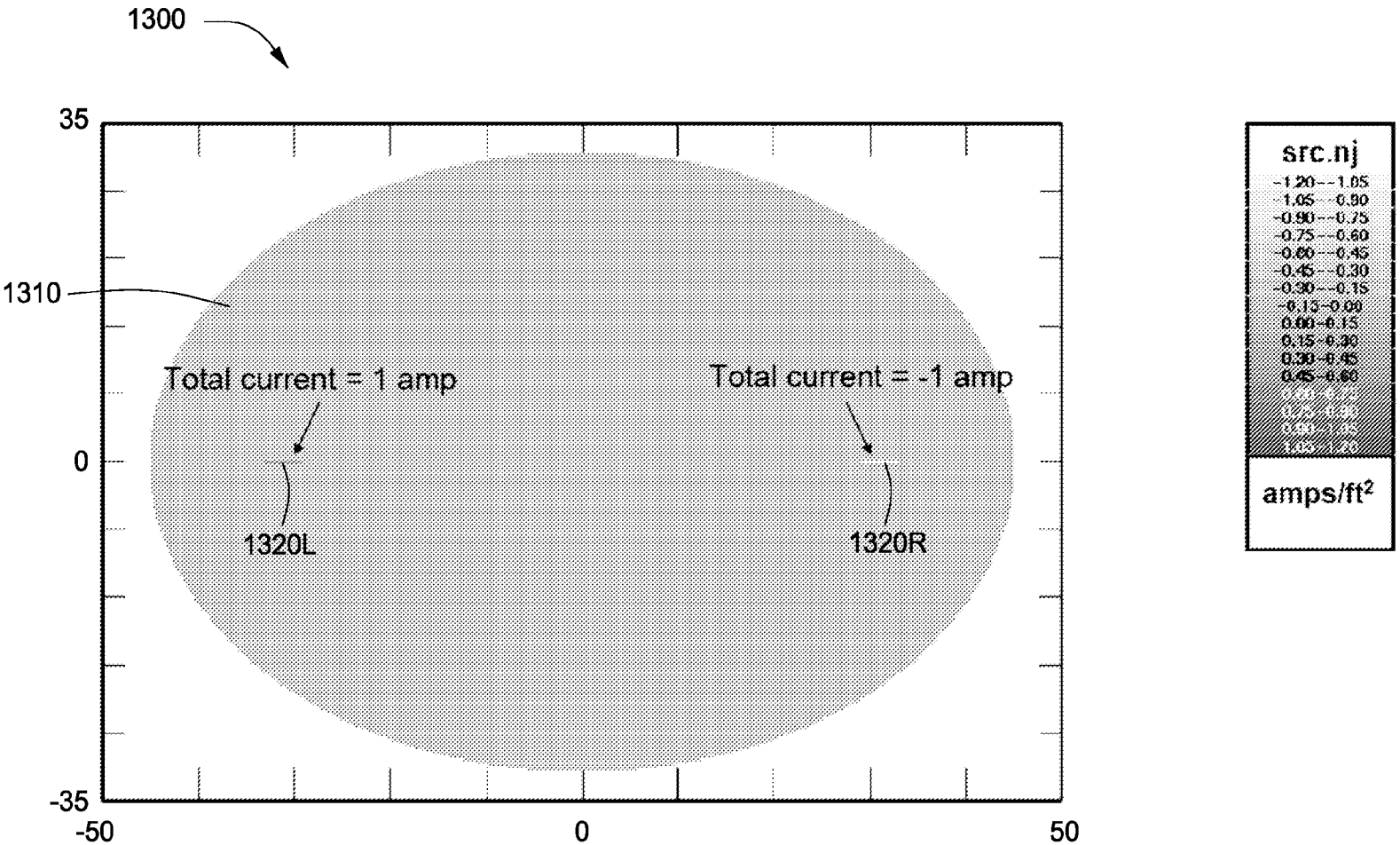
FIG. 15 is a representation of electric current moving into and out of the fracture plane of FIG. 13. This representation is an electric current source map.

Next, FIG. 15 provides a current source map 1300. In this instance, the map 1300 shows movement of current into and out of the fracture 1310. More specifically, FIG. 15 shows the input and output current for the first simulation. As indicated, the total current into and out of the fracture 1310 is one ampere. In one aspect, current goes into the plate 1320L on the left, and leaves through the plate 1320R on the right.

FIG. 15 includes a scale for current, in units of amps/ft$^2$. The scale runs from −1.20-−1.05 to 1.05-1.20. In between, the scale moves through −0.15-0.00 and 0.00-0.15. It can be seen that the current entering and leaving the fracture 1310 is 0.0 amps/ft$^2$ except at the two steel plates 1320.

Figure 16:
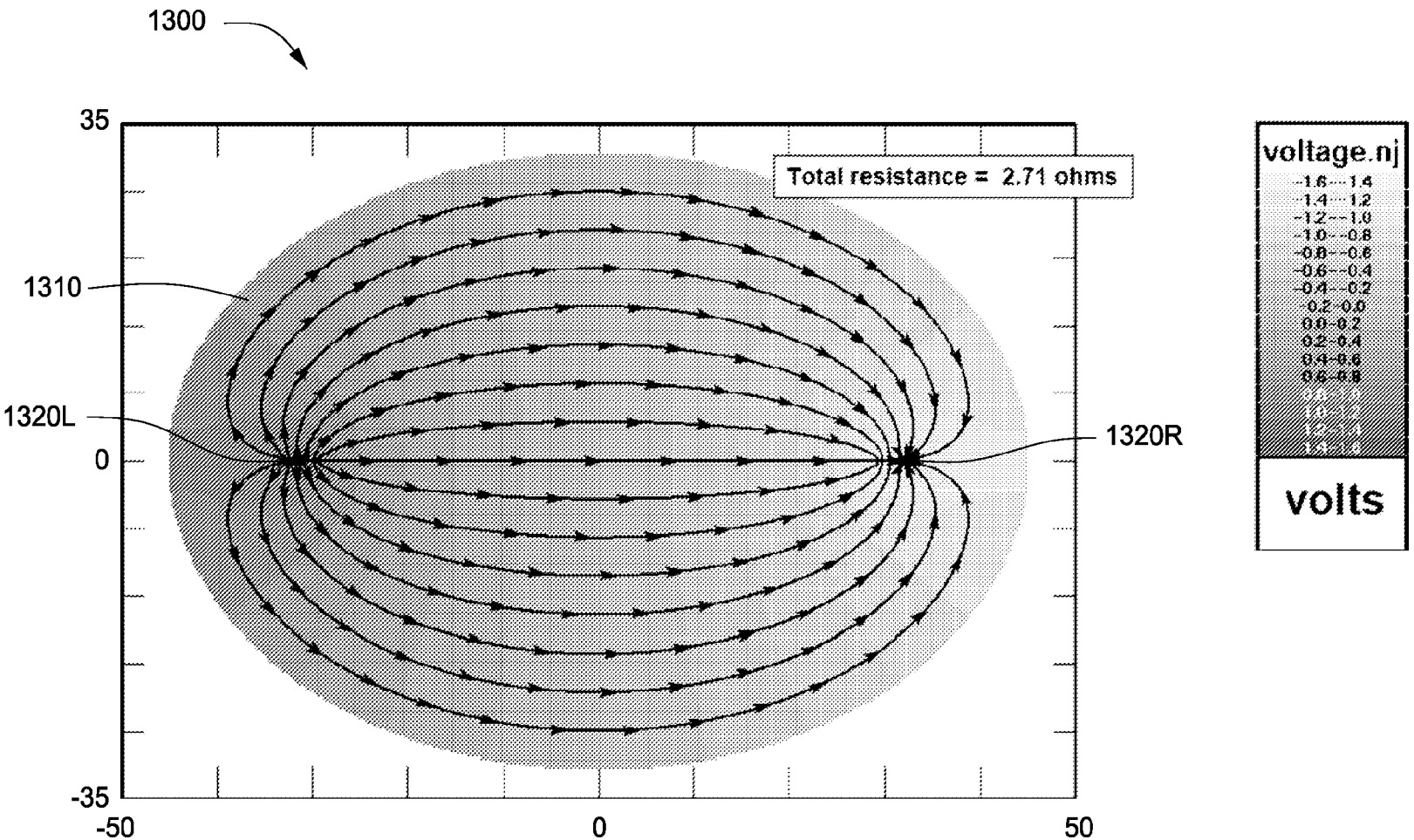
FIG. 16 shows a voltage distribution within the fracture of FIG. 13.

FIG. 16 demonstrates a calculated voltage distribution in the fracture 1310 from the one ampere of total current. Lines with arrows are provided to indicate the electrical current flow, which follows the local voltage gradient. As indicated, the total resistance of the fracture 1310 between the two pieces of steel 1320 is 2.71 Ohms.

A scale is provided in FIG. 16 measured in volts. The scale moves from −1.6-−1.4 to 1.4-1.6. In between, the scale moves through −0.2-0.0 and 0.0-0.2 volts. It can be seen that strongly negative voltage values exist immediately at the right plate 1320R, and strongly positive voltage values exist immediately at the left plate 1320L. It can also be seen that there is a higher concentration of current at the steel plates 1320.

Figure 17:
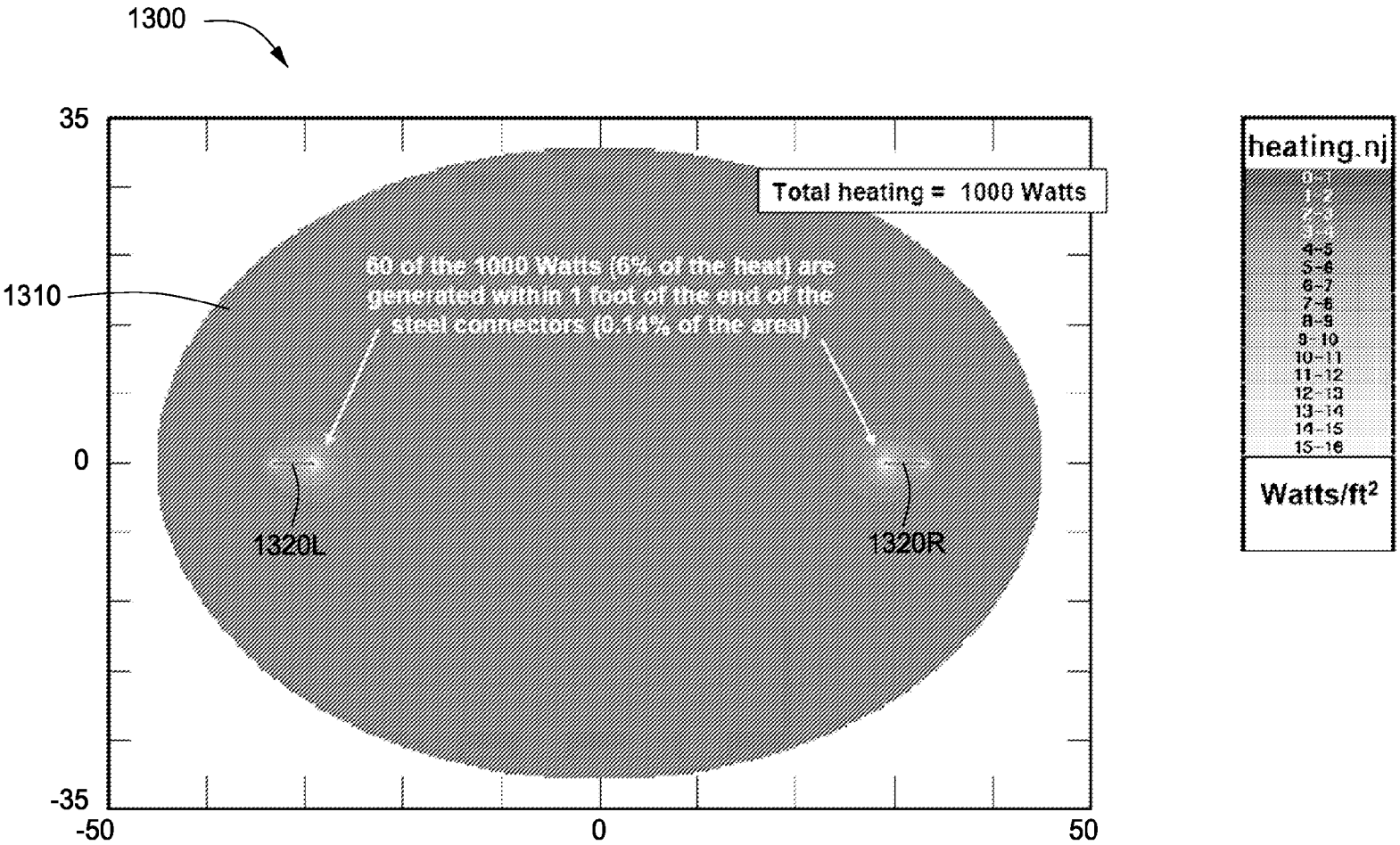
FIG. 17 shows a heating distribution within the fracture of FIG. 13.

Finally, FIG. 17 demonstrates the resulting heating distribution in the fracture 1310 from the first simulation. The units of the map 1300 are Watts/ft$^2$. A gray-scale is provided indicating values from 0 up to 16 Watts/ft2. As can be seen, the heat distribution in the map 1300 shows a total heat input of 1,000 Watts. 60 of the 1,000 Watts (6% of the heat) are generated within one foot of the ends of the plates 1320L, 1320R.

The heat generation in the simulated fracture 1310 declines rapidly away from the steel plates 1320. This indicates that much energy was lost at the plates 1320 without generating sufficient heat to pyrolyze solid formation hydrocarbons that would otherwise reside in the formation. Six percent of the heat was generated in just 0.14% of the fracture area 1310. As a result, excessive heating was demonstrated to occur in the immediate vicinity of the steel plates 1320. Therefore, a modification is desired to disperse heat away from the plates 1320.

Simulation No. 2

A second simulation was conducted wherein an "intermediate material" was placed between the steel plates and the surrounding calcined coke. The intermediate material was a highly conductive material that was placed around the conductive connections. The "intermediate material" was simulated to have an electrical conductivity 100 times that of the calcined coke, or a resistivity of 0.00001 Ohm-Meters. As will be shown, this eliminated the high voltage drop across the area of high current density around the connection points, effectively eliminating the excessive heating around the connection points.

Figure 18:
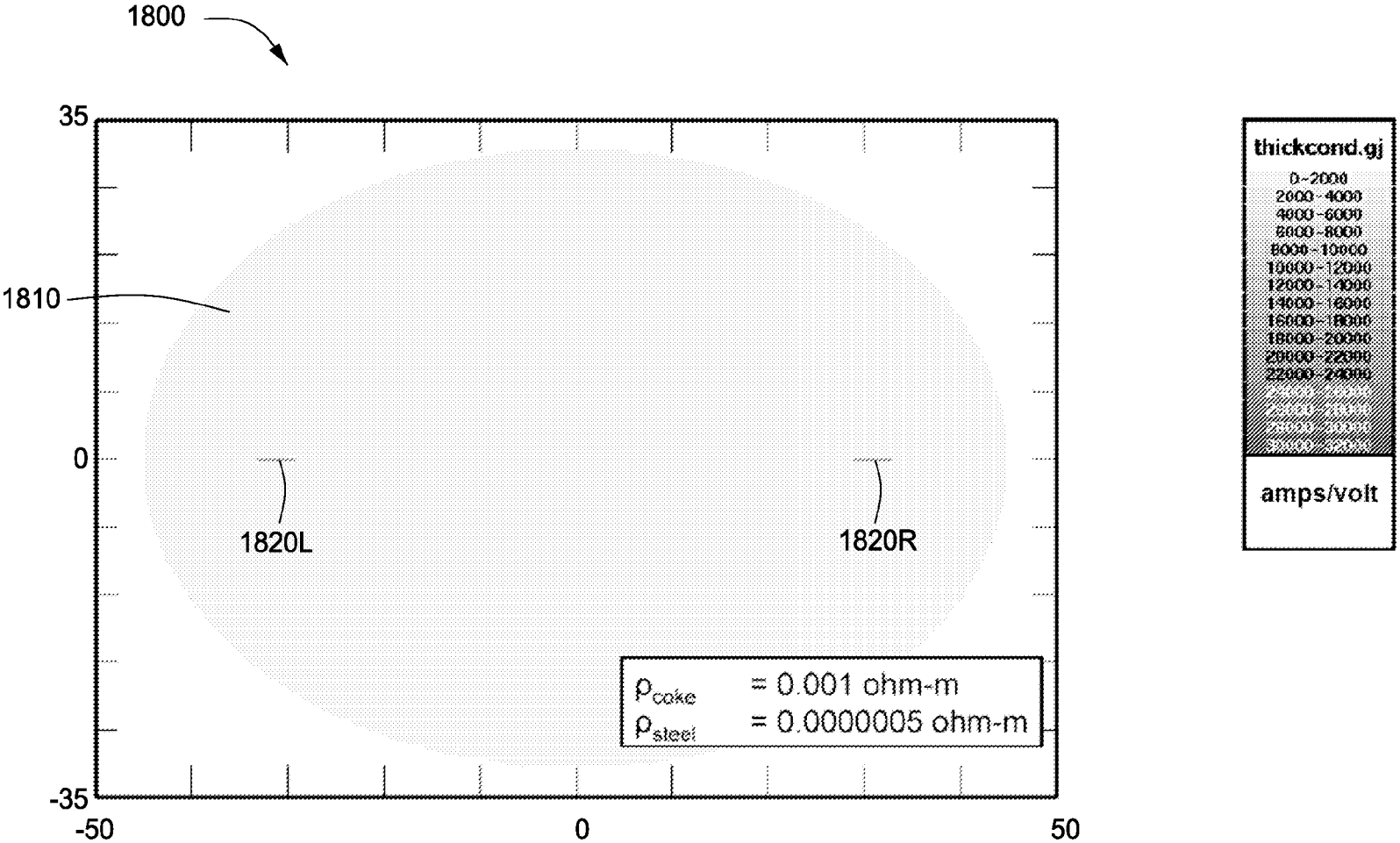
FIG. 18 is a thickness-conductivity map showing a plan view of a simulated fracture plane. Two steel plates are again positioned within surrounding conductive granular proppants within the fracture plane. The map is gray-scaled to show the product value of conductivity multiplied by the thickness of the conductive granular proppants across the fracture.

The results of the second simulation are demonstrated in FIGS. 18 through 23. First, FIG. 18 provides a thickness-conductivity map 1800 showing a plan view of a simulated fracture. The fracture is shown at 1810. The fracture 1810 is again filled with a conductive proppant. In this simulation, coke is used as a primary conductive proppant. The coke again has a resistivity (indicated at $\rho_{coke}$) of 0.001 ohm-m.

Two steel plates are shown at 1820 within the fracture 1810. These represent a left plate 1820L and a right plate 1820R. The coke surrounds each of the steel plates 1820. The steel plates 1820 serve to deliver current in the fracture 1810 and through the coke.

In this second simulation the coke does not immediately contact the steel plates 1820; rather, a connecting granular material is used around the plates 1820. The resistivity of the connector material (indicated at $\rho_{connector}$) is 0.00001 ohm-m.

The map 1800 is gray-scaled to show the value of conductivity of the conductive granular proppants 1820 multiplied by its thickness at various locations across the map 1800. This means that the product of conductivity and thickness ($t/\rho$) for the fracture 1810 is mapped across a plan view of the fracture 1820. The values are measured in amps/volt. The scale starts at 0-2,000 amps/volt, and goes to 30,000-32,000 amps/volt. At this scale, the proppants in the fracture 1810 entirely fall within the 0-2,000 amps/volt range. Stated another way, the thickness-conductivity product is consistent between 0 and 2,000 amps/volt.

The map 1800 of FIG. 18 has been scaled to distinguish between the conductive granular proppant in the fracture 1810, and the two steel plates 1820 that make up the electrical connection. The legend in FIG. 18 gives the resistivities of the materials used in the second simulation. The $\rho_{coke}$ refers to the resistivity of the bulk proppant material; the $\rho_{connector}$ refers to the resistivity of the highly conductive material used immediately around the plates 1820L, 1820R; and, the $\rho_{steel}$, refers to the resistivity of the steel plates 1820.

The plates 1820 are once again modeled as four-foot-long, three-inch-wide, and ½-inch-thick plates. The plates 1820 are highly conductive, with the thickness-conductivity of the plates 1820 showing in the 30,000-32,000 amps/volt range. The plates 1820 show up as being black.

Figure 19:
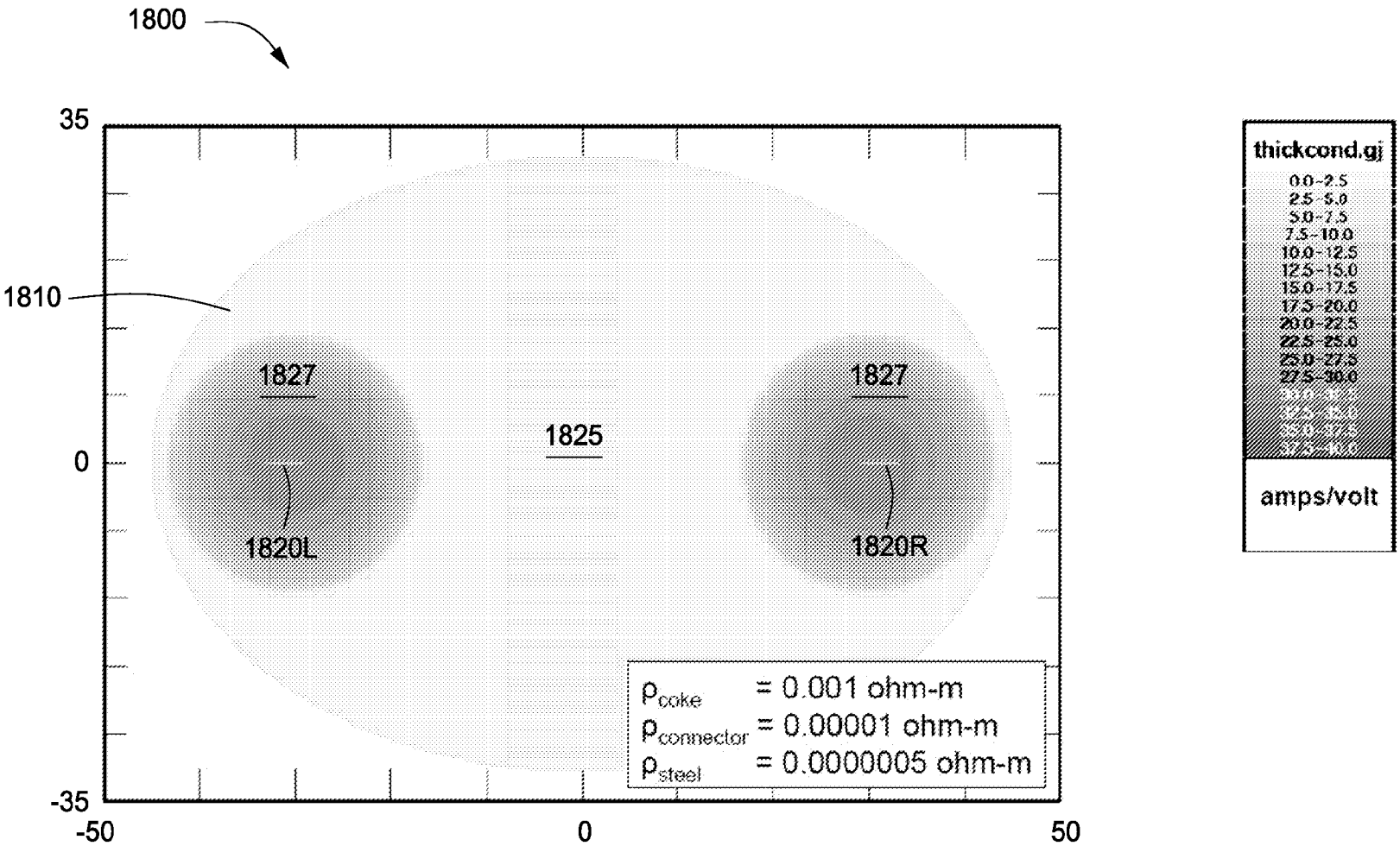
FIG. 19 is another view of the thickness-conductivity map of FIG. 18. The map is gray-scaled in finer increments of conductivity multiplied by thickness to distinguish product values between the calcined coke, around the steel plates and a higher conductivity proppant, or "connector."

FIG. 19 is another view of the thickness-conductivity map 1800 of FIG. 18. The map 1800 is gray-scaled in finer increments of conductivity multiplied by thickness to distinguish variations in proppant conductivity-thickness within the fracture 1810. The scale starts at 0.00-2.50 amps/volt, and goes to 37.50-40.00 amps/volt. At this scale, variations in the thickness-conductivity product between the primary coke proppant and the connector proppant become evident. The conductivity-thickness product across most of the fracture 1800 is within the smallest range of the scale—0.00-2.50 amps/volt. However, concentric rings of proppant having a higher conductivity-thickness product are visible around the plates 1820L, 1820R. Immediately adjacent the plates 1820L, 1820R, the conductivity-thickness product is as high as 17.5 to 20.0 amps/volt. The rings dissipate away from the plates 1820L, 1820R to about 7.5 to 10.0 amps/volt before dropping to the lowest range of 0.00 to 2.50 amps/volt within the coke.

Figure 20:
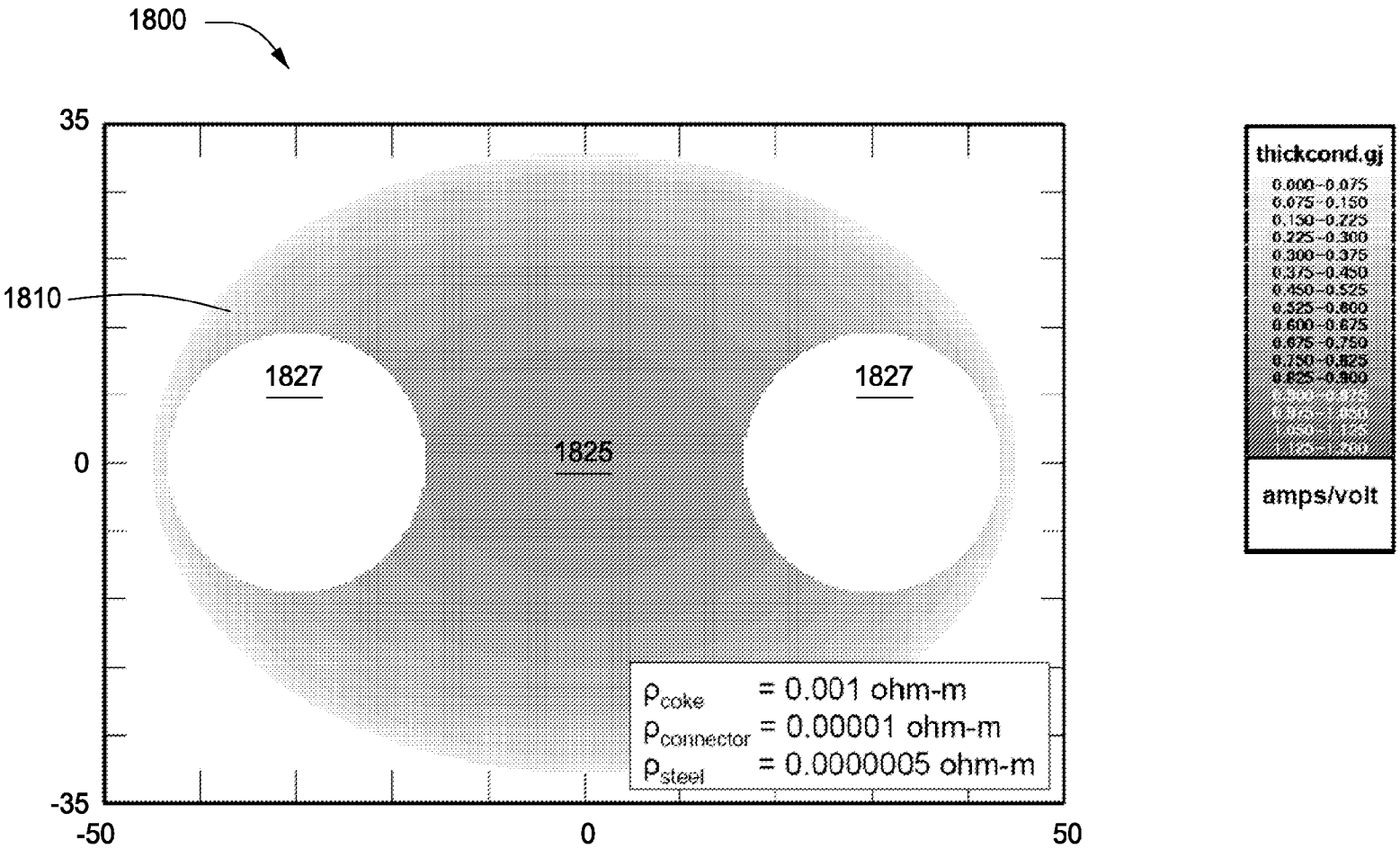
FIG. 20 is another view of the thickness-conductivity map of FIG. 18. The map is gray-scaled in still further finer increments of conductivity times thickness to distinguish variations in conductivity between the calcined coke around the steel plates and the higher conductivity proppant.

FIG. 20 is another view of the thickness-conductivity map 1800 of FIG. 18.

The map 1800 is gray-scaled in still further finer increments of conductivity multiplied by thickness to distinguish variations in proppant conductivity-thickness within the primary proppant. The scale starts at 0.000-0.075 amps/volt, and goes to 1.125-1.200 amps/volt. The conductivity-thickness product across the fracture 1810 is approximately 0.000 to 0.075 at the edge of the fracture 1810, and increases to about 0.675 to 0.750 at the center of the fracture 1810. However, concentric rings of proppant having a higher conductivity-thickness product are again visible. These rings show up white and are off the scale as their conductivity exceeds the highest range of 1.125 to 1.200.

In FIG. 20 the plates 1820 cannot be distinguished from the intermediate proppant because they are "off the chart" as well, meaning the conductivity-thickness product is high.

It is noted that the conductivity of the coke within the fracture 1810 is constant. Therefore, the demonstrated variations in conductivity-thickness product seen in FIG. 20 are attributed to fracture thickness variations. The fracture 1810 is thin at the outer edge, and becomes increasingly thick towards its center. This tends to simulate actual fracture geometry.

Figure 21:
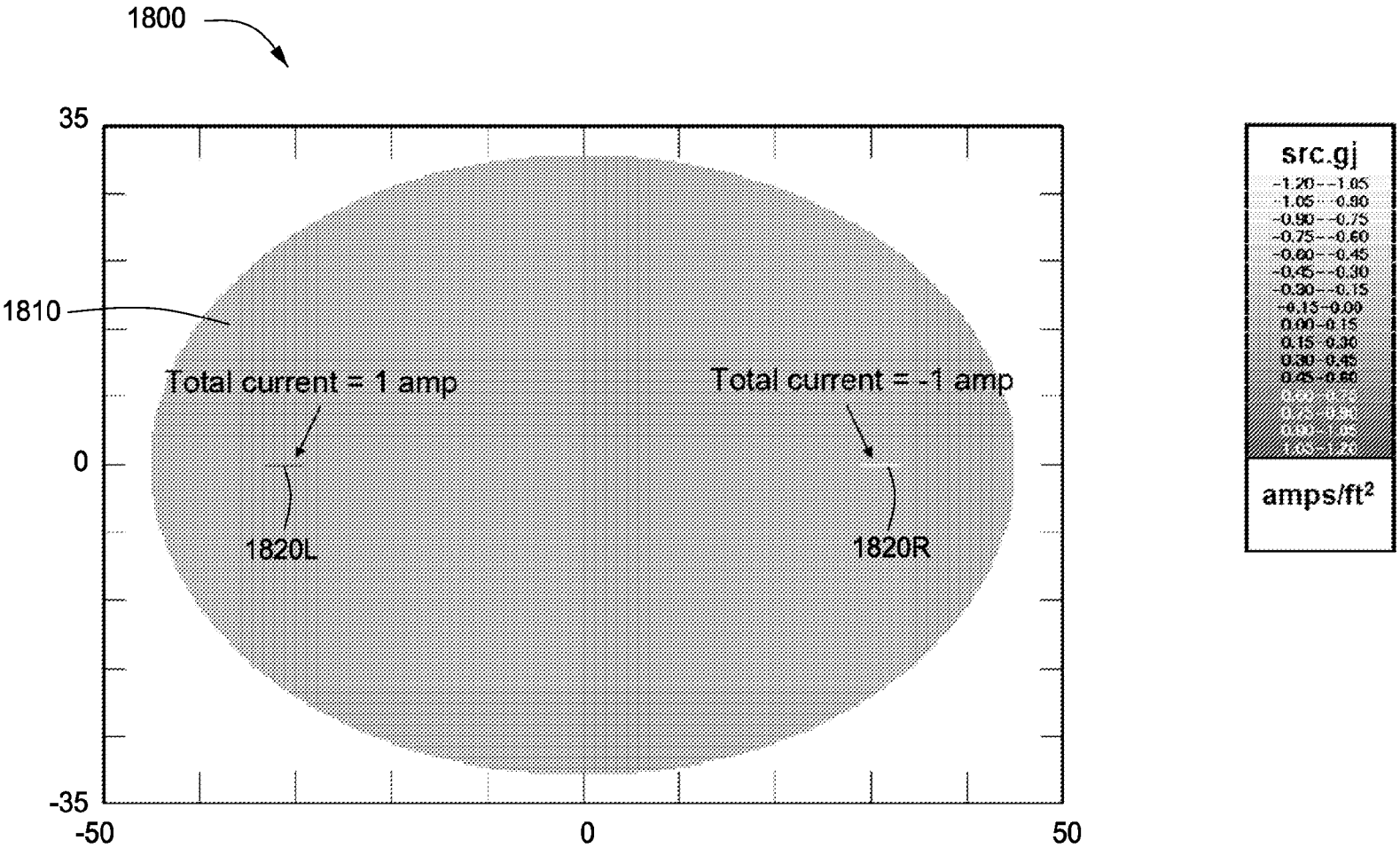
FIG. 21 is a representation of electric current moving into and out of the fracture plane of FIG. 18. This representation is an electric current source map.

Next, FIG. 21 provides a current source map 1800. In this instance, the map 1800 shows movement of current into and out of the fracture 1810. More specifically, FIG. 21 shows the input and output current for the second simulation. As indicated, the total current into and out of the fracture 1810 is one ampere. In one aspect, current goes into the plate 1820L on the left, and leaves through the plate 1820R on the right. The current entering and leaving the fracture 1810 is zero, except at the steel plates 1820R, 1820L.

FIG. 21 includes a scale for current, in units of amps/ft$^2$. The scale runs from −1.20-−1.05 to 1.05-1.20. In between, the scale moves through −0.15-0.00 and 0.00-0.15. It can be seen that the current entering and leaving the fracture 1810 is 0.0 amps/ft$^2$ except at the two steel plates 1820.

Figure 22:
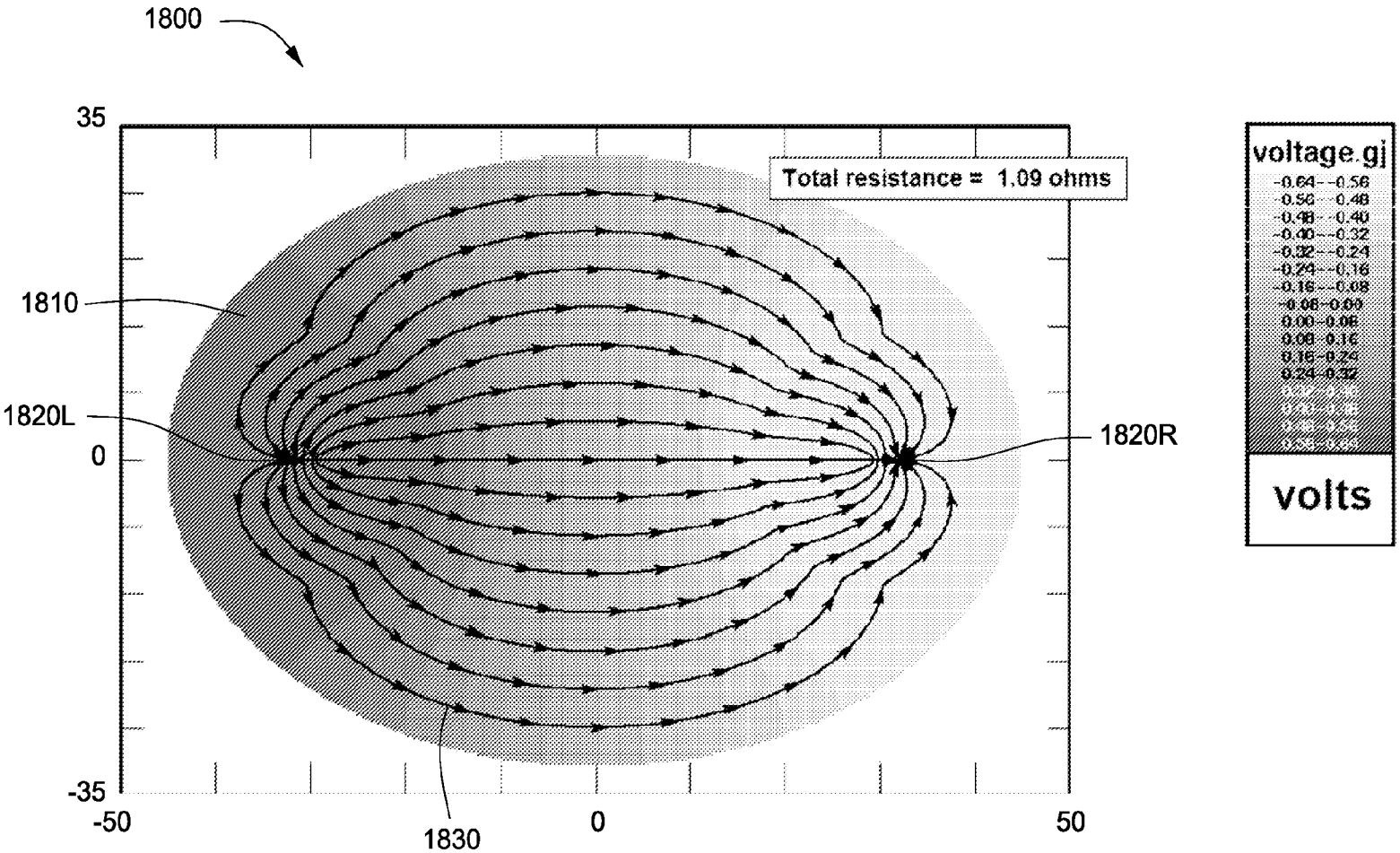
FIG. 22 shows a voltage distribution within the fracture plane of FIG. 18.

FIG. 22 demonstrates a calculated voltage distribution in the fracture 1810 from the one ampere of total current. Lines with arrows are provided to indicate the electrical current flow, which follows the local voltage gradient. As indicated, the total resistance of the fracture 1810 between the two plates 1820 is 1.09 Ohms, indicating that the higher conductivity material around the plates 1820 has decreased the overall resistance in the fracture relative to the map 1300 of FIG. 16.

A scale is provided in FIG. 22 measured in volts. The scale moves from −0.64-−0.56 to 0.56-0.64. In between, the scale moves through −0.08-0.0 and 0.0-0.08 volts. These ranges are lower than in the corresponding map 1300 of FIG. 16. This is because total resistance in fracture plane 1810 is lower.

It can be seen in FIG. 22 that negative voltage values exist immediately at the right plate 1820R, and positive voltage values exist immediately at the left plate 1820L. Of interest, current is still focused in the vicinity of the plates 1820, meaning that there is a higher concentration of current at the steel plates 1820. However, the current pathways can be seen to bend as they enter and leave the higher conductivity areas around the plates 1820.

Figure 23:
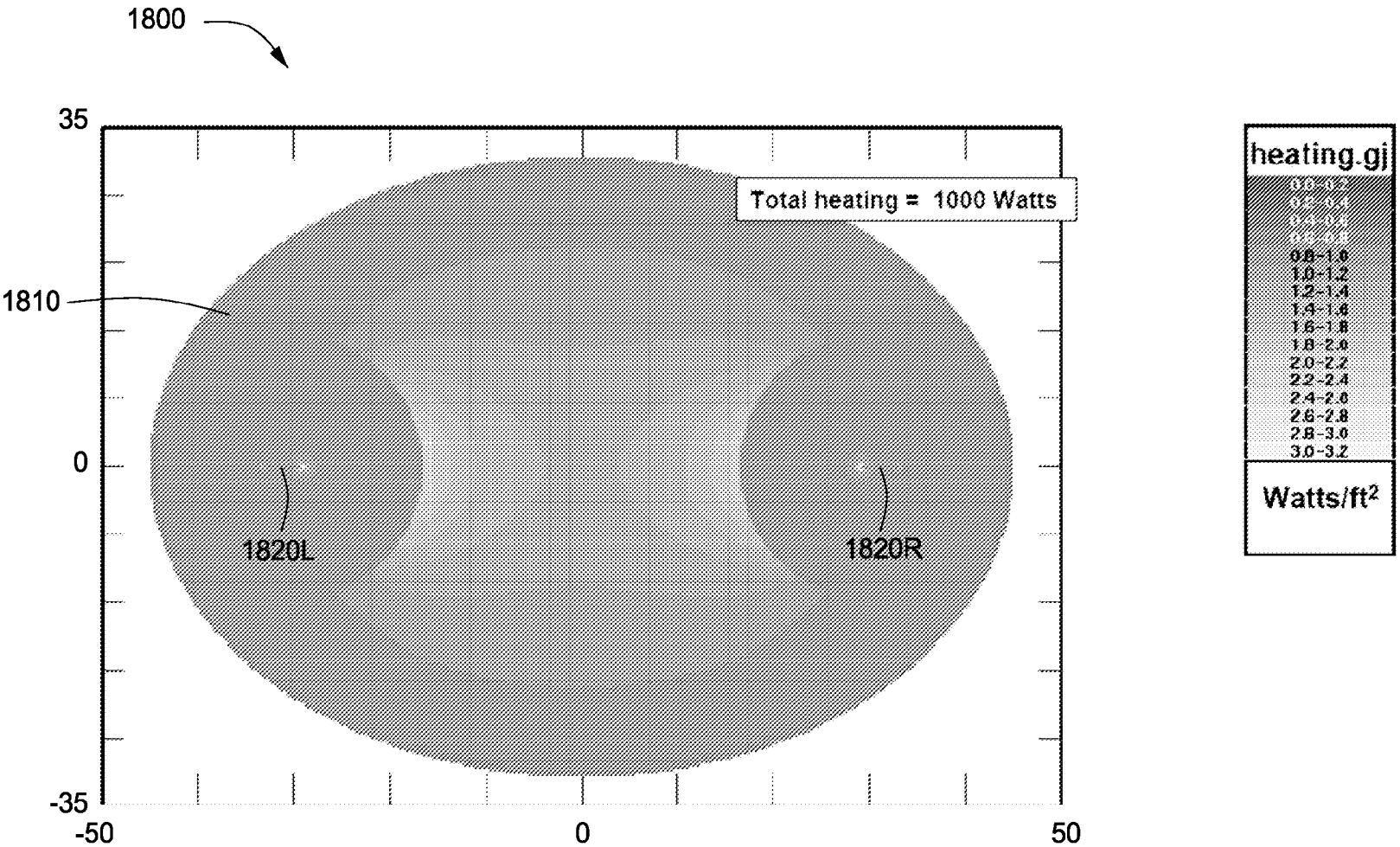
FIG. 23 shows a heating distribution within the fracture plane of FIG. 18.

Finally, FIG. 23 demonstrates the resulting heating distribution in the fracture 1810 from the simulation. The units of the map 1800 are Watts/ft$^2$. A gray-scale is provided indicating values from 0.0-0.2 up to 3.0-3.2 Watts/ft$^2$. As can be seen, the heat distribution in the map 1800 shows a total heat input of 1,000 Watts. However, only 3.3 of the 1,000 Watts (0.33% of the heat) are generated within 1 foot of the ends of the connecting plates 1820L, 1820R. This is a substantial reduction in localized heat generation over the first simulation demonstrated in FIG. 17, proving a more uniform heating of the fracture 1810.

It is again noted that moderate heat is indicated at the respective ends of the plates 1820L, 1820R. However, these heat areas do not reflect extensive heating within the overall fracture 1810 and provide no cause for concern.

Simulation No. 3

Next, a third simulation was conducted wherein a non-conductive material was used as the connecting granular material. The non-conductive material was specifically placed at the ends of the simulated steel plates. The non-conductive material operates to redirect current in the formation to mitigate excessive heating around the steel connections. This is another alternative method for eliminating the high heating in the area of high current density around the plates, effectively reducing the excessive heating experienced in the first simulation so that the fracture receives a more uniform heat distribution.

Figure 24:
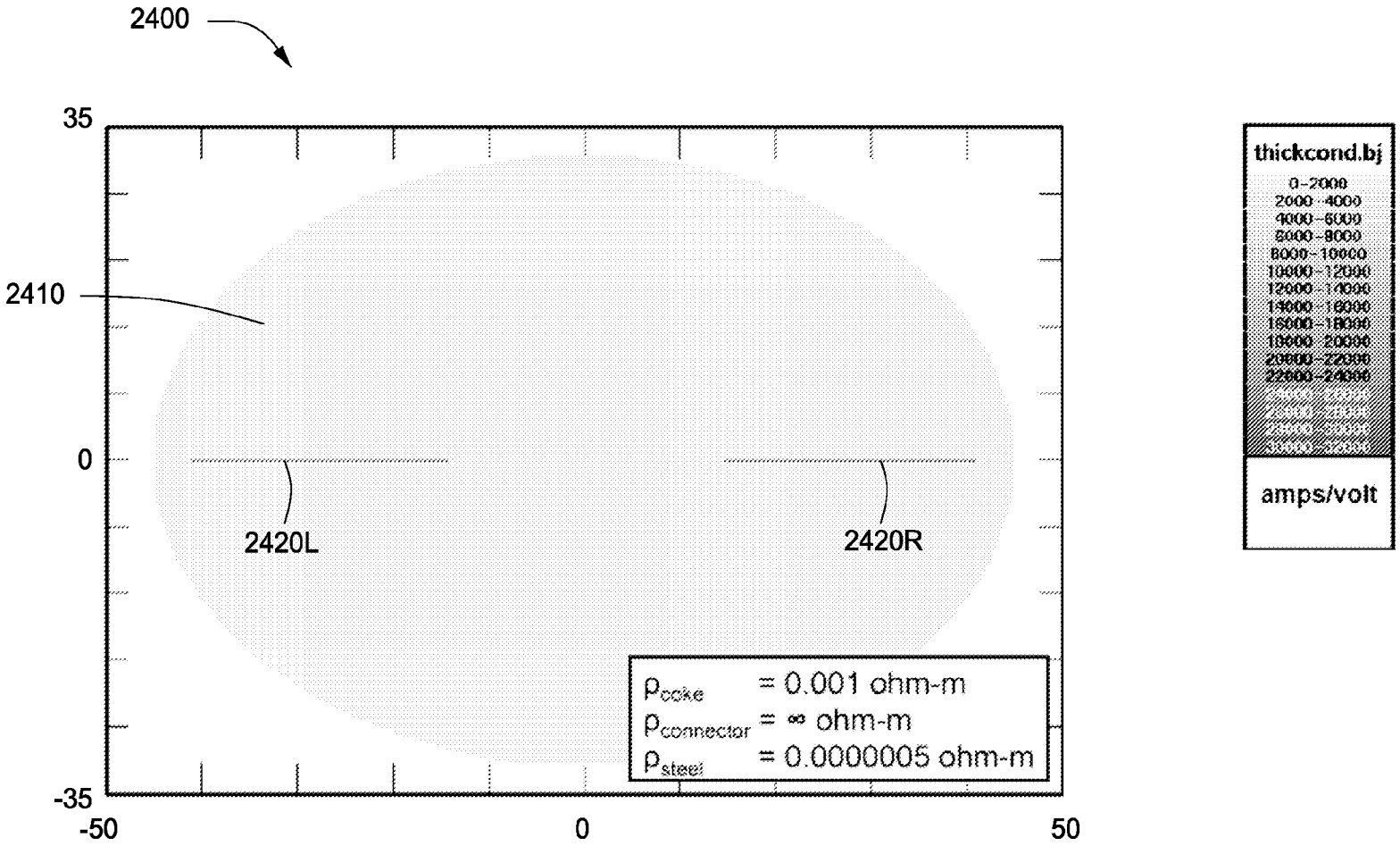
FIG. 24 is a thickness-conductivity map showing a plan view of a simulated fracture plane. Two steel plates are again positioned within surrounding conductive granular proppants within the fracture plane. The map is gray-scaled to show the product value of conductivity multiplied by thickness for the conductive granular proppants across the fracture.

The results of the third simulation are demonstrated in FIGS. 24 through 28. First, FIG. 24 provides a conductivity map 2400 showing a plan view of a simulated fracture. The fracture is shown at 2410. The fracture 2410 is again filled with a conductive proppant. In this simulation, coke is used as a primary conductive proppant. The resistivity of the coke (indicated at $\rho_{coke}$) is 0.001 ohm-m.

Two steel plates are shown at 2420 within the fracture 2410. These represent a left plate 2420L and a right plate 2420R. The coke surrounds each of the steel plates 2420. The steel plates 2420 serve to deliver current in the fracture 2410 and through the coke.

In this third simulation the coke does not immediately contact all of the steel plates 2420; rather, an intermediate granular material is used around the plates 2420 with coke contacting the plates 2420 only at respective ends. In this instance, the granular material is substantially non-conductive. Thus, the resistivity of the coke is 0.001 ohm-m, while the resistivity of the granular connector material (indicated at $\rho_{connector}$) is essentially infinite.

The map 2400 is gray-scaled to show the value of conductivity of the conductive granular proppant multiplied by its thickness at various locations across the map 2400. This means that the product of conductivity and thickness ($t/\rho$) for the fracture 2410 is mapped across a plan view of the fracture 2420. The values are measured in amps/volt.

The map 2400 of FIG. 24 has been scaled to distinguish between the coke in the fracture 2410, and the two steel plates 2420 that make up the electrical connection. The legend in FIG. 24 gives the resistivities of the materials used in all the third simulation. The $\rho_{coke}$, refers to the resistivity of the bulk proppant material; the $\rho_{connector}$ refers to the resistivity of the non-conductive granular material used around the connectors 2420L, 2420R in the third simulation; and, the $\rho_{steel}$, refers to the resistivity of the steel plates 2420. The scale starts at 0-2,000 amps/volt, and goes to 30,000-32,000 amps/volt. At this scale, the resistivity values for the proppant in the fracture 2410 ($\rho_{coke}$) entirely fall within the 0-2,000 amps/volt range. Stated another way, the thickness-conductivity product is consistent between 0 and 2,000 amps/volt.

In the third simulation, the plates 2420 are modeled as 27 feet long, 3 inches wide, and ½-inch thick. Compared to the four-foot plates 1820 used in the second simulation, the plates 2420 of the third simulation are very long. This is because the connecting granular material used in the third simulation is substantially non-conductive. The longer plates 2420 provide additional surface area through which current may travel into the fracture 2410. The plates 1820 are highly conductive, with the thickness-conductivity of the plates 2420 showing in the 30,000-32,000 amps/volt range. The current into and out of the fracture 2410 is introduced through the plates 2420.

Figure 25:
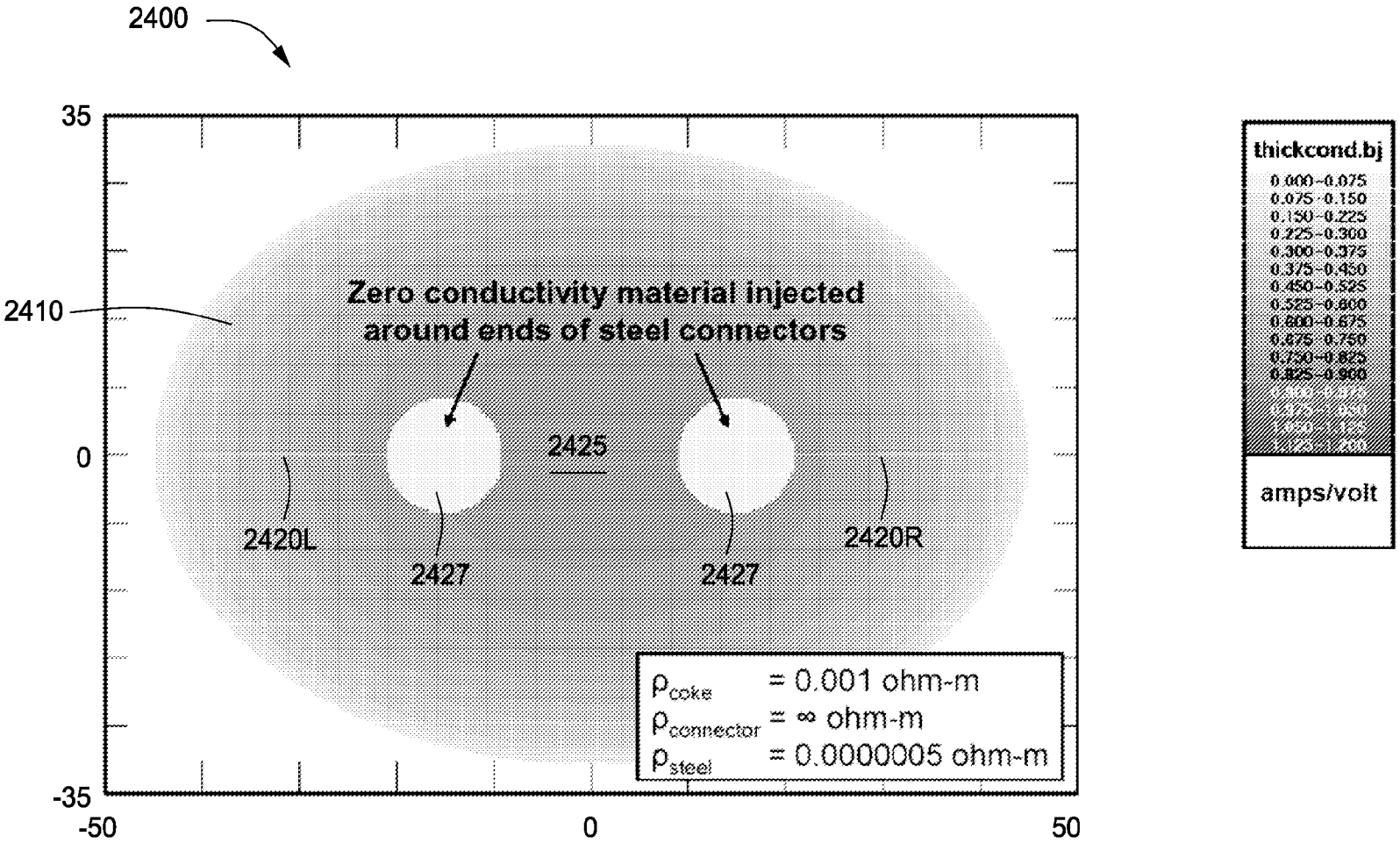
FIG. 25 is another view of the thickness-conductivity map of FIG. 24. The map is gray-scaled in finer increments of conductivity multiplied by thickness to distinguish between calcined coke, or "connector," around the steel plates and a higher conductivity proppant.

FIG. 25 is another view of the conductivity map 2400 of FIG. 24. The map 2400 is gray-scaled in finer increments of conductivity multiplied by thickness to distinguish variations in proppant conductivity-thickness within the fracture 2410. The scale starts at 0.000-0.075 amps/volt, and goes to 1.125-1.200 amps/volt. The conductivity-thickness product across the fracture 2410 is approximately 0.000 to 0.075 at the edge of the fracture 2410, and increases to about 0.675 to 0.750 at the center of the fracture 1810. However, concentric rings of substantially non-conductive proppant appear at ends of the plates 2420L, 2420R. These rings show up almost white as their conductivity is zero.

The map 2400 of FIG. 25 has been scaled to distinguish variations in conductivity-thickness in the coke-filled bulk of the fracture 2410. The coke proppant is indicated at 2425. The conductivity of the coke proppant 2425 within the fracture 2410 is constant. Therefore, the demonstrated variations in conductivity-thickness product are attributed to fracture thickness variations. The fracture 2410 is thin at the outer edge, and becomes increasingly thick towards its center. This tends to simulate actual fracture geometry.

FIG. 25 also shows where non-conductive material ($t/\rho=0$) has been emplaced around the ends of the steel plates 2420L, 2420R. The non-conductive granular material is indicated at 2427. This non-conductive material 2427 interrupts the flow of current from the plates 2420L, 2420R to the bulk proppant 2425.

The plates 2420 are also visible in FIG. 25. The extremely high conductivity plates 2420 show up in FIG. 25 as white lines, indicating an off-scale value.

Figure 26:
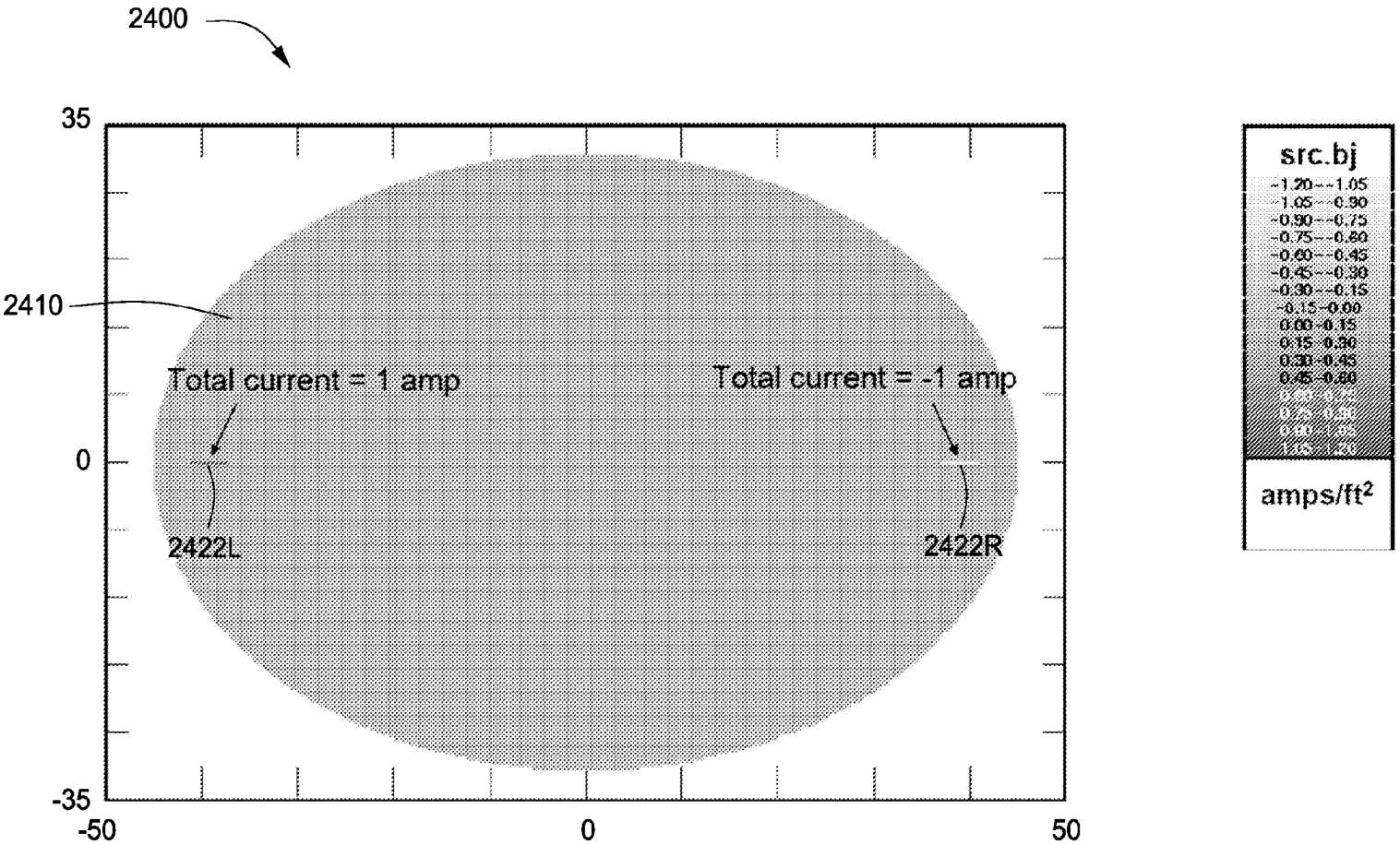
FIG. 26 is a representation of electric current moving into and out of the fracture plane of FIG. 24. This representation is an electric current source map.

Next, FIG. 26 provides a current source map 2400. In this instance the map 2400 shows movement of current into and out of the fracture 2410. More specifically, FIG. 26 shows the input and output current for the third simulation. As indicated, the total current into and out of the fracture 2410 is one ampere. In one aspect, current goes into the connector 2420L on the left, and leaves through the connector 2420R on the right. The current entering and leaving the fracture 2410 is zero except at the steel plates 2420R, 2420L.

It is noted that the 27-foot length of the respective connectors 2420L and 2420R appears abbreviated in the view of FIG. 26. This is because current is only being supplied near the ends of the plates 2420. It is noted that the exposed portion in each of plate 2422L and 2422R is shorter in FIG. 26 than in FIG. 25. This is indicative of where the current has been applied.

FIG. 26 includes a scale for current, in units of amps/ft$^2$. The scale runs from −1.20-−1.05 to 1.05-1.20. In between, the scale moves through −0.15-0.00 and 0.00-0.15. It can be seen that the current entering and leaving the fracture 2410 is 0.0 amps/ft$^2$ except at a portion of the two steel plates 2420 that are in contact with the conductive proppant.

Figure 27:
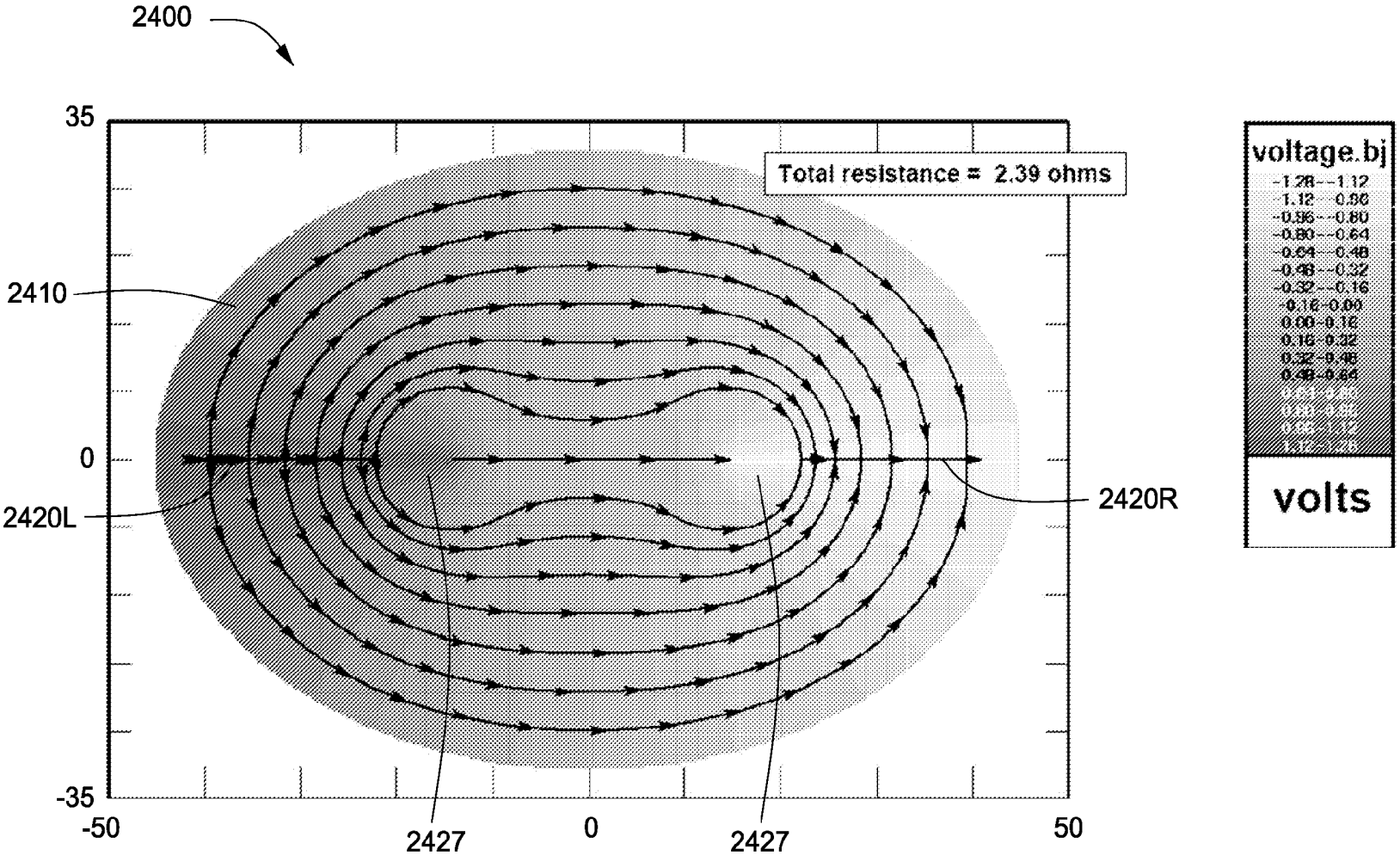
FIG. 27 shows a voltage distribution within the fracture plane of FIG. 24.

FIG. 27 demonstrates a calculated voltage distribution in the fracture 2410 from the one ampere of total current. Lines with arrows are provided to indicate the electrical current flow, which follows the local voltage gradient. As indicated, the total resistance of the fracture 2410 between the two plates 2420 is 2.39 Ohms. This is slightly less than the 2.71 Ohms prevalent in FIG. 16 from the first simulation. Thus, while the non-conductive connecting material 2427 around the ends of the plates 2420 should increase the resistance relative to the map 1300 of FIG. 16, the steel plates are much longer, and their impact is to decrease the overall resistance of the fracture 2410.

A scale is provided in FIG. 27 measured in volts. The scale moves from −1.28-−1.12 to 1.12-1.28. In between, the scale moves through −0.16-0.0 and 0.0-0.16 volts.

It can be seen in FIG. 27 that negative voltage values exist immediately at the right connector 2420R, and positive voltage values exist immediately at the left connector 2420L. Of interest, current is still focused in the vicinity of the plates 2420, meaning that there is a higher concentration of current at the steel plates 2420. However, no current pathways are seen in the areas where the non-conductive intermediate granular material 2427 resides. The current must now go around the non-conductive material 2427, effectively mitigating the highly focused current of the first simulation.

Figure 28:
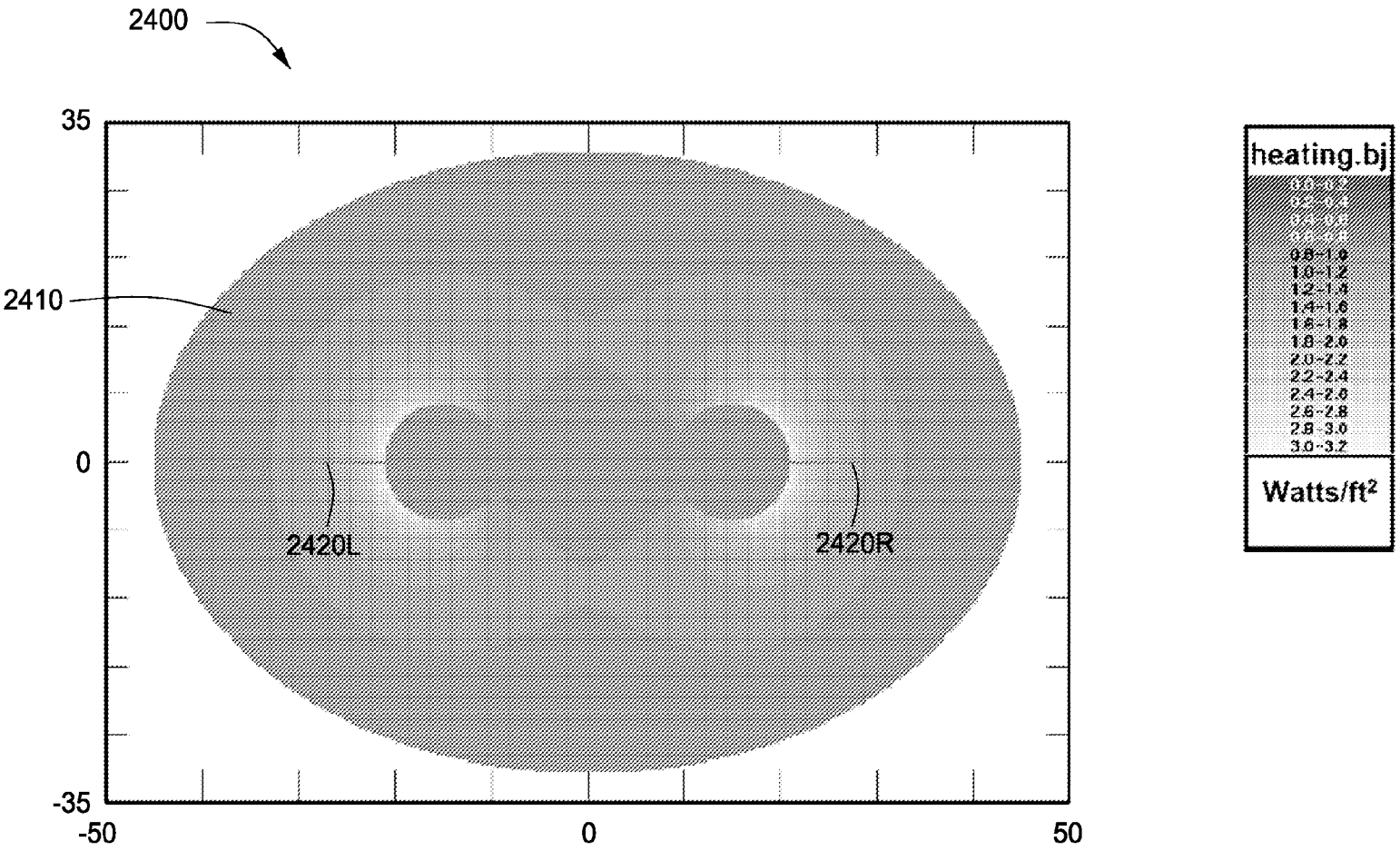
FIG. 28 shows a heating distribution within the fracture plane of FIG. 24.
Figure 29:
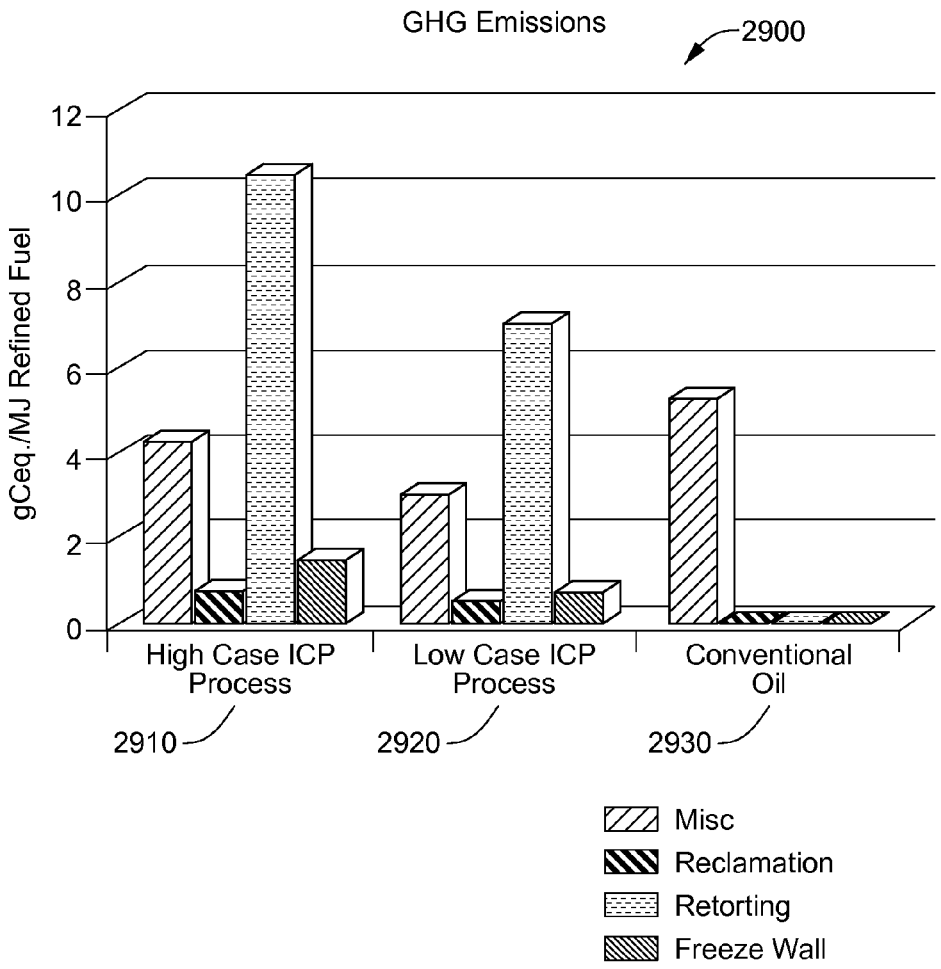
FIG. 29 is a graphical view of estimated greenhouse gas emissions associated with conventional hydrocarbons and an exemplary process for the in situ conversion of oil shale.

Finally, FIG. 28 demonstrates the resulting heating distribution in the fracture 2410 from the simulation. The units of the map 2400 are measured in Watts/ft$^2$. A gray-scale is provided indicating values from 0.0-0.2 up to 3.0-3.2 Watts/ft$^2$. As can be seen, the heat distribution in the map 2400 in FIG. 28 shows a total heat input of 1,000 Watts. No areas of intense heat generation around the plates 2420L, 2420R are seen. Indeed, heat generation is essentially zero in the area where the non-conductive granular material 2427 is emplaced. However, the heating distribution is not nearly as uniform as the heating distribution seen in FIG. 23 for the second simulation. For this reason, the use of higher conductivity material (as in the second simulation) rather than non-conductive material (as in the third simulation) is considered preferable.

The above-described processes may be of merit in connection with the recovery of hydrocarbons in the Piceance Basin of Colorado. Some have estimated that in some oil shale deposits of the Western United States, up to 1 million barrels of oil may be recoverable per surface acre. One study has estimated the oil shale resource within the nahcolite-bearing portions of the oil shale formations of the Piceance Basin to be 400 billion barrels of shale oil in place. Overall, up to 1 trillion barrels of shale oil may exist in the Piceance Basin alone.

Certain features of the present description are described in terms of a set of numerical upper limits and a set of numerical lower limits. It should be appreciated that ranges formed by any combination of these limits are within the scope of the description unless otherwise indicated. Although some of the dependent claims have single dependencies in accordance with U.S. practice, each of the features in any of such dependent claims can be combined with each of the features of one or more of the other dependent claims dependent upon the same independent claim or claims.

While it will be apparent that the description herein described is well calculated to achieve the benefits and advantages set forth above, it will be appreciated that the description is susceptible to modification, variation and change without departing from the spirit thereof.

Although many examples of this description are applicable to transforming solid organic matter into producible hydrocarbons in oil shale, many aspects of this description may also be applicable to heavy oil reservoirs, or tar sands. In these instances, the electrical heat supplied would serve to reduce hydrocarbon viscosity. Additionally, while the present description has been described in terms of one or more preferred embodiments, it is to be understood that other modifications may be made without departing from the scope of the description, which is set forth in the claims below.

TABLE OF REFERENCES

REF. 1: Berry, K. L., Hutson, R. L., Sterrett, J. S., and Knepper, J. C., 1982, Modified in situ retorting results of two field retorts, Gary, J. H., ed., 15th Oil Shale Symp., CSM, p. 385-396.
REF. 2: Bridges, J. E., Krstansky, J. J., Taflove, A., and Sresty, G., 1983, The IITRI in situ fuel recovery process, J. Microwave Power, v. 18, p. 3-14.
REF. 3: Bouck, L. S., 1977, Recovery of geothermal energy, U.S. Pat. No. 4,030,549.
REF. 4: Chute, F. S., and Vermeulen, F. E., 1988, Present and potential applications of electromagnetic heating in the in situ recovery of oil, AOSTRA J. Res., v. 4, p. 19-33.
REF. 5: Covell, J. R., Fahy, J. L., Schreiber, J., Suddeth, B. C., and Trudell, L., 1984, Indirect in situ retorting of oil shale using the TREE process, Gary, J. H., ed., 17th Oil Shale Symposium Proceedings, Colorado School of Mines, p. 46-58.
REF. 6: Crowson, F. L., 1971, Method and apparatus for electrically heating a subsurface formation, U.S. Pat. No. 3,620,300.
REF. 7: Gill, W. G., 1972, Electrical method and apparatus for the recovery of oil, U.S. Pat. No. 3,642,066.
REF. 8: Gipson, L. P., and Montgomery, C. T., 1997, Method for increasing the production of petroleum from a subterranean formation penetrated by a wellbore, U.S. Pat. No. 5,620,049.
REF. 9: Gipson, L. P., and Montgomery, C. T., 2000, Method of treating subterranean gas hydrate formations, U.S. Pat. No. 6,148,911.
REF. 10: Humphrey, J. P., 1978, Energy from in situ processing of Antrim oil shale, DOE Report FE-2346-29.
REF. 11: Lekas, M. A., Lekas, M. J., and Strickland, F. G., 1991, Initial evaluation of fracturing oil shale with propellants for in situ retorting - Phase 2, DOE Report DOE/MC/11076-3064.
REF. 12: Little, W. E., and McLendon, T. R., 1987, Method for in situ heating of hydrocarbonaceous formations, U.S. Pat. No. 4,705,108.
REF. 13: Oil & Gas Journal, 1998, Aussie oil shale project moves to Stage 2, Oct. 26, p. 42.
REF. 14: Orkiszewski, J., Hill, J. L., McReynolds, P. S., and Boberg, T. C., 1964, Method and apparatus for electrical heating of oil-bearing formations, U.S. Pat. No. 3,149,672.
REF. 15: Osborne, J. S., 1983, In situ oil shale process, U.S. Pat. No. 4,401,162.
REF. 16: Passey, Q. R., Thomas, M. M., and Bohacs, K. M., 2001, WO 01/81505.
REF. 17: Pittman, R. W., Fontaine, M. F., 1984, In situ production of hydrocarbons including shale oil, U.S. Pat. No. 4,487,260.
REF. 18: Riva, D. and Hopkins, P., 1998, Suncor down under: the Stuart Oil Shale Project, Annual Meeting of the Canadian Inst. of Mining, Metallurgy, and Petroleum, Montreal, May 3-7.
REF. 19: Salamonsson, G., 1951, The Ljungstrom in situ method for shale-oil recovery, Sell, G., ed., Proc. of the 2nd Oil Shale and Cannel Coal Conf., v. 2, Glasgow, July 1950, Institute of Petroleum, London, p. 260-280.
REF. 20: Segalman, D. J., 1986, Electrode well method and apparatus, U.S. Pat. No. 4,567,945.
REF. 21: Stevens, A. L., and Zahradnik, R. L., 1983, Results from the simultaneous processing of modified in situ retorts 7& 8, Gary, J. H., ed., 16th Oil Shale Symp., CSM, p. 267-280.
REF. 22: Tissot, B. P., and Welte, D. H., 1984, Petroleum Formation and Occurrence, New York, Springer-Verlag, p. 699.
REF. 23: Tyner, C. E., Parrish, R. L., and Major, B. H., 1982, Sandia/Geokinetics Retort 23: a horizontal in situ retorting experiment, Gary, J. H., ed., 15th Oil Shale Symp., CSM, p. 370-384.
REF. 24: Van Meurs, P., DeRouffiguan, E. P., Vinegar, H. J., and Lucid, M. F., 1989, Conductively heating a subterranean oil shale to create permeability and subsequently produce oil, U.S. Pat. No. 4,886,118
REF. 25: Vermeulen, F. E., 1989, Electrical heating of reservoirs, Hepler, L., and Hsi, C., eds., AOSTRA Technical Handbook on Oil Sands, Bitumens, and Heavy Oils, Chapt. 13, p. 339-376.
REF. 26: Yen, T. F., and Chilingarian, G. V., 1976, Oil Shale, Amsterdam, Elsevier, p. 292.
REF. 27: Parker, H. W. 1960, In Situ Electrolinking of Oil Shale, U.S. Pat. No. 3,137,347.

We claim:

1. A method of treating a subterranean formation that contains solid organic matter, said method comprising:

(a) heating a treatment interval within the subterranean formation with one or more electrical in situ heaters;

(b) determining available power for the one or more electrical in situ heaters at regular, predetermined intervals; and (c) selectively controlling heating rates of the one or more electrical in situ heaters based on the determined available power at each regular, predetermined interval and based on an optimization model that outputs optimal heating rates for each of the electrical heaters at the determined available power.

2. The method of claim 1 further comprising running an optimization model to determine optimal heating rates for the one or more electrical heaters based on a first power input.

3. The method of claim 2, wherein running the optimization model is done prior to determining available power from a power source.

4. The method of claim 3, wherein the selectively controlled heating rates are selected from a library of optimal solutions predetermined by running the optimization model based on a plurality of different, available power values from the power source.

5. The method of claim 2, wherein running the optimization model comprises determining optimal heating rates for each electrical heater and a plurality of power inputs within a range of between 10 MW to 600 MW.

6. The method of claim 5, wherein the electrical heaters are resistive heaters.

7. The method of claim 6, wherein the power factor for each resistive heater is between 0.7 to 1.0, the power is three-phase AC power, each heater is operatively connected through a transformer to a power distribution sub-station servicing the treatment interval.

8. The method of claim 6, wherein the electrical heaters are wellbore heaters.

9. The method of claim 6, wherein the electrical heaters comprise one or more electrically conductive fractures.

10. The method of claim 2, wherein running the optimization model is done after determining available power from a power source, the power source comprising one or more power sources providing electrical power through a utility grid.

11. The method of claim 2, wherein running the optimization model comprises determining optimal heating rates for each electrical heater and a plurality of power inputs within a range of between 0 MW to 1000 MW.

12. The method of claim 11, wherein the received data comprises one or more of predicted solar power, available wind power, and/or utility rates.

13. The method of claim 1, further comprising:

running an optimization model to determine optimal heating rates based on a first power input to the treatment interval; and obtaining a prediction of projected intermittent energy over an upcoming period, wherein the upcoming period is selected from a group of upcoming time periods consisting of 4 hour, 8 hour, 12 hour, 24 hour, 48 hour, and 72 hour or more time periods and the optimization model is ran to produce a library of optimal solutions based on the prediction of projected intermittent energy over the upcoming period.

14. The method of claim 1, wherein determining available power for the electrical heaters at regular, predetermined intervals includes receiving data from a utility grid indicating one or more of available power from the grid, source of the available power, and/or utility rates associated with the available power from the grid.

15. The method of claim 1, wherein determining available power for the electrical heaters includes determining available wind power in a particular geographic region.

16. The method of claim 1, wherein determining available power for the electrical heaters includes receiving data relating to one or more wind farms and their available power.

17. The method of claim 16, wherein the received data comprises one or more of predicted wind speed, actual real-time wind speed, available wind power, and/or utility rates, and the selectively controlled heating rates are controlled based upon one or more of wind speed, actual real-time wind speed, available wind power, or utility rates from the received data.

18. The method of claim 1, wherein determining available power for the electrical heaters includes determining available solar power in a particular geographic region.

19. The method of claim 1, wherein determining available power for the electrical heaters includes receiving data relating to one or more solar power generation facilities and their available power.

20. The method of claim 1, wherein selectively controlling heating rates of the one or more electrical heaters based on the determined available power includes switching one or more electrical heaters to a heating or non-heating condition based on the determined available power and based on an optimal solution from the optimization model.

21. The method of claim 1, wherein selectively controlling heating rates of the one or more electrical heaters includes load shedding heaters in response to drops in determined available power.

22. The method of claim 1, wherein selectively controlling heating rates of the one or more electrical heaters includes selectively altering voltage allocated to each of the one or more heaters based on the determined available power.

23. The method of claim 22, wherein selectively altering voltage includes designating a tap for a multi-tap transformer allocated to an individual heater or group of heaters based on determined, available power.

24. The method of claim 1, wherein the subterranean formation comprises an oil shale formation, a tar sands formation, a coal formation, and/or a conventional hydrocarbon formation.

25. A method of treating a subterranean formation that contains solid organic matter, said method comprising:

(a) heating a treatment interval within the subterranean formation with one or more in situ heating processes;

(b) determining one or more available resources for the treatment of the subterranean formation; and (c) selectively controlling heating rates of the one or more electrical heaters or another process parameter associated with the treatment interval based on the determined available resources and based on an optimization model that outputs optimal process controls based on the determined available resource.

26. The method of claim 25, wherein determining available resources for the treatment of the subterranean formation comprises determining at least one of available surface water or ground water for the treatment of the subterranean formation.

27. The method of claim 26, further comprising estimating water availability based on predicted snowmelt for a watershed utilized to source process water.

28. The method of claim 27, wherein selectively controlling heating rates of the one or more electrical heaters or other process parameters associated with the treatment interval is based on the estimated water availability.

29. The method of claim 28, wherein one or more heating rates are reduced in response to a estimated water availability being above or below a predetermined value.

30. The method of claim 26, wherein one or more heating rates are increased in response to estimated water availability being above or below a predetermined value.

31. The method of claim 26, wherein the heating rates are set to values determined by the optimization model and based on the determined available resource.

32. The method of claim 25, wherein the determined available resource comprises one or more of available renewable energy, available production equipment, or sales prices for a product produced from the treatment interval.

33. The method of claim 25, wherein selectively controlling the heating rates comprises controlling heating rates when market prices for a predetermined product or derivative product produced from the subterranean formation have changed relative to a threshold value or range.

34. The method of claim 25, wherein selectively controlling the one or more heating rates is performed dynamically based on real-time feedback concerning availability of a production resource.

35. The method of claim 25, further comprising activating additional heaters in the treatment interval based on a solution provided by the optimization model and in response to the determined available resource changing relative to a threshold value.

36. The method of claim 25, wherein the one or more in situ heating processes comprises at least one heating process selected from the group consisting of heating the formation with a heat transfer fluid introduced into the formation at a sustained temperature above 265 degrees C., electrically conductive fractures, or electrically conductive, resistive heating elements relying upon thermal conduction as a primary heat transfer mechanism.

37. The method of claim 25, further comprising:

recovering one or more formation water-soluble minerals from the formation by flushing the formation with an aqueous fluid to dissolve one or more first water-soluble minerals in the aqueous fluid to form a first aqueous solution; and producing the first aqueous solution to the surface.

38. The method of claim 37, wherein flushing the formation is initiated based on determining at least one of available surface water or available ground water for the treatment of the subterranean formation.

39. The method of claim 38, wherein flushing of the formation for producing the first aqueous solution to the surface is performed before or after substantially heating the formation and producing hydrocarbons from the formation, and the one or more formation water-soluble minerals comprise sodium, nahcolite (sodium bicarbonate), dawsonite, soda ash, or combinations thereof.

40. A tangible computer-readable storage medium includes embodied thereon a computer program configured to, when executed by a processor, calculate at least one optimal solution for selectively adjusting heating rates for one or more in situ heaters for a treatment interval within a subterranean formation based on running a optimization model utilizing one or more of variable, intermittent source power, utility prices, and/or estimated available production resources, the computer-readable storage medium comprising one or more code segments configured to run the optimization model to output the at least one optimal solution.

* * * * *